US010539063B2

(12) United States Patent
Ito et al.

(10) Patent No.: US 10,539,063 B2
(45) Date of Patent: Jan. 21, 2020

(54) COOLING SYSTEM FOR COOLING AN INTERNAL COMBUSTION ENGINE

(71) Applicants: DENSO CORPORATION, Kariya, Aichi-pref. (JP); SOKEN, INC., Nisshin, Aichi-pref. (JP)

(72) Inventors: Yuji Ito, Nisshin (JP); Kentaro Yutani, Nisshin (JP); Tomotaka Sugishita, Nisshin (JP); Motomasa Iizuka, Nisshin (JP); Takeo Matsumoto, Kariya (JP)

(73) Assignees: DENSO CORPORATION, Kariya (JP); SOKEN, INC., Nisshin (JP)

( * ) Notice: Subject to any disclaimer, the term of this patent is extended or adjusted under 35 U.S.C. 154(b) by 0 days.

(21) Appl. No.: 16/258,856

(22) Filed: Jan. 28, 2019

(65) Prior Publication Data

US 2019/0170051 A1 Jun. 6, 2019

Related U.S. Application Data

(63) Continuation of application No. PCT/JP2017/027385, filed on Jul. 28, 2017.

(30) Foreign Application Priority Data

Aug. 1, 2016 (JP) ..... 2016-151442

(51) Int. Cl.
*F01P 5/12* (2006.01)
*F01P 3/02* (2006.01)
(Continued)

(52) U.S. Cl.
CPC ..... *F01P 5/12* (2013.01); *F01P 3/02* (2013.01); *F01P 7/16* (2013.01); *F01P 11/16* (2013.01);
(Continued)

(58) Field of Classification Search
CPC ..... F01P 5/12; F01P 5/10; F01P 3/02; F01P 7/16; F01P 11/16; F01P 11/18;
(Continued)

(56) References Cited

U.S. PATENT DOCUMENTS 6,604,371 B2 * 8/2003 Ueno ..... F04B 39/0207 62/129
8,146,542 B2 * 4/2012 Cattani ..... F01P 3/12 123/41.1
8,746,187 B2 * 6/2014 Nogawa ..... F01P 3/02 123/41.82 R
9,347,364 B2 * 5/2016 Quix ..... F01P 3/12
2003/0131806 A1 * 7/2003 Suzuki ..... B60H 1/00492 123/41.14
(Continued)

FOREIGN PATENT DOCUMENTS

JP 2005-016435 1/2005
JP 2009-197641 9/2009
(Continued)

*Primary Examiner* — Grant Moubry
(74) *Attorney, Agent, or Firm* — Nixon & Vanderhye P.C.

(57) ABSTRACT

The cooling system is provided with an internal passage for circulating the cooling water inside an internal combustion engine, a water pump provided in an one end side external passage connected to the one end portion of the internal passage, and an ECU configured to execute a water flow switching control that switches a cooling water flow in the internal passage between a forward flow directed from the one end portion of the internal passage to the other end portion and a reverse flow directed from the other end portion to the one end portion.

10 Claims, 55 Drawing Sheets

(51) Int. Cl.

| | |
|---|---|
| ***F01P 7/16*** | (2006.01) |
| ***F04B 49/02*** | (2006.01) |
| ***F01P 11/16*** | (2006.01) |
| ***F01P 11/18*** | (2006.01) |

(52) U.S. Cl.
CPC ..... *F01P 11/18* (2013.01); *F04B 49/02* (2013.01); *F01P 2003/021* (2013.01); *F01P 2003/024* (2013.01); *F01P 2005/125* (2013.01); *F01P 2037/02* (2013.01)

(58) Field of Classification Search
CPC ..... F01P 2003/024; F01P 2003/021; F01P 2005/125; F01P 2037/02; F04B 49/02
See application file for complete search history.

(56) References Cited

U.S. PATENT DOCUMENTS

| | | | | |
|---|---|---|---|---|
| 2004/0060524 | A1* | 4/2004 | Hwang | F01P 3/02 123/41.28 |
| 2008/0190597 | A1* | 8/2008 | Pantow | F01P 7/165 165/287 |
| 2013/0167784 | A1* | 7/2013 | Quix | F02M 26/33 123/41.1 |
| 2017/0328254 | A1* | 11/2017 | Baltes | F02G 5/00 |

FOREIGN PATENT DOCUMENTS

| | | |
|---|---|---|
| JP | 2011-021495 | 2/2011 |
| JP | 2014-231824 | 12/2014 |

* cited by examiner

COOLING SYSTEM FOR COOLING AN INTERNAL COMBUSTION ENGINE

CROSS REFERENCE TO RELATED APPLICATION

The present application is a continuation application of International Patent Application No. PCT/JP2017/027385 filed on Jul. 28, 2017, which designated the U.S. and claims the benefits of priority of Japanese Patent Application No. 2016-151442 filed on Aug. 1, 2016. The entire disclosure of all of the above applications is incorporated herein by reference.

TECHNICAL FIELD

The present disclosure relates to a cooling system for cooling an internal combustion engine and a control device for the cooling system.

BACKGROUND

A cooling water passage is provided in a cylinder head and a cylinder block of an internal combustion engine and an electric water pump pumps cooling water to a cooling water passage in order to warm up and cool the internal combustion engine.

SUMMARY

It is an object of the present disclosure to provide a cooling system and a control device which is possible to avoid the local boiling of the cooling water while maximizing the stop period of the water pump at the time of starting the internal combustion engine.

The present disclosure relates to a cooling system for cooling an internal combustion engine, comprising: an internal passage for circulating cooling water inside of an internal combustion engine; a water pump that is provided in an one-end side external passage connected to one end portion of the internal passage; a water flow switching unit that executes a water flow switching control to switch a forward flow from the one end of the internal passage to the other end portion of the flow of the cooling water in the internal passage and a reverse flow flowing from the end portion to the one end portion.

DETAILED DESCRIPTION

Figure 1:
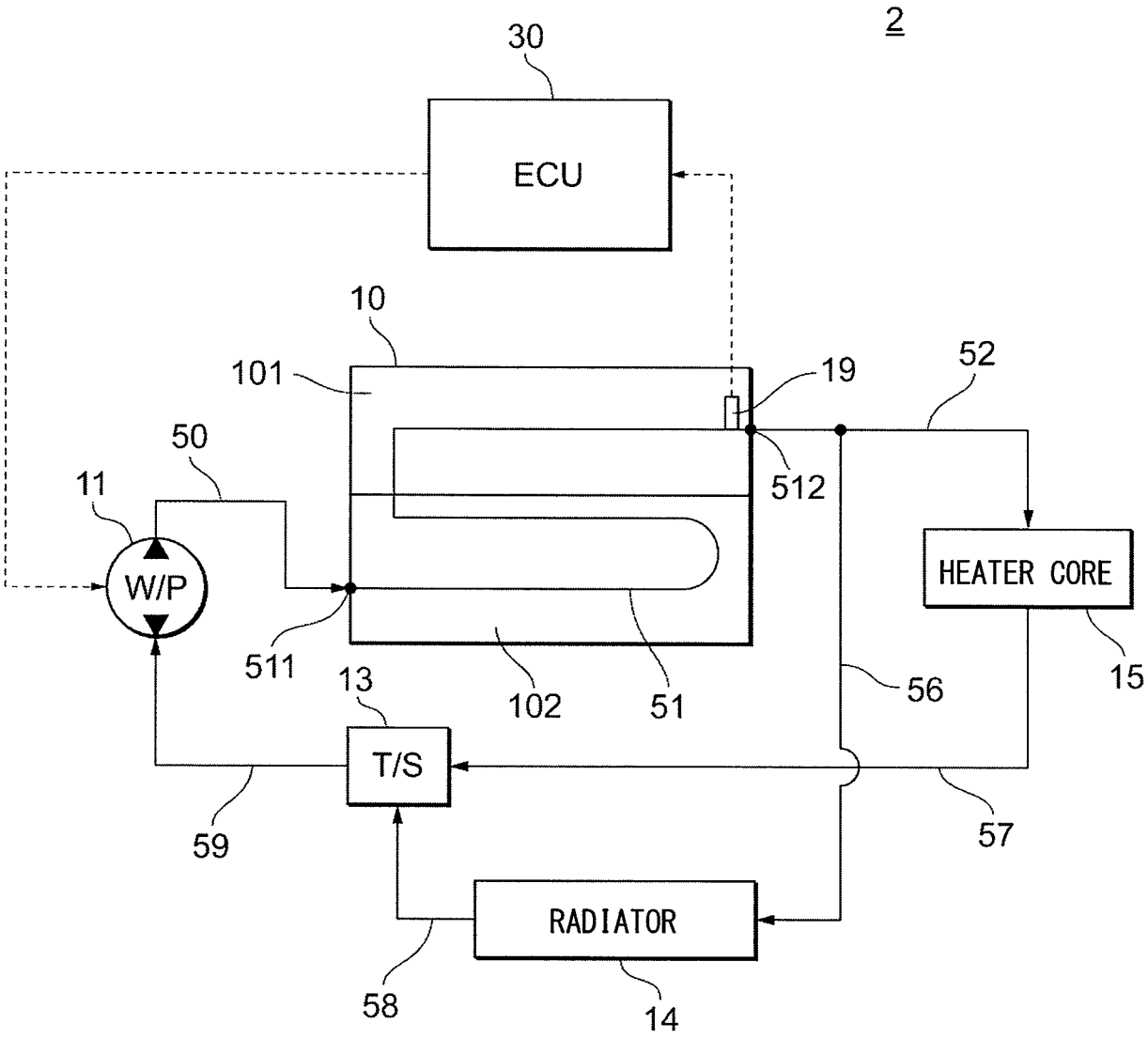
FIG. 1 is a system configuration diagram showing a configuration of a cooling system according to a first embodiment of the present disclosure.

Hereinafter, the present embodiment will be described with reference to the attached drawings. In order to facilitate the ease of understanding, the same reference numerals are attached to the same constituent elements in each drawing where possible, and redundant explanations are omitted.

As shown in FIG. 1, a cooling system 2 according to a first embodiment of the present disclosure includes an internal combustion engine 10, a water pump (W/P) 11, a thermostat 13, a radiator 14, a heater core 15, an ECU (Electronic Control Unit) 30.

The internal combustion engine 10 has a cylinder head 101 and a cylinder block 102. The cylinder head 101 is provided with a combustion chamber (not shown) for burning fuel. The cylinder block 102 is provided with a piston (not shown) and a crankshaft (not shown).

The internal combustion engine 10 is further provided with a cooling water passage 51 for passing cooling water so as to cool the cylinder head 101 and the cylinder block 102. The cooling water passage 51 is formed from one end portion 511 on the cylinder block 102 side to the other end portion 512 on the cylinder head 101 side. The cooling water passage 51 corresponds to the internal passage of the present disclosure.

A water temperature sensor 19 is provided on the other end portion 512 side of the cooling water passage 51. The water temperature sensor 19 is a sensor configured to detect the water temperature of the cooling water in the cooling water passage 51. The water temperature sensor 19 is provided in the most downstream portion of the cooling water passage 51 in the cylinder head 101. In the cylinder head 101, the central portion of the portion where the combustion chamber is provided has the highest temperature, so that the water temperature of the portion measured by the water temperature sensor 19 becomes lower than the temperature at the highest temperature portion. The water temperature sensor 19 outputs an electric signal indicating the water temperature to the ECU 30.

A downstream end of the cooling water passage 50 is connected to one end portion 511 of the cooling water passage 51. Since the upstream side of the cooling water passage 51 is provided in the cylinder block 102, the cooling water passage 50 is connected to the one end portion 511 of the cooling water passage 51 in the cylinder block 102.

The upstream end of the cooling water passage 50 is connected to a discharge port side when the water pump 11 rotates in the forward direction. The cooling water discharged under pressure by driving the water pump 11 is sent to the internal combustion engine 10 through the cooling water passage 50.

The water pump 11 is an electric pump. The water pump 11 is rotationally driven in the forward direction according to a drive signal output from the ECU 30. When the water pump 11 is rotationally driven in the forward direction, the cooling water is discharged to the cooling water passage 50 side. The water pump 11 is configured to be rotationally driven in the reverse direction in accordance with the drive signal output from the ECU 30. When the water pump 11 is rotationally driven in the reverse direction, the cooling water is discharged toward the cooling water passage 59 side.

An upstream end of the cooling water passage 52 is connected to the other end portion 512 of the cooling water passage 51. Since the downstream side of the cooling water passage 51 is provided in the cylinder head 101, the cooling water passage 51 is connected to the upstream end of the cooling water passage 52 in the cylinder head 101. The cooling water passage 51 corresponds to the other end side external passage of the present disclosure.

The downstream end of the cooling water passage 52 is connected to the heater core 15. The heater core 15 is connected to the upstream end of the cooling water passage 57. The cooling water flowing into the heater core 15 from the cooling water passage 52 flows through the heater core 15 and flows out to the cooling water passage 57. Since the cooling water flowing out from the internal combustion engine 10 has a high temperature, heat exchange is performed with a conditioned air in the heater core 15, and the air conditioning air is heated. The cooling water flowing in the heater core 15 flows out into the cooling water passage 57 in a state in which the temperature is lowered.

The cooling water passage 56 diverges from the middle of the cooling water passage 52. The downstream end of the cooling water passage 56 is connected to the radiator 14. The radiator 14 is connected to an upstream end of the cooling water passage 58. The cooling water flowing into the radiator 14 from the cooling water passage 56 flows through the radiator 14 and flows out to the cooling water passage 58. Since the cooling water flowing out from the internal combustion engine 10 has a high temperature, heat exchanges with the outside air in the radiator 14 and the temperature decreases. The cooling water flowing in the radiator 14 flows out into the cooling water passage 58 in a state where the temperature is lowered.

The downstream end of the cooling water passage 57 and the downstream end of the cooling water passage 58 are connected to the thermostat 13. The thermostat 13 is connected to the upstream end of the cooling water passage 59. When the temperature of the cooling water flowing into the thermostat 13 from the cooling water passages 57, 58 is lower than the threshold temperature, the thermostat 13 is closed and the cooling water from the cooling water passage 58 side is shut off. When the temperature of the cooling water flowing into the thermostat 13 from the cooling water passage 57 exceeds the threshold temperature, the thermostat 13 is opened, and the cooling water passing through the cooling water passage 58 flows out into the cooling water passage 59. The downstream end of the cooling water passage 59 is connected to the water pump 11.

Figure 2:
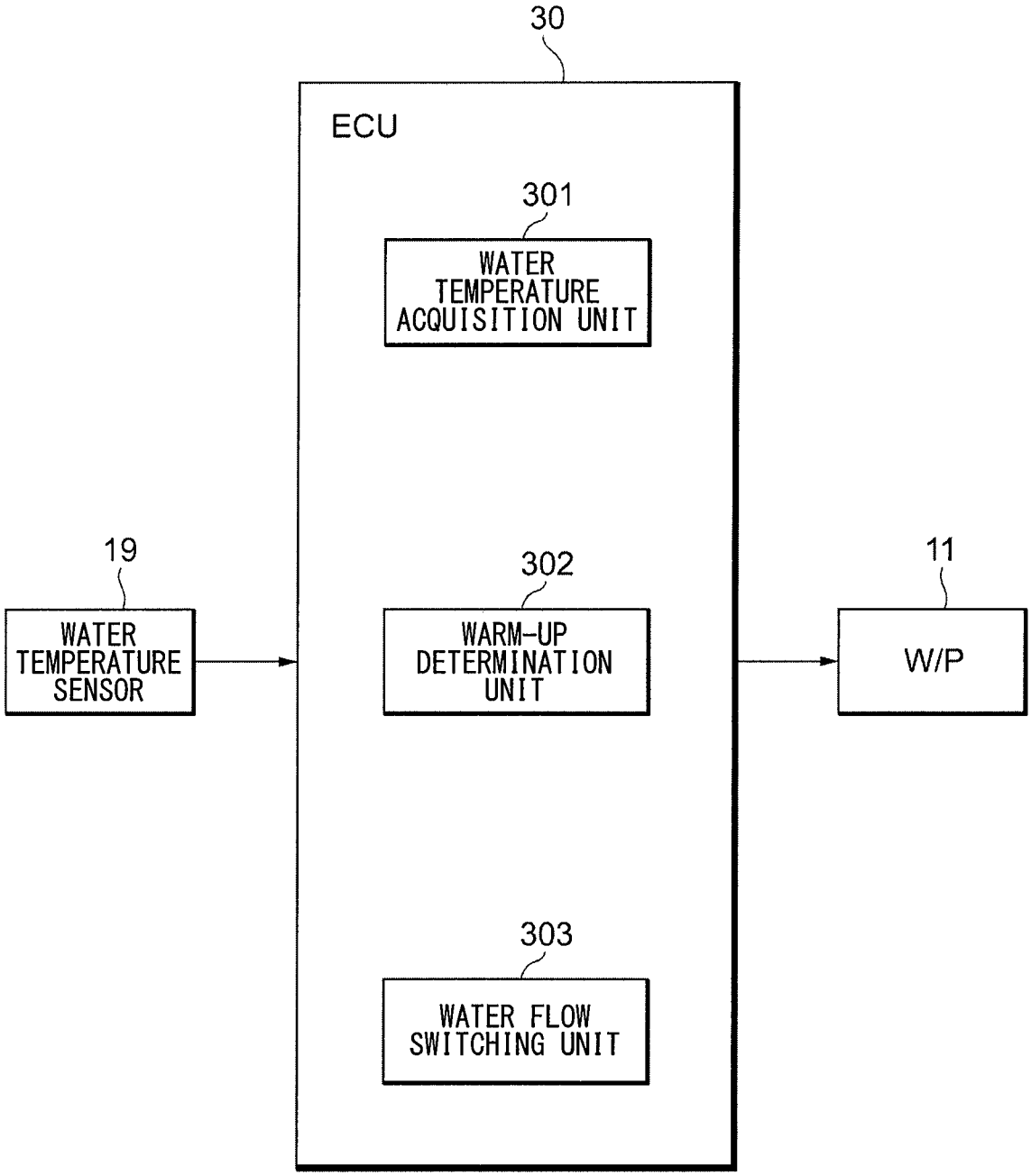
FIG. 2 is a block diagram for explaining a functional configuration of an ECU shown in FIG. 1.

Next, with reference to FIG. 2, the ECU 30 which is a control device used for the cooling system 2 will be described. The ECU 30 receives a water temperature detection signal output from the water temperature sensor 19. The ECU 30 outputs a drive signal to the water pump 11.

The ECU 30 includes a water temperature acquisition unit 301, a warm-up determination unit 302, and a water flow switching unit 303 as functional components.

The water temperature acquisition unit 301 is a part for obtaining the water temperature of the cooling water inside of the internal combustion engine 10. The water temperature acquisition unit 301 acquires the water temperature of the cooling water based on the water temperature detection signal output from the water temperature sensor 19. In the case of the present embodiment, a water temperature detection signal output from a water temperature sensor 19 provided inside the internal combustion engine 10 is used. However, the water temperature of the cooling water inside the internal combustion engine 10 may be estimated, based on the output result of the water temperature sensor provided outside the internal combustion engine 10.

The warm-up determination unit 302 determines the warm-up state of the internal combustion engine 10. The warm-up determination unit 302 determines whether or not the internal combustion engine 10 has been warmed up based on the cooling water temperature acquired by the water temperature acquisition unit 301.

Figure 3:
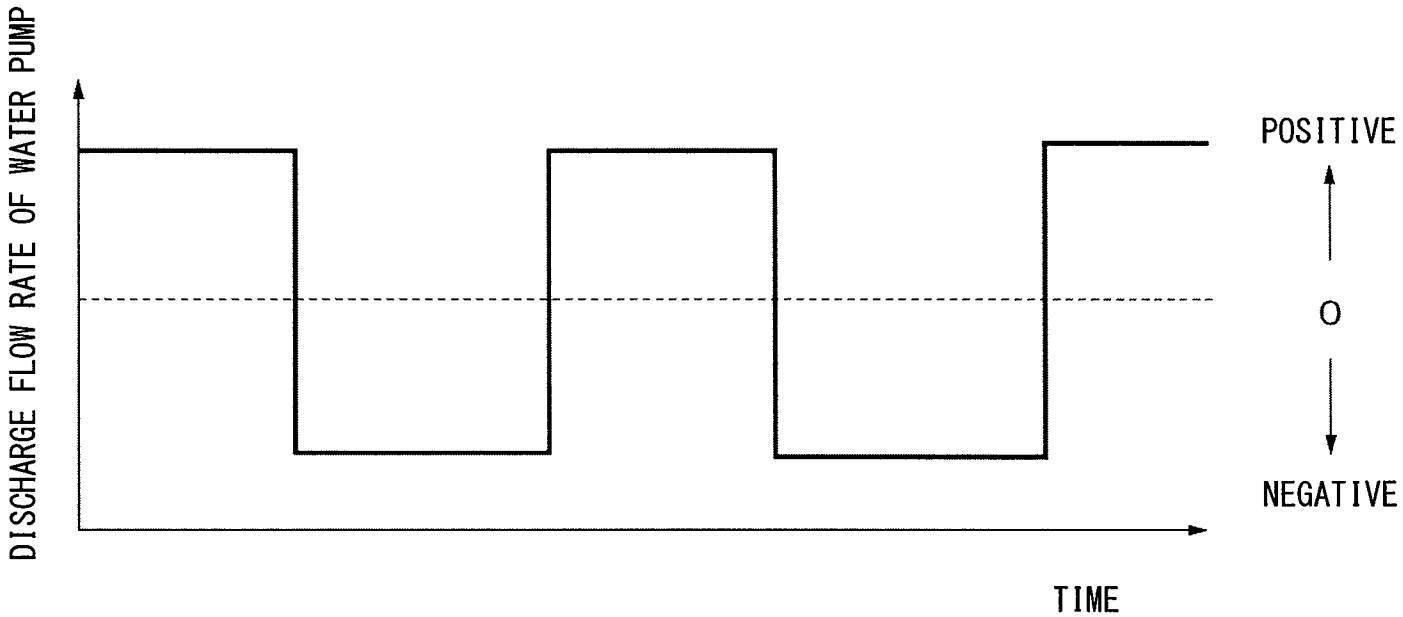
FIG. 3 is a diagram showing an example of flow rate variation of a water pump.

The water flow switching unit 303 is a part that executes the water flow switching control, and switches the forward flow from the one end portion 511 to the other end portion 512 of the cooling water passage 51 and the reverse flow from the other end portion 512 toward the one end portion 511 with respect to the flow of the cooling water in the cooling water passage 51. By executing the water flow switching control by the water flow switching unit 303, the discharge flow rate of the water pump 11 fluctuates in the forward direction and the reverse direction, as shown in FIG. 3.

Figure 4:
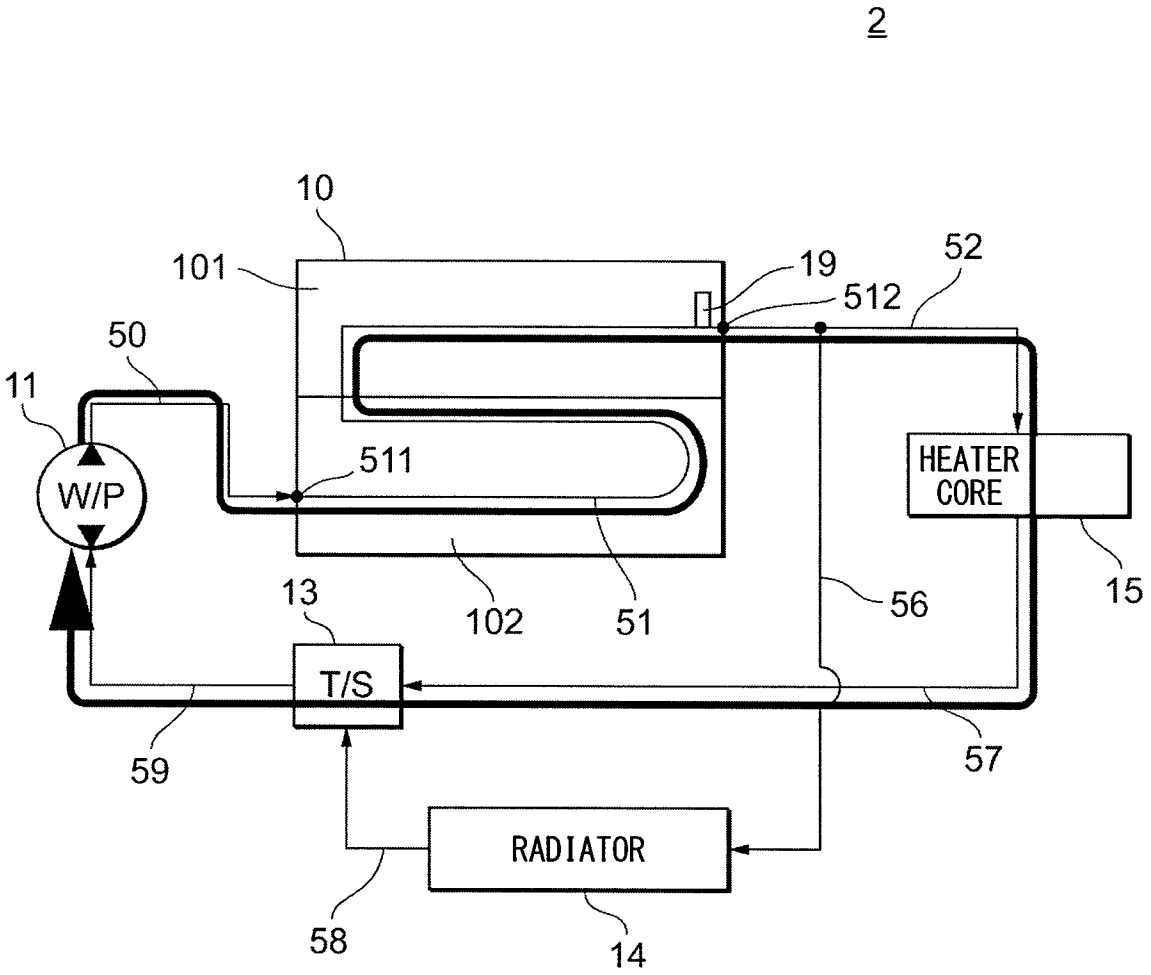
FIG. 4 is a diagram showing a state in which cooling water flows in a forward flow in the cooling system shown in FIG. 1.

FIG. 4 shows the flow of the cooling water when the water flow switching unit 303 executes the water flow switching control so that the flow of the cooling water flows in the forward direction. As shown in FIG. 4, the cooling water is discharged from the water pump 11, and flows in the order of the cooling water passage 50, the cooling water passage 51, the cooling water passage 52, the heater core 15, the cooling water passage 57, the thermostat 13, and the cooling water passage 59, and returns to the water pump 11.

Figure 5:
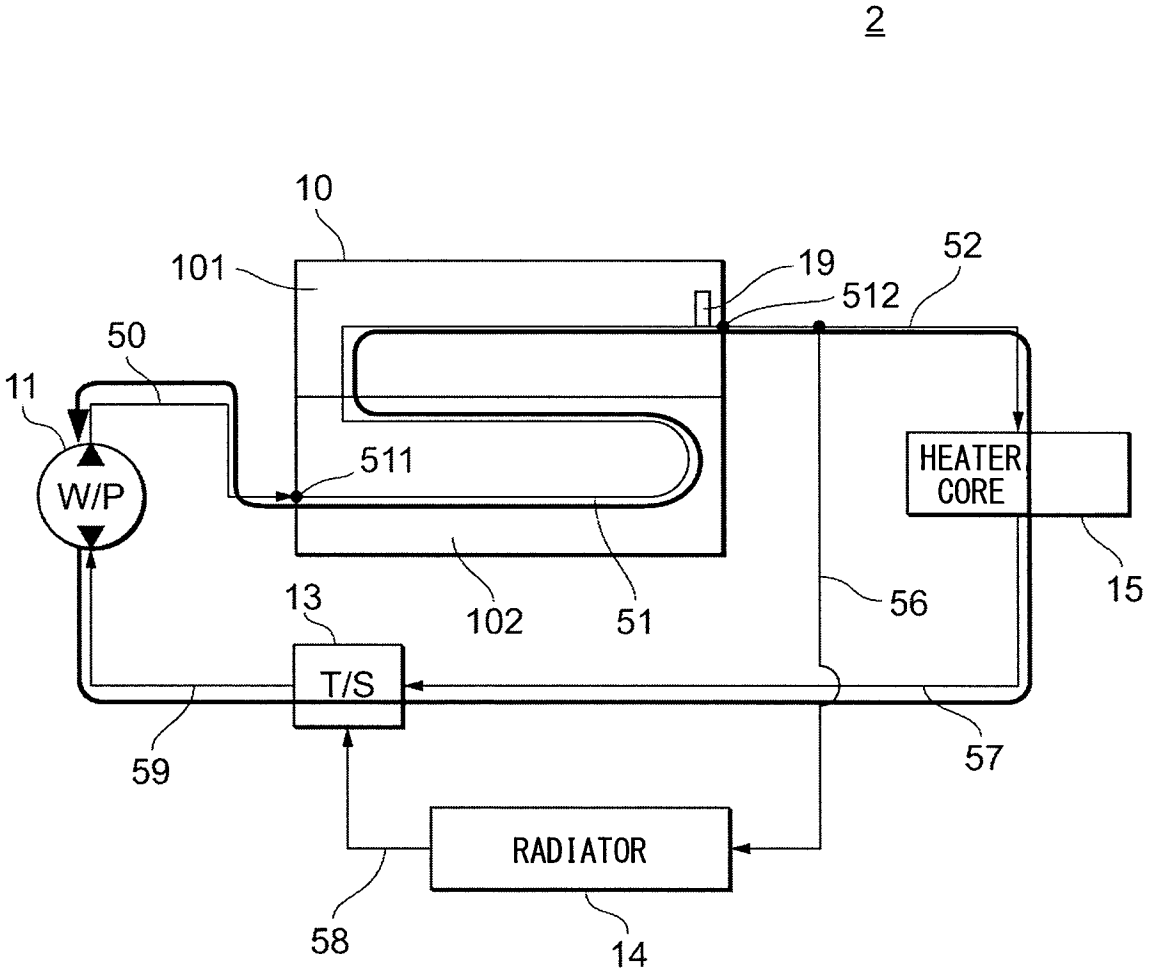
FIG. 5 is a diagram showing a state in which cooling water flows in a reverse flow in the cooling system shown in FIG. 1.

FIG. 5 shows the flow of the cooling water when the water flow switching unit 303 executes the water flow switching control so that the flow of the cooling water flows in the forward direction. As shown in FIG. 4, the cooling water is discharged from the water pump 11 and flows in the order of the cooling water passage 59, the thermostat 13, the cooling water passage 57, the heater core 15, the cooling water passage 52, the cooling water passage 51 and the cooling water passage 50, and returns to the water pump 11.

Figure 6:
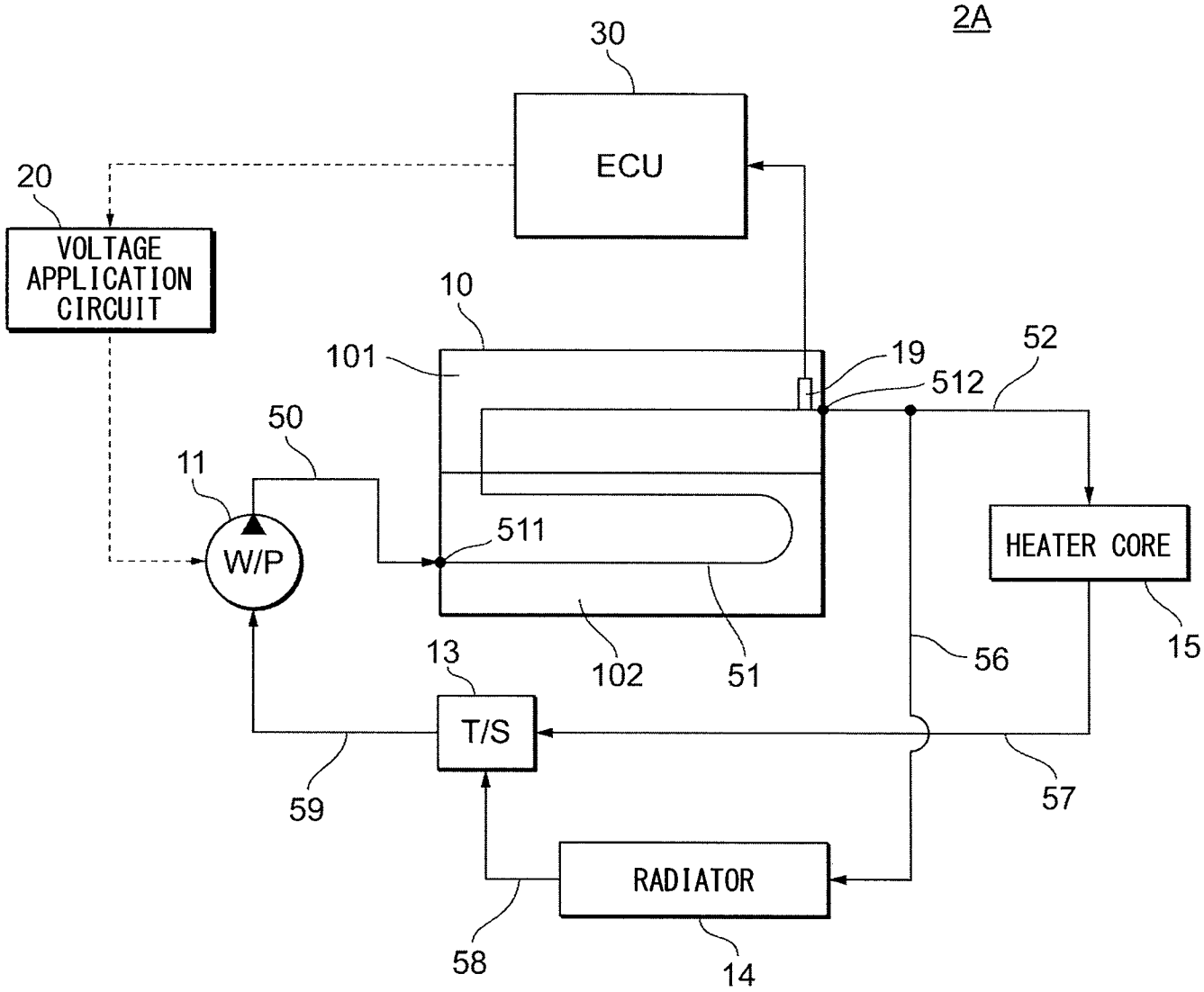
FIG. 6 is a system configuration diagram showing a configuration of a modification of the cooling system shown in FIG. 1.

Subsequently, a cooling system 2A as a modified example will be described with reference to FIG. 6. In the cooling system 2A, the voltage application circuit 20 is additionally provided in the cooling system 2. A drive signal is output from the ECU 30 to the voltage application circuit 20. An example of the voltage applied to the water pump 11 by the voltage application circuit 20 is shown in FIG. 7.

Figure 7:
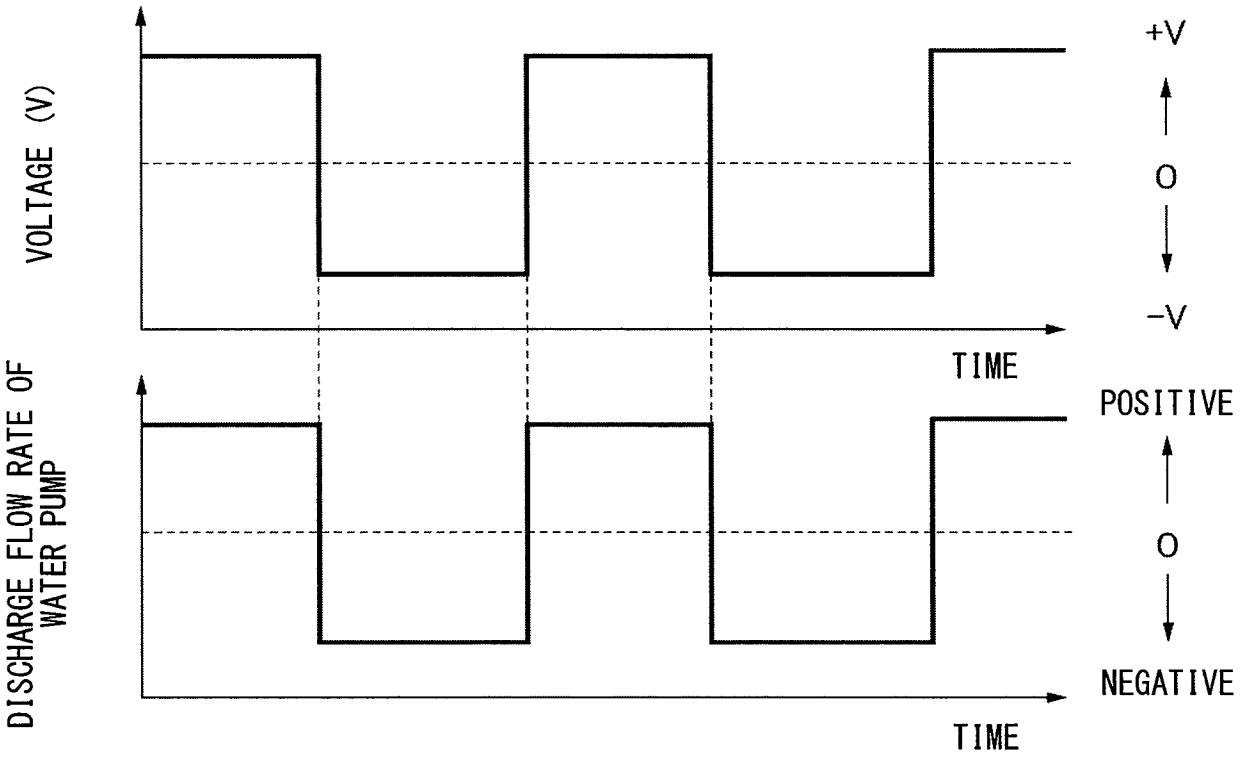
FIG. 7 is a diagram for explaining a relationship between an applied voltage and a flow rate of the water pump.

As shown in FIG. 7 (A), the voltage output from the voltage application circuit 20 periodically varies between the negative voltage (−V) and the positive voltage (+V). In accordance with the voltage fluctuation, as shown in FIG. 7 (B), the discharge flow rate of the water pump 11 fluctuates in the positive direction and the negative direction.

Figure 8:
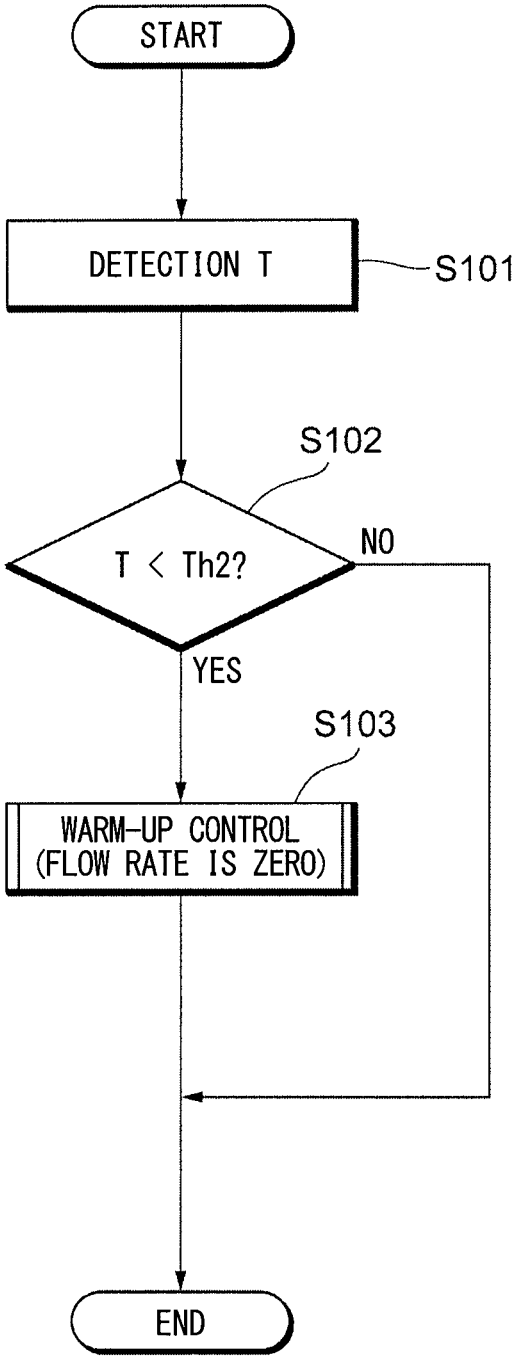
FIG. 8 is a flowchart for explaining a process of warm-up determination.

Subsequently, the operation of the cooling system 2 and the cooling system 2A will be described with reference to FIG. 8. In step S101, the water temperature acquisition unit 301 detects the water temperature sensor temperature T detected by the water temperature sensor 19.

In step S102 following step S101, the warm-up determination unit 302 determines whether or not the water temperature sensor temperature T has reached the warming-up temperature Th2. If the water temperature sensor temperature T has not reached the warming-up temperature Th2 (step S102: YES), the process proceeds to step S103. If the water temperature sensor temperature T has reached the warming-up temperature Th2 (step S102: NO), the process is terminated.

Figure 9:
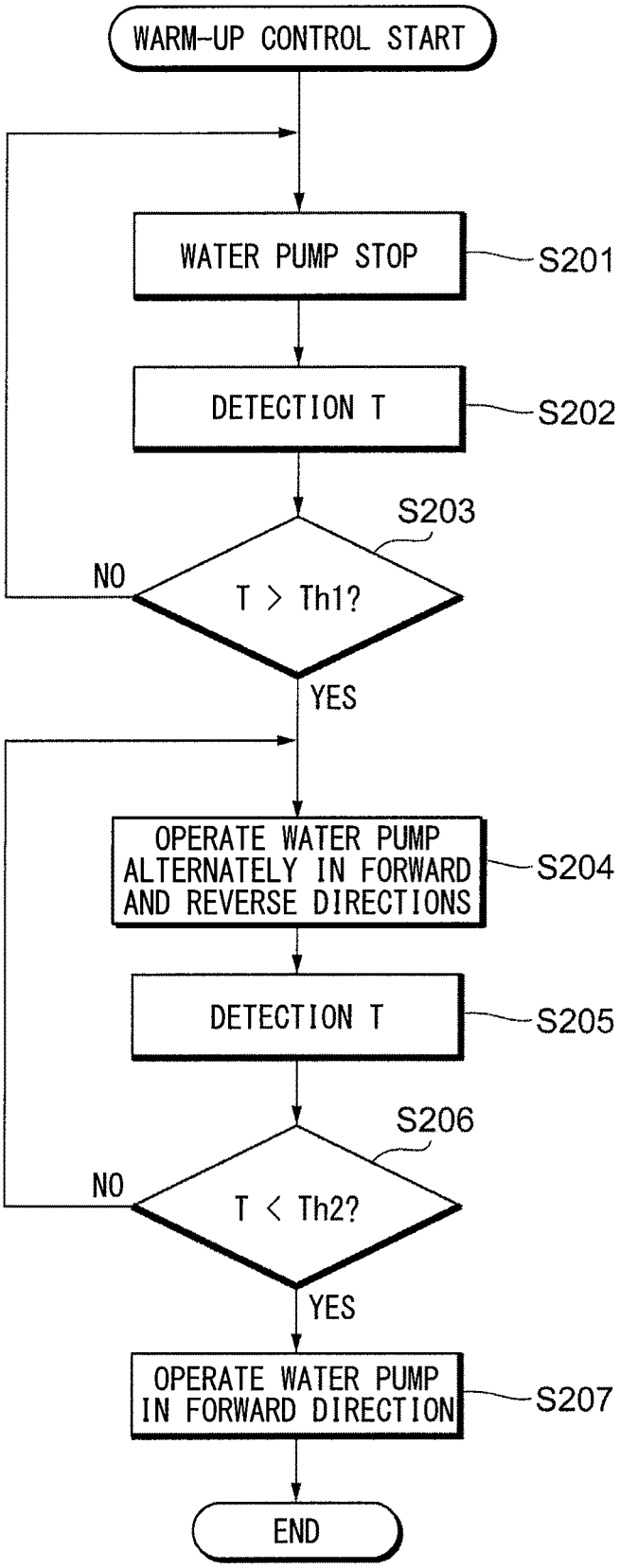
FIG. 9 is a flowchart for explaining a process of warm-up control.
Figure 10:
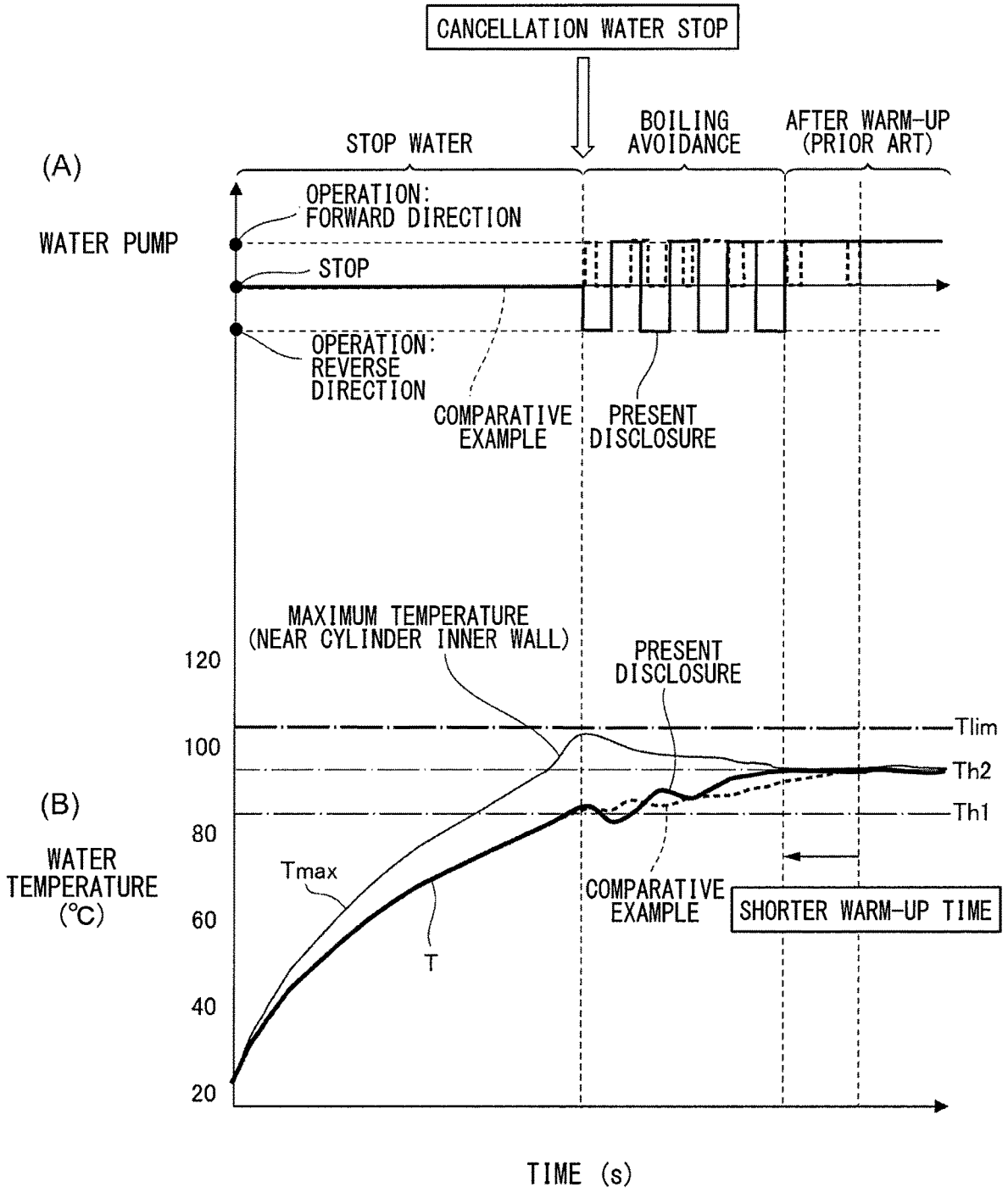
FIG. 10 is a diagram for explaining variations in water temperature when the processing shown in FIG. 9 is executed.

In step S103, the warm-up control is executed. The warm-up control will be described in detail with reference to FIGS. 9 and 10. FIG. 9 is a flowchart showing warm-up control. FIG. 10 is a diagram showing behaviors and temperatures of respective parts when warm-up control is performed. FIG. 10 (A) shows the operation and stop of the water pump 11. FIG. 10 (B) shows the temperature of the cooling water.

In step S201 of FIG. 9, the water flow switching unit 303 outputs a signal for stopping the water pump 11. In step S202 following step S201, the water temperature acquisition unit 301 detects the water temperature sensor temperature T detected by the water temperature sensor 19.

In step S203 following step S202, the warm-up determination unit 302 determines whether or not the water temperature sensor temperature T has reached the warming-up temperature Th1. The warm-up temperature Th1 is lower than the warm-up temperature Th2. If the water temperature sensor temperature T has not reached the warming-up temperature Th1 (step S203: NO), the process returns to step S201. If the water temperature sensor temperature T has reached the warming-up temperature Th1 (step S203: YES), the process proceeds to step S204.

In step S204, the water flow switching unit 303 alternately executes the forward rotation control of rotating the water pump 11 in the forward direction and the reverse rotation control of rotating the water pump 11 in the reverse direction. As shown in FIG. 10, the movement that the cooling water in the internal combustion engine 10 is once pushed out and then returned is repeated. Therefore, the temperature of the cooling water in the internal combustion engine 10 rises faster, and the warm-up time is shortened. Since the maximum temperature Tmax of the cooling water in the internal combustion engine 10 does not exceed the upper limit temperature Tlim, boiling of the cooling water can be avoided.

In step S205 following step S204, the water temperature acquisition unit 301 acquires the water temperature T. In step S206 following step S205, the warm-up determination unit 302 determines whether or not the water temperature sensor temperature T has reached the warming-up temperature Th2. If the water temperature sensor temperature T has not reached the warming-up temperature Th2 (step S206: NO), the process returns to step S204. If the water temperature sensor temperature T has reached the warming-up temperature Th2 (step S206: YES), the process proceeds to step S207. In step S207, the water flow switching unit 303 rotates the water pump 11 in the forward direction.

As described above, the cooling system 2 and the cooling system 2A according to the first embodiment are cooling systems that cool the internal combustion engine 10. The cooling systems have a cooling water passage 51 as an internal passage for circulating cooling water inside the internal combustion engine 10, a water pump 11 provided in a cooling water passage 50 as one end side external passage connected to one end portion 511 of the cooling water passage 51. The water flow switching unit 303 executes the water flow switching control to switch the forward flow from one end portion 511 to the other end portion 512 of the cooling water passage 51 and the reverse flow from the other end portion 512 to the one end portion 511 with respect to the flow of the cooling water in the cooling water passage 51.

When the internal combustion engine 10 warms up, the temperature of the cooling water locally rises in the cooling water passage 51. Therefore, by causing a flow to the cooling water, the cooling water whose temperature has been locally raised moves to a place where the temperature hardly rises so as to avoid boiling. Further, according to the present disclosure, since the control for switching the water flow is executed, the flow of the cooling water in the cooling water passage 51 as an internal passage can be switched between the forward flow and the reverse flow. It is possible to flow the once-warmed cooling water back into the internal combustion engine, by flowing the cooling water while switching the flow in an opposite direction. Therefore, earlier warm-up can be realized while avoiding local boiling.

The cooling system 2, 2A according to the present embodiment further includes a water temperature acquisition unit 301 that acquires the temperature of the cooling water inside the internal combustion engine 10. When the temperature of the cooling water inside the internal combustion engine 10 is lower than the lower threshold temperature Th1, the water flow switching unit 303 executes the water flow switching control.

It is not necessary to flow the cooling water at a temperature lower than the lower threshold temperature Th which is the temperature at which the cooling water inside the internal combustion engine 10 does not boil. Therefore, warm-up can be accelerated.

In the cooling system 2, 2A according to the present embodiment, when the temperature of the cooling water in the internal combustion engine 10 reaches the upper threshold temperature Th2 higher than the lower threshold temperature Th1, the water flow switching unit 303 ends the water flow switching control.

When the temperature of the cooling water reaches the upper threshold temperature Th2, warming-up of the internal combustion engine 10 is completed, so that the water flow switching control is terminated. The operation can be shifted to the circulation of the cooling water in the normal forward direction.

Further, in the cooling system 2, 2A according to the present embodiment, the water flow switching unit 303 executes the water flow switching control for changing the discharge direction of the cooling water by switching the rotation direction of the water pump 11 between the forward direction and the reverse direction.

By switching the rotation direction of the water pump 11, it is possible to execute the water flow switching control without adding other functional parts.

Figure 11:
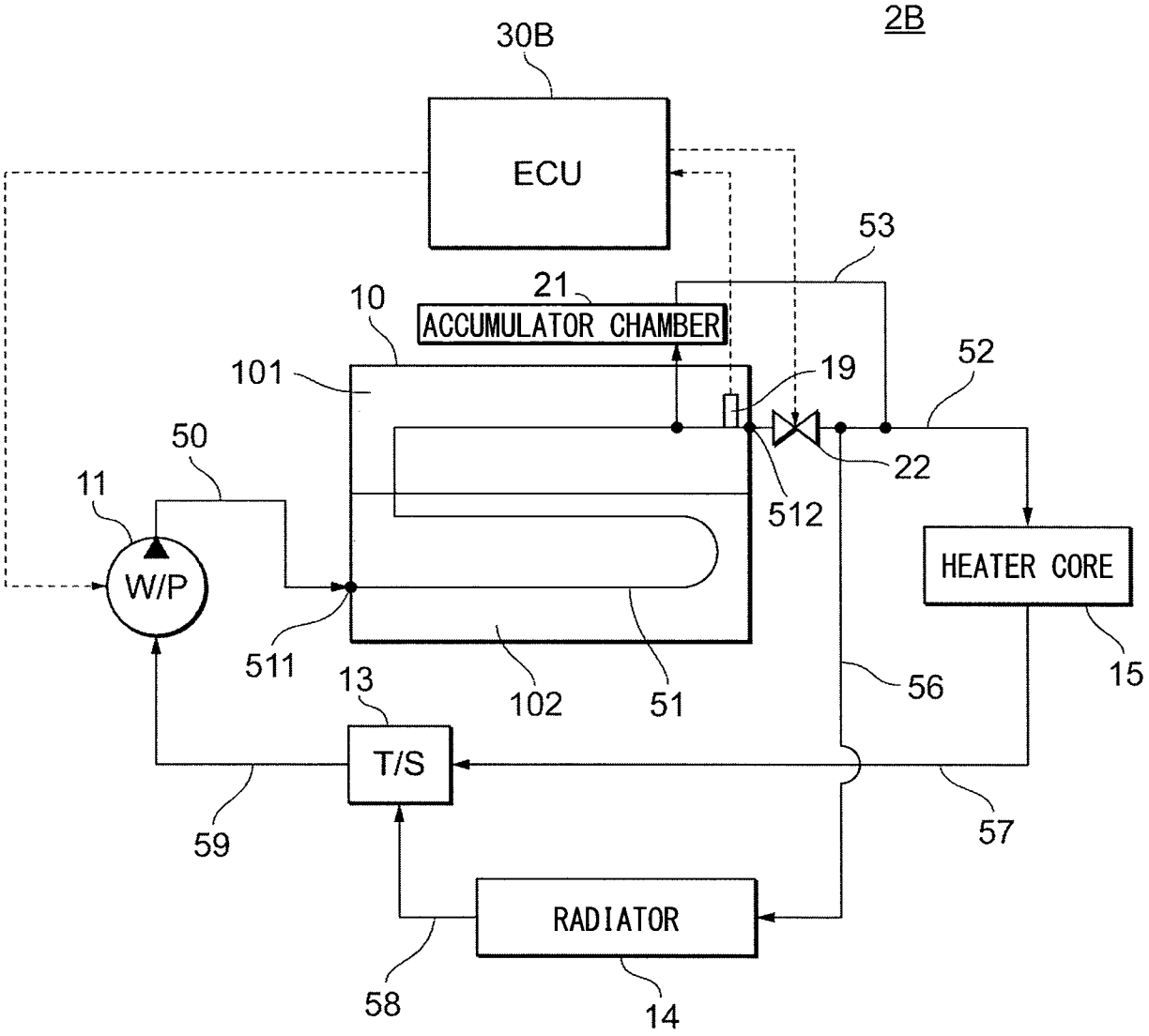
FIG. 11 is a system configuration diagram showing a configuration of a cooling system according to a second embodiment of the present disclosure.

Subsequently, the cooling system 2B according to a second embodiment will be described with reference to FIG. 11. As shown in FIG. 11, a cooling system 2B according to a second embodiment of the present disclosure includes the internal combustion engine 10, the water pump 11, the thermostat 13, the radiator 14, the heater core 15, and an ECU 30B. The internal combustion engine 10, the thermostat 13, the radiator 14, and the heater core 15 are the same as those in the first embodiment, and the explanation thereof is omitted. The water pump 11 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

The cooling system 2B further includes a bypass passage 53, an accumulator chamber 21 as a cooling water reservoir, and a two-way valve 22. The bypass passage 53 divides the cooling water from the other end portion 512 side of the cooling water passage 51 as the internal passage, and is provided to re-join the cooling water to the cooling water passage 52 which is the other end side external passage. The bypass passage 53 may divide and re-join the cooling water only in the cooling water passage 51, or may divide and re-join the cooling water only in the cooling water passage 52.

The accumulator chamber 21 is provided in the bypass passage 53. The accumulator chamber 21 functions as a cooling water reservoir capable of temporarily storing and releasing the cooling water.

The two-way valve 22 is provided in the cooling water passage 52 in parallel to the bypass passage 53. The two-way valve 22 can be provided in the cooling water passage parallel to the bypass passage 53, and the two-way valve 22 may be provided in the cooling water passage 51.

Figure 12:
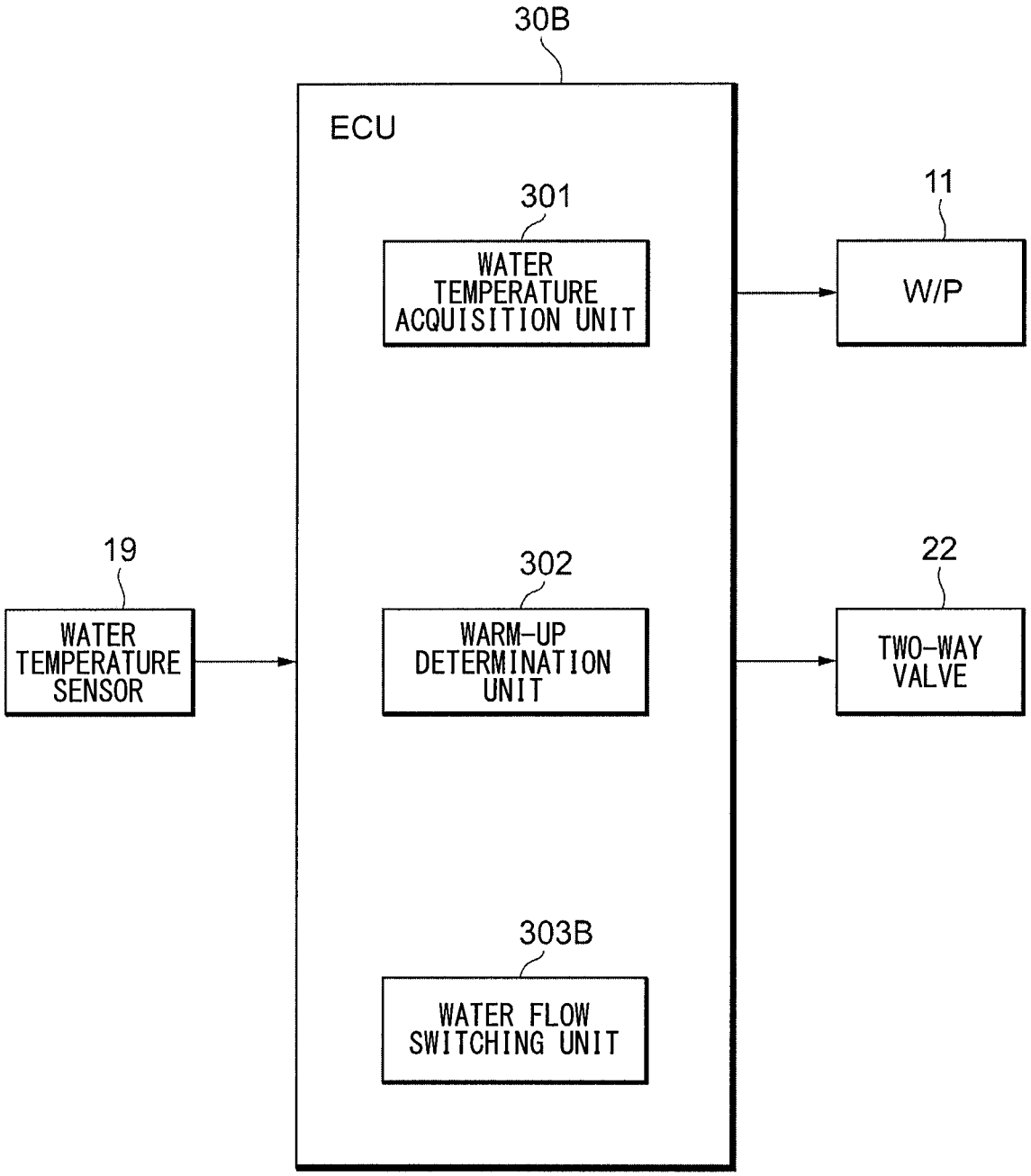
FIG. 12 is a block diagram for explaining a functional configuration of the ECU shown in FIG. 11.

Next, with reference to FIG. 12, the ECU 30B as a control device used for the cooling system 2B will be described. The ECU 30B receives a water temperature detection signal output from the water temperature sensor 19. The ECU 30B outputs drive signal to the water pump 11 and the two-way valve 22.

The ECU 30B includes a water temperature acquisition unit 301, a warm-up determination unit 302, and a water flow switching unit 303B as functional components.

The water temperature acquisition unit 301 and the warm-up determination unit 302 are the same as those described in the first embodiment, and the description thereof will be omitted.

The water flow switching unit 303B is a part that executes the water flow switching control, and switches the forward flow from the one end portion 511 to the other end portion 512 of the cooling water passage 51 and the reverse flow from the other end portion 512 toward the one end portion 511 with respect to the flow of the cooling water in the cooling water passage 51. The water flow switching unit 303B executes the water flow switching control by driving the water pump 11 and the two-way valve 22. The water flow switching unit 303B executes the water flow switching control, in which a forward flow is generated by closing the two-way valve 22 and driving the water pump 11, and a reverse flow is generated by closing the two-way valve 22 and stopping the water pump 11.

Figure 13:
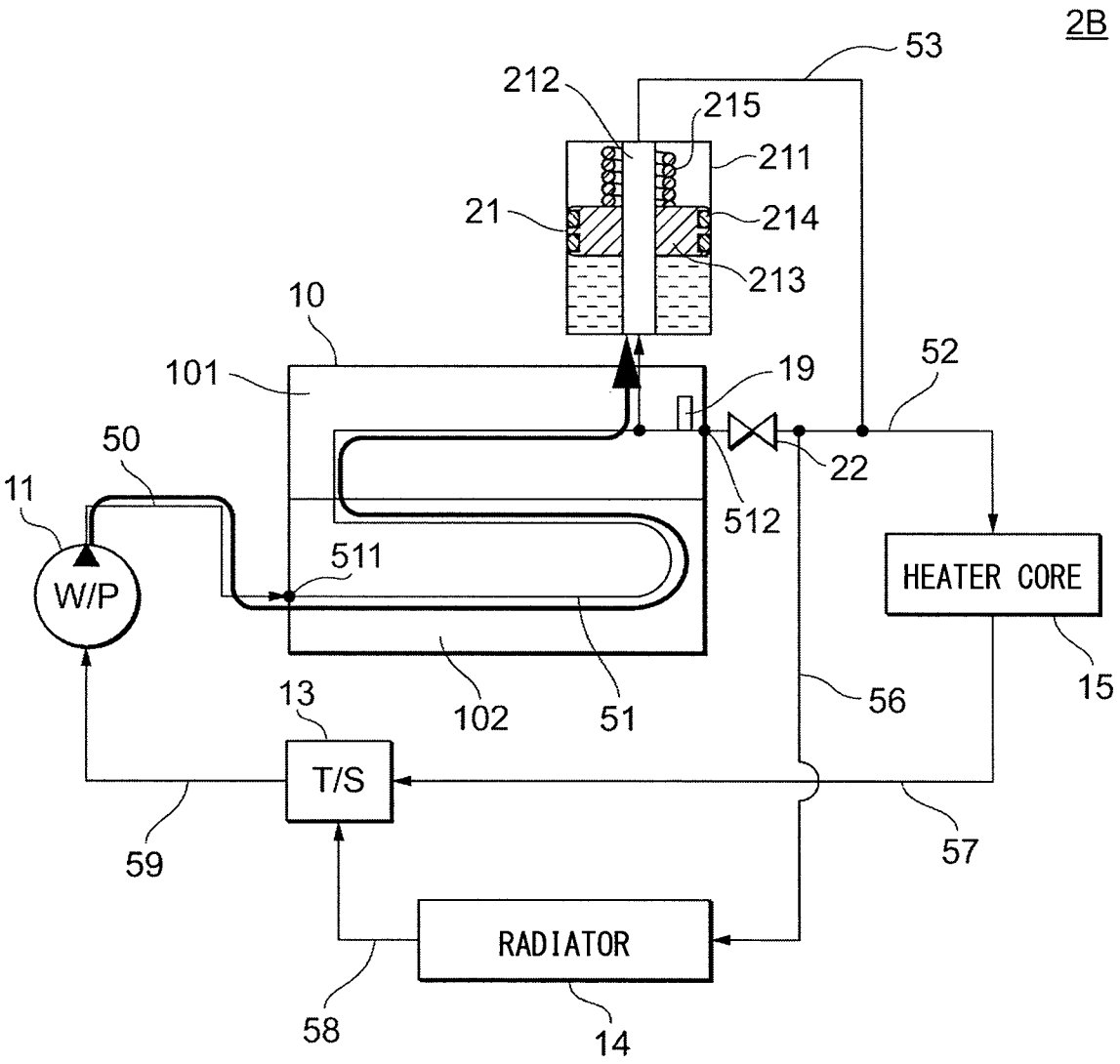
FIG. 13 is a diagram showing a state in which cooling water flows in a forward flow in the cooling system shown in FIG. 11.

FIG. 13 shows the flow of the cooling water when the water flow switching unit 303B executes the water flow switching control so that the flow of the cooling water flows in the forward direction. As shown in FIG. 13, the cooling water is discharged from the water pump 11, flows through the cooling water passage 50 and the cooling water passage 51 and flows into the accumulator chamber 21.

The accumulator chamber 21 has a reservoir 211, a shaft 212, a piston 213, a seal member 214, and a spring 215.

The reservoir 211 is connected to the bypass passage 53, and is constructed so that cooling water flows therein. The shaft 212 is provided so as to extend along the inflow direction of the cooling water. The piston 213 is configured to slide along the shaft 212.

The piston 213 partitions the reservoir 211. An O-ring shaped seal member 214 is provided around the piston 213. The seal member 214 is in close contact with the inner wall of the reservoir 211.

The spring 215 as an urging member is provided so as to urge the piston 213 against the cooling water flowing into the reservoir 211.

When the water pump 11 is driven by closing the two-way valve 22, the cooling water flows to the bypass passage 53 side. The cooling water flowing into the bypass passage 53 flows into the reservoir 211 of the accumulator chamber 21. The flowing cooling water flows into one space of the reservoir 211 partitioned by the piston 213. The piston 213 is pushed in by the cooling water, so that the spring 215 is in a contracted state.

Figure 14:
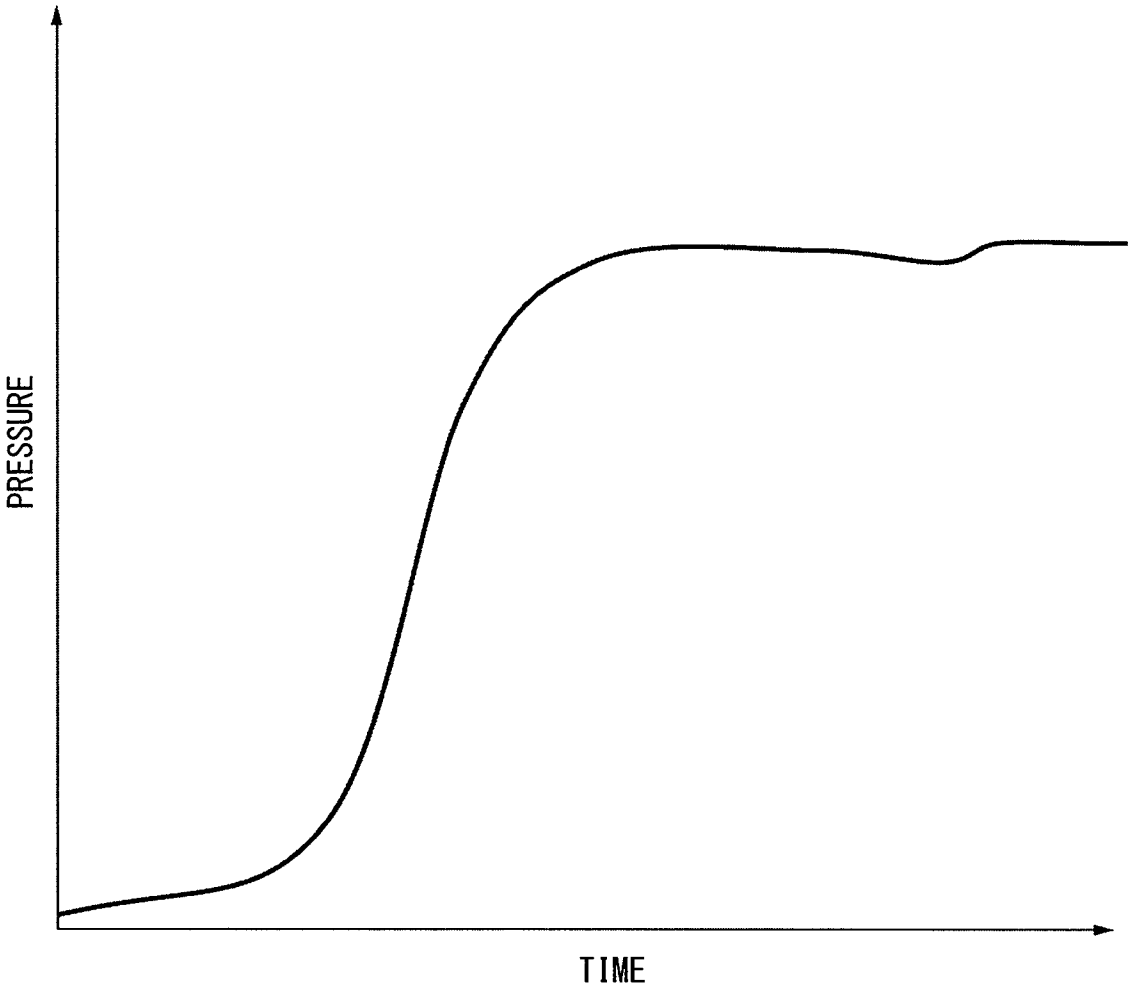
FIG. 14 is a diagram for explaining the relationship between time and pressure in FIG. 13.

As shown in FIG. 14, the internal pressure of the accumulator chamber 21 rises with the lapse of time. The internal pressure of the accumulator chamber 21 becomes substantially constant with the spring 215 shrunk.

Figure 15:
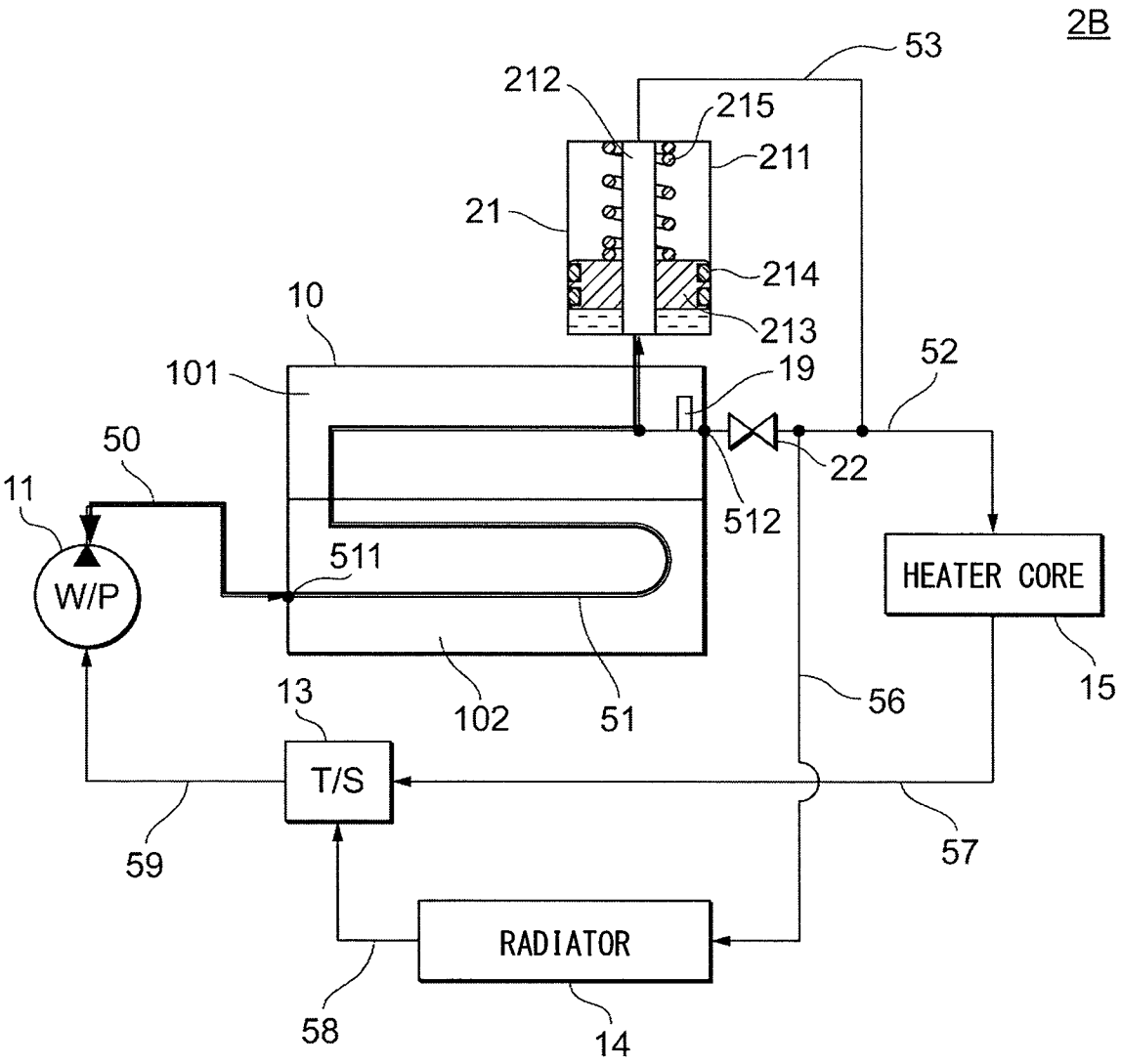
FIG. 15 is a diagram showing a state in which cooling water flows in a reverse flow in the cooling system shown in FIG. 11.
Figure 16:
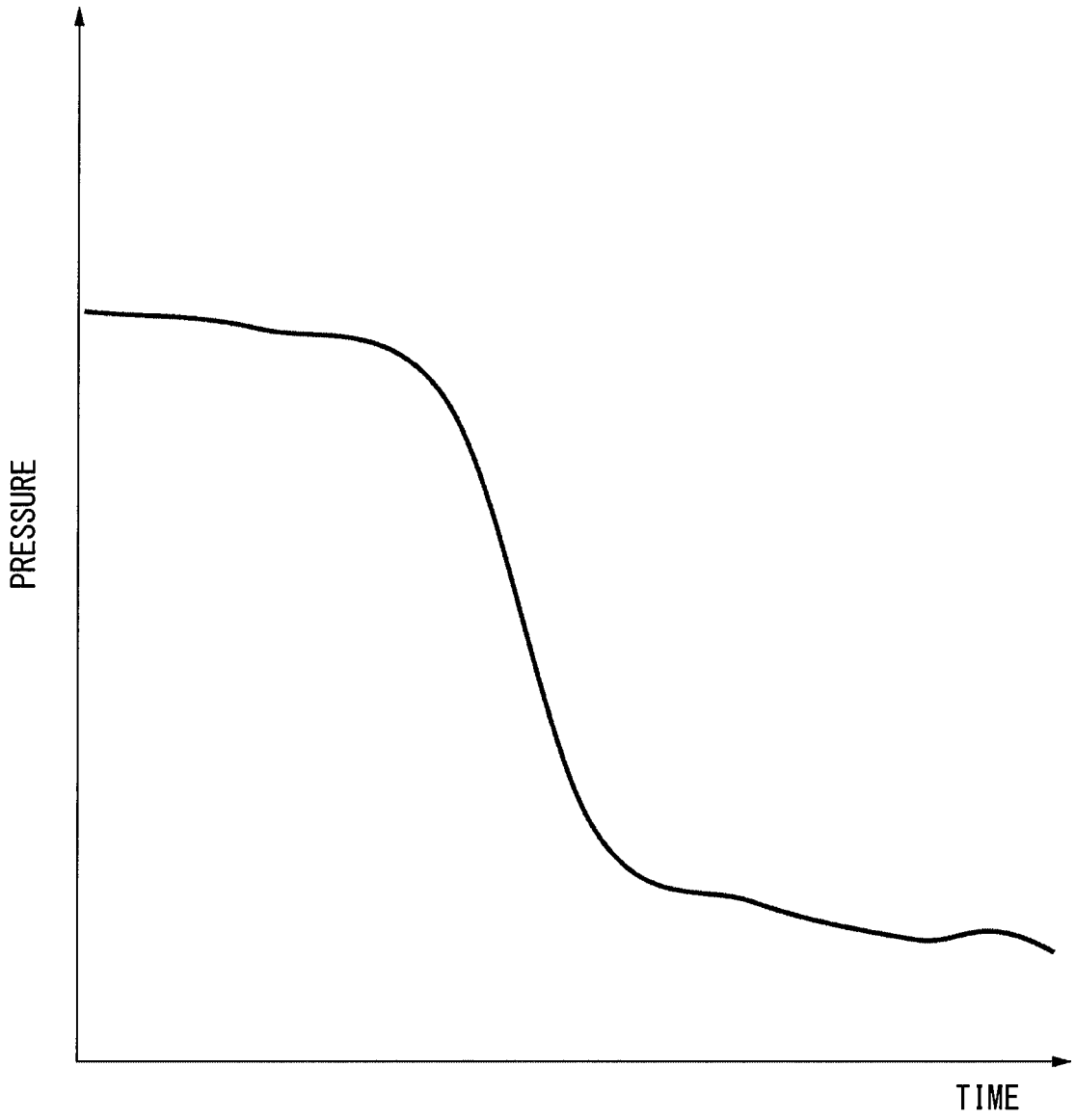
FIG. 16 is a diagram for explaining the relationship between time and pressure in FIG. 15.

FIG. 15 shows the flow of the cooling water when the water flow switching unit 303B executes the water flow switching control so that the flow of the cooling water flows in the forward direction. As shown in FIG. 15, when the water pump 11 is stopped, the cooling water in the pressure accumulator chamber 21 is pushed out by the urging force of the spring 215, flows out into the cooling water passage 51, passes through the cooling water passage 50, and reaches the pump 11. As shown in FIG. 16, the internal pressure of the accumulator chamber 21 rises with the lapse of time.

Figure 17:
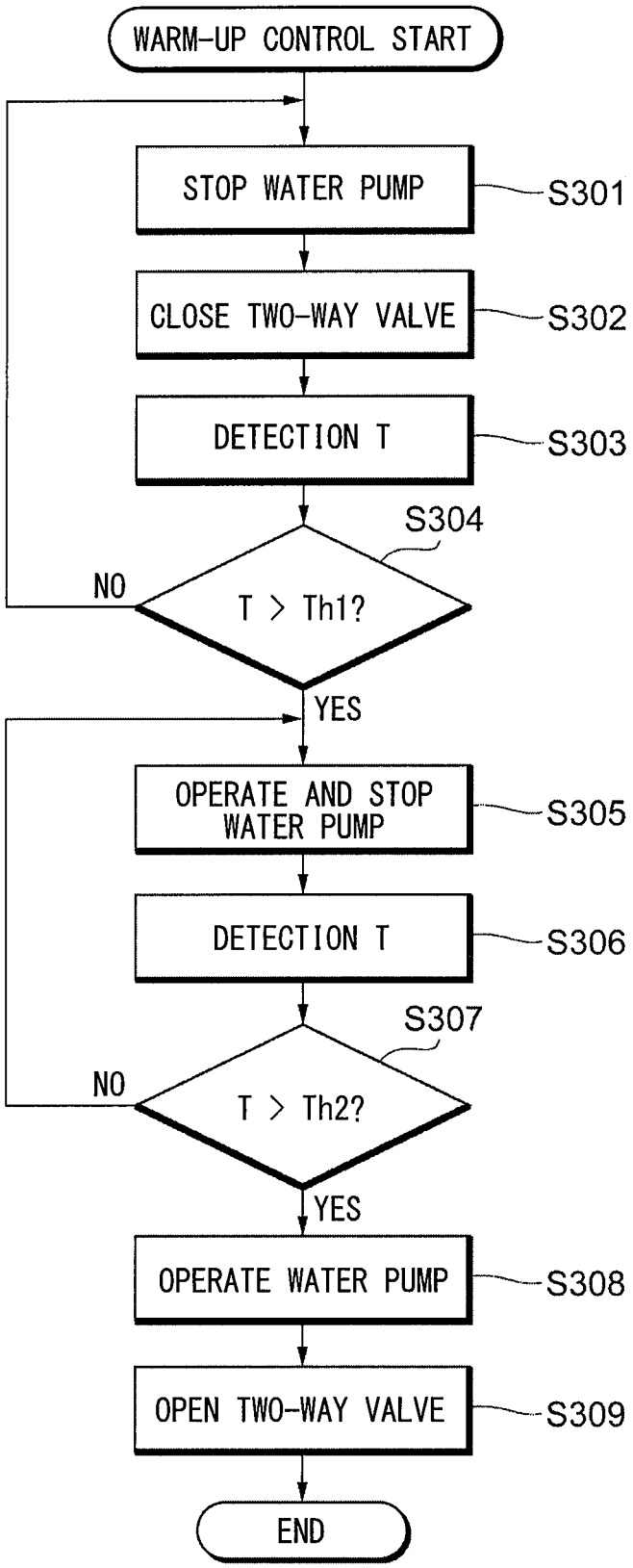
FIG. 17 is a flowchart for explaining a process of warm-up control.
Figure 18:
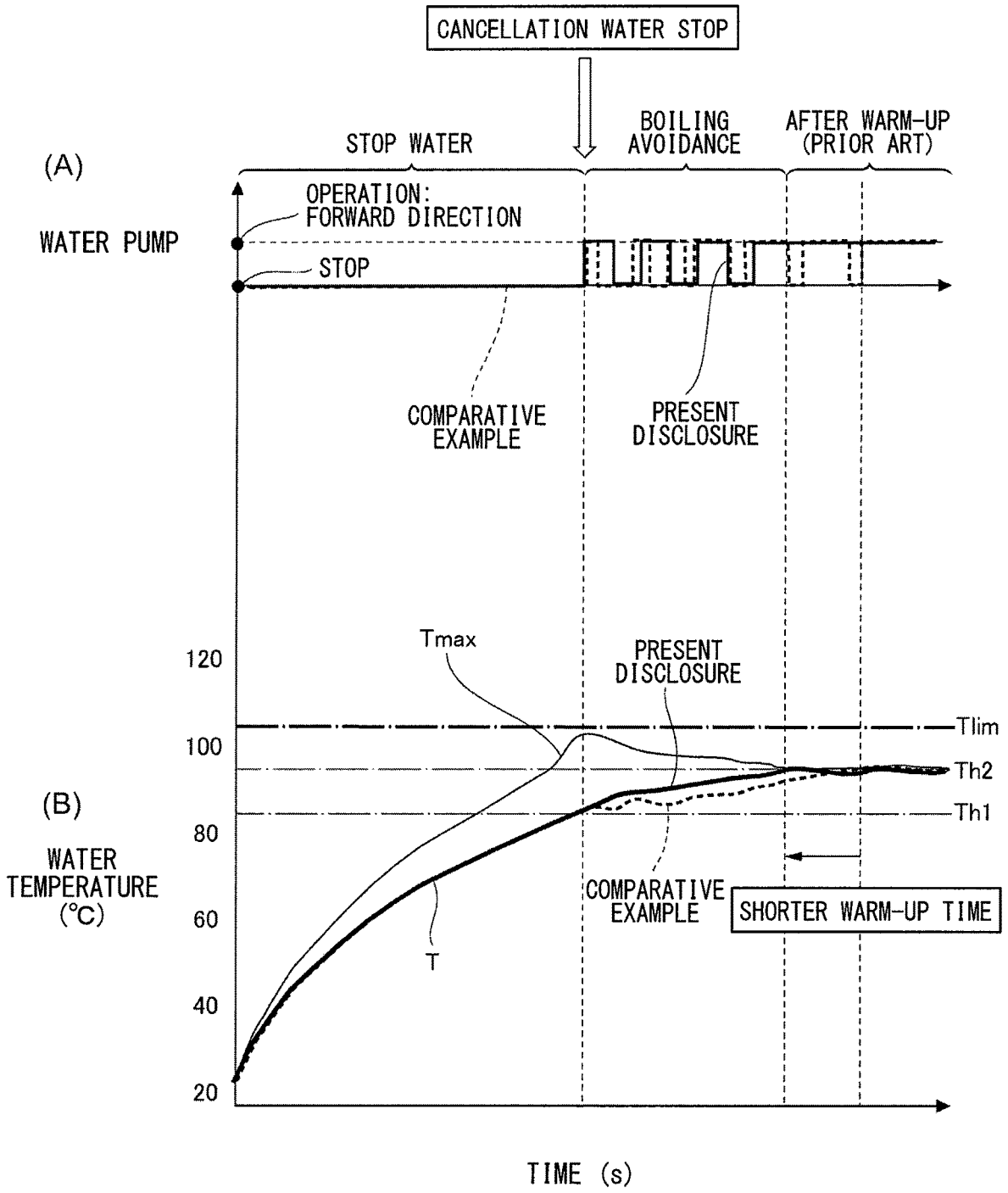
FIG. 18 is a diagram for explaining variations in water temperature when the process shown in FIG. 17 is executed.

Next, warm-up control of the cooling system 2B will be described with reference to FIGS. 17 and 18. FIG. 17 is a flowchart showing warm-up control. FIG. 18 is a diagram showing behaviors and temperatures of respective parts when warm-up control is performed. FIG. 18 (A) shows the operation and stop of the water pump 11. FIG. 18 (B) shows the temperature of the cooling water.

In step S301 of FIG. 17, the water flow switching unit 303B outputs a signal to stop the water pump 11. In step S302 following step S301, the water flow switching unit 303B outputs a signal to close the two-way valve 22. In step S303 following step S302, the water temperature acquisition unit 301 detects the water temperature sensor temperature T detected by the water temperature sensor 19.

In step S304 following step S303, the warm-up determination unit 302 determines whether or not the water temperature sensor temperature T has reached the warming-up temperature Th1. The warm-up temperature Th1 is lower than the warm-up temperature Th2. If the water temperature sensor temperature T has not reached the warming-up temperature Th1 (step S304: NO), the process returns to step S301. If the water temperature sensor temperature T has reached the warming-up temperature Th1 (step S304: YES), the process proceeds to step S305.

In step S305, the water flow switching unit 303B alternately executes the output of the signal for driving the water pump 11 and the output of the signal for stopping the water pump 11. As shown in FIG. 18, the movement that the cooling water in the internal combustion engine 10 is once pushed out and then returned is repeated. Therefore, the temperature of the cooling water in the internal combustion engine 10 rises faster, and the warm-up time is shortened. Since the maximum temperature Tmax of the cooling water in the internal combustion engine 10 does not exceed the upper limit temperature Tlim, boiling of the cooling water can be avoided.

In step S306 following step S305, the water temperature acquisition unit 301 acquires the water temperature T. In step S307 following step S306, the warm-up determination unit 302 determines whether or not the water temperature sensor temperature T has reached the warming-up temperature Th2. If the water temperature sensor temperature T has not reached the warming-up temperature Th2 (step S307: NO), the process returns to step S305. If the water temperature sensor temperature T has reached the warming-up temperature Th2 (step S307: YES), the process proceeds to step S308.

In step S308, the water flow switching unit 303B rotates the water pump 11 in the forward direction. In step S309 following step S308, the water flow switching unit 303B outputs a signal to open the two-way valve 22.

The cooling system 2B according to the present embodiment includes the bypass passage 53 for dividing and rejoining the cooling water to the other end portion 512 side of the cooling water passage 51 as the internal passage and/or to the cooling water passage 52 as the other end side external passage connected to the other end portion 512 side. Furthermore, the cooling system 2B has the accumulator chamber 21 provided in the bypass passage 53 as a cooling water storing portion capable of temporarily storing and releasing the cooling water, and the two-way valve 22 provided in parallel with the bypass passage 53 and on the other end portion 512 side of the cooling water passage 51 or in the cooling water passage 52. The water flow switching portion 303B controls the water pump 11 and the two-way valve 22, and executes the control of the water flow switching.

In the present embodiment, the cooling water is temporarily stored in a state pressurized in the accumulator chamber 21 by flowing the cooling water in the forward direction.

Thereafter, the cooling water is caused to flow in the reverse direction by the pressure. By repeating the stop and operation of the water pump 11, the water flow switching control can be executed.

Further, in the present embodiment, the water flow switching unit 303B executes the water flow switching control, in which a forward flow is generated by closing the two-way valve 22 and driving the water pump 11, and a reverse flow is generated by closing the two-way valve 22 and stopping the water pump 11. By closing the two-way valve 22, it is possible to stop the outflow of the cooling water to the side of the cooling water passage 52, and to guide the cooling water to the accumulator chamber 21. When the two-way valve 22 is closed, since the cooling water can be reciprocated between the water pump 11 and the accumulator chamber 21, it is possible to execute the water flow switching control only by driving and stopping the water pump 11.

Further, in the present embodiment, the accumulator chamber 21 as a cooling water reservoir includes the reservoir 211 connected to the bypass passage 53 and through which cooling water flows, a piston 213 for partitioning the reservoir 211, the spring 215 as an urging member that urges the piston 213 against the cooling water flowing into the reservoir 211. Since the piston 213 is provided in the reservoir 211 so as to oppose the inflow of the cooling water by the spring 215, it is possible to provide the cooling water reservoir with a simple configuration.

Incidentally, the cooling system 2B according to the second embodiment has the same effects as the cooling system 2, 2A according to the first embodiment, unless they are technically contradictory.

Figure 19:
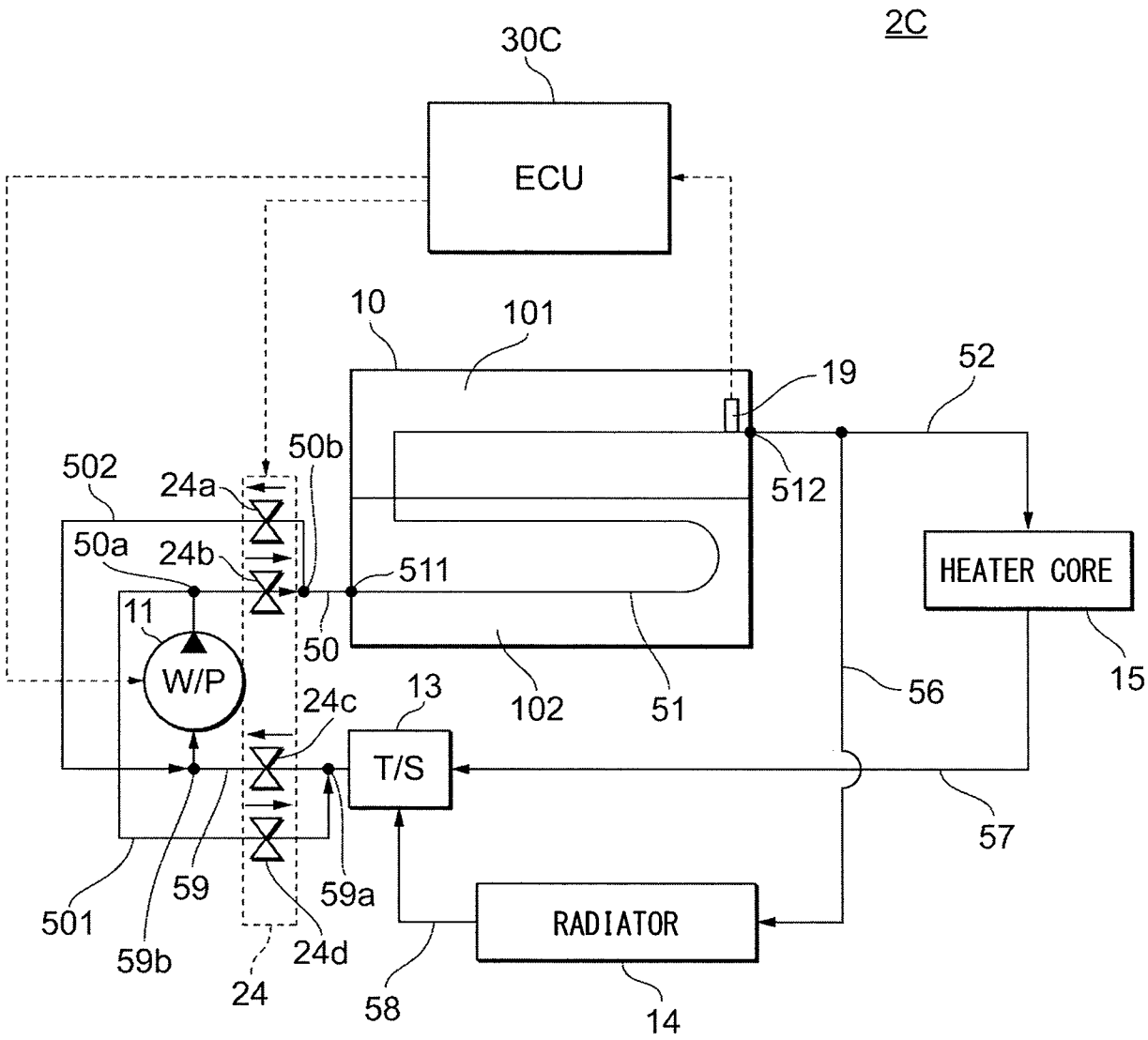
FIG. 19 is a system configuration diagram showing a configuration of a cooling system according to a third embodiment of the present disclosure.

Subsequently, a cooling system 2C according to the third embodiment will be described with reference to FIG. 19. As shown in FIG. 19, the cooling system 2C according to a third embodiment of the present disclosure includes an internal combustion engine 10, a water pump 11, a thermostat 13, a radiator 14, a heater core 15, and an ECU 30C. The internal combustion engine 10, the thermostat 13, the radiator 14, and the heater core 15 are the same as those in the first embodiment, and the explanation thereof is omitted. The water pump 11 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

The cooling system 2C further includes a first communication passage 501 and a second communication passage 502 that connect the cooling water passage 50 which is one end side external passage and the cooling water passage 59 which is the other end side external passage.

The first communication passage 501 connects a branch portion 50*a* of the cooling water passage 50 and a branch portion 59*a* of the cooling water passage 59. The second communication passage 502 connects a branch portion 50*b* of the cooling water passage 50 and a branch portion 59*b* of the cooling water passage 59. The branch portion 50*a* is provided on the upstream side closer to the discharge port of the water pump 11 than the branch portion 50*b*. The branch portion 59*a* is provided on the upstream side far from the suction port of the water pump 11 than the branch portion 59*b*.

The cooling system 2C further includes the switching valve 24 for switching a forward flow and a reverse flow. In the forward flow, the cooling water discharged from the discharge port of the water pump 11 flows through the internal combustion engine 10 via the cooling water passage 50, which is the one end side external passage, and returns to the suction port of the water pump 11 from the cooling water passage 59, which is the one end side external passage. The reverse flow passes through the first communication passage 501 and the cooling water passage 59 which is the other end side external passage, passes through the internal combustion engine 10, and returns to the suction port from the cooling water passage 50, which is the one end side external passage, and the second communication passage 502.

The switching valve 24 has a first valve 24*a*, a second valve 24*b*, a third valve 24*c*, and a fourth valve 24*d*, which are two-way valves, respectively. The first valve 24*a* is provided in the second communication passage 502. The second valve 24*b* is provided between the branch portion 50*a* of the first communication passage 501 and the branch portion 50*b* of the second communication passage 502 in the cooling water passage 50 which is the one end side outer passage.

The third valve 24*c* is provided between the branch portion 59*a* of the first communication passage 501 and the branch portion 59*b* of the second communication passage 502 in the cooling water passage 59 which is the other end side outer passage. The fourth valve 24*d* is provided in the first communication passage 501.

Figure 20:
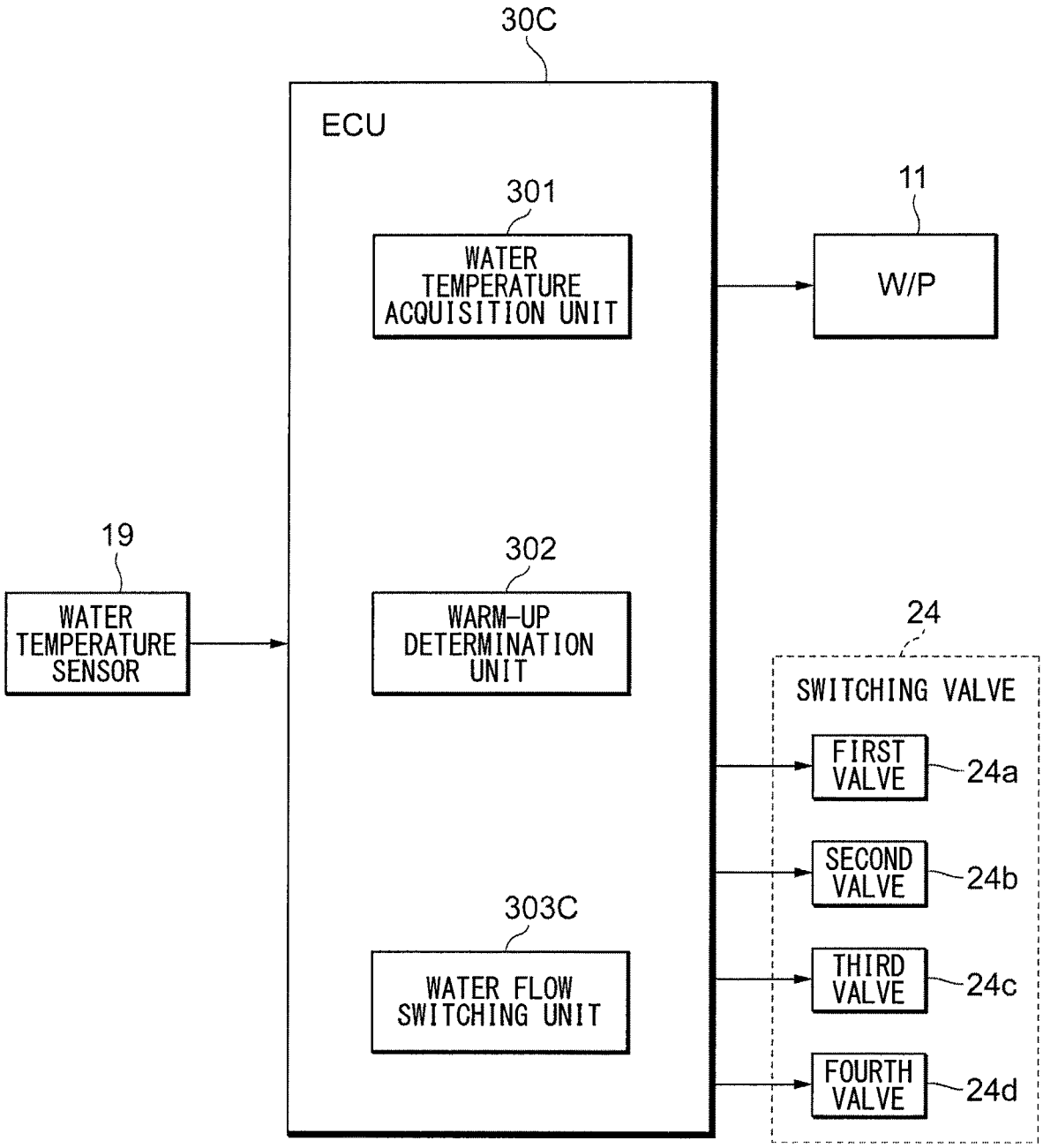
FIG. 20 is a block diagram for explaining a functional configuration of the ECU shown in FIG. 19.

Next, with reference to FIG. 20, the ECU 30C which is a control device used for the cooling system 2C will be described. The ECU 30C receives a water temperature detection signal output from the water temperature sensor 19. The ECU 30C outputs a drive signal to the water pump 11, the first valve 24*a*, the second valve 24*b*, the third valve 24*c*, and the fourth valve 24*d* that constitute the switching valve 24.

The ECU 30C includes the water temperature acquisition unit 301, the warm-up determination unit 302, and a water flow switching unit 303C as functional components.

The water temperature acquisition unit 301 and the warm-up determination unit 302 are the same as those described in the first embodiment, and the description thereof will be omitted.

The water flow switching unit 303C is a part that executes the water flow switching control, and switches the forward flow from the one end portion 511 to the other end portion 512 of the cooling water passage 51 and the reverse flow from the other end portion 512 toward the one end portion 511 with respect to the flow of the cooling water in the cooling water passage 51. The water flow switching unit 303C executes the water flow switching control by driving the water pump 11 and the switching valve 24.

Figure 21:
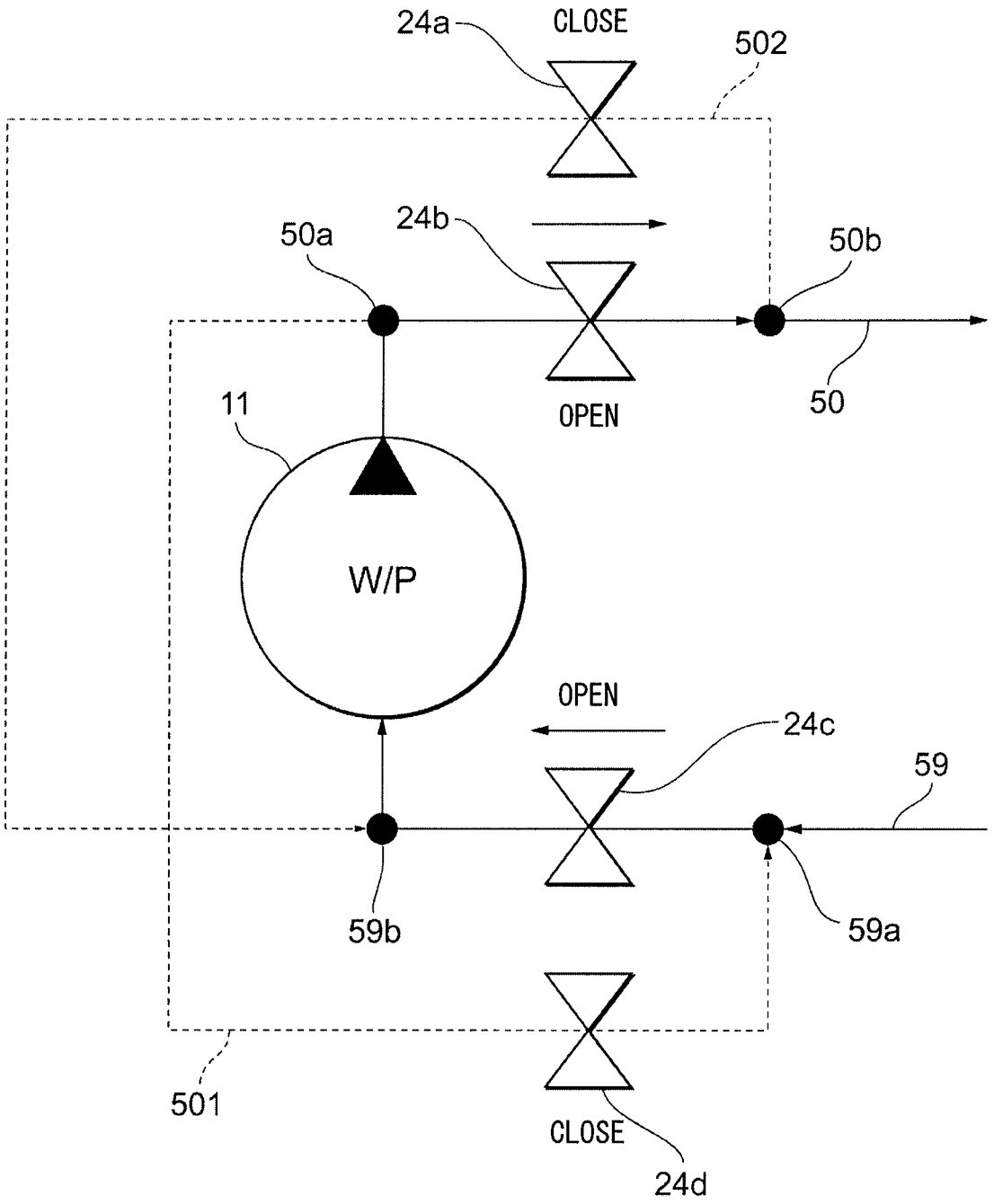
FIG. 21 is a diagram for explaining the operation of a switching valve shown in FIG. 19.

As shown in FIG. 21, the water flow switching unit 303C opens the second valve 24*b* and the third valve 24*c* while closing the first valve 24*a* and the fourth valve 24*d*, and drives the water pump 11 so as to flow in the forward direction.

Figure 23:
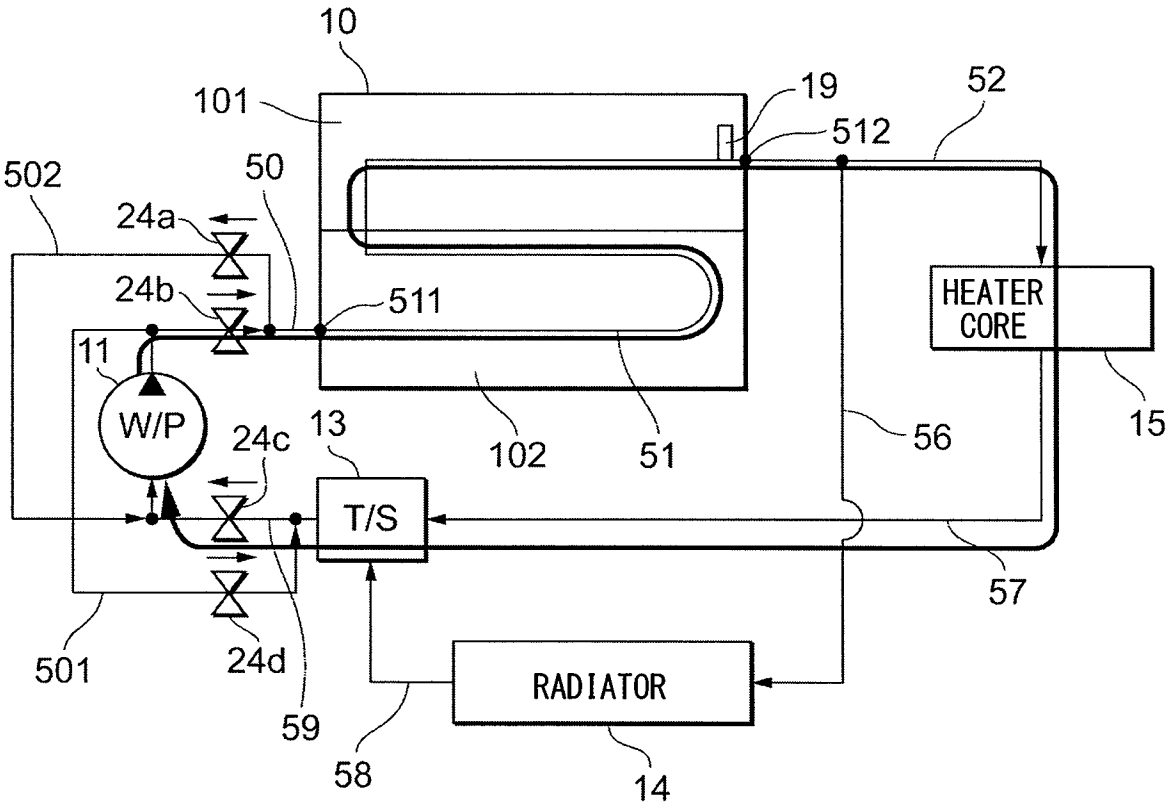
FIG. 23 is a diagram showing a state in which cooling water flows in a forward flow in the cooling system shown in FIG. 19.

FIG. 23 shows the flow of the cooling water when the water flow switching unit 303C executes the water flow switching control so that the flow of the cooling water flows in the forward direction. As shown in FIG. 23, the cooling water is discharged from the water pump 11 and passes through the cooling water passage 50, the cooling water passage 51, the cooling water passage 52, the cooling water passage 57, the cooling water passage 59, and returns to the water pump 11.

Figure 22:
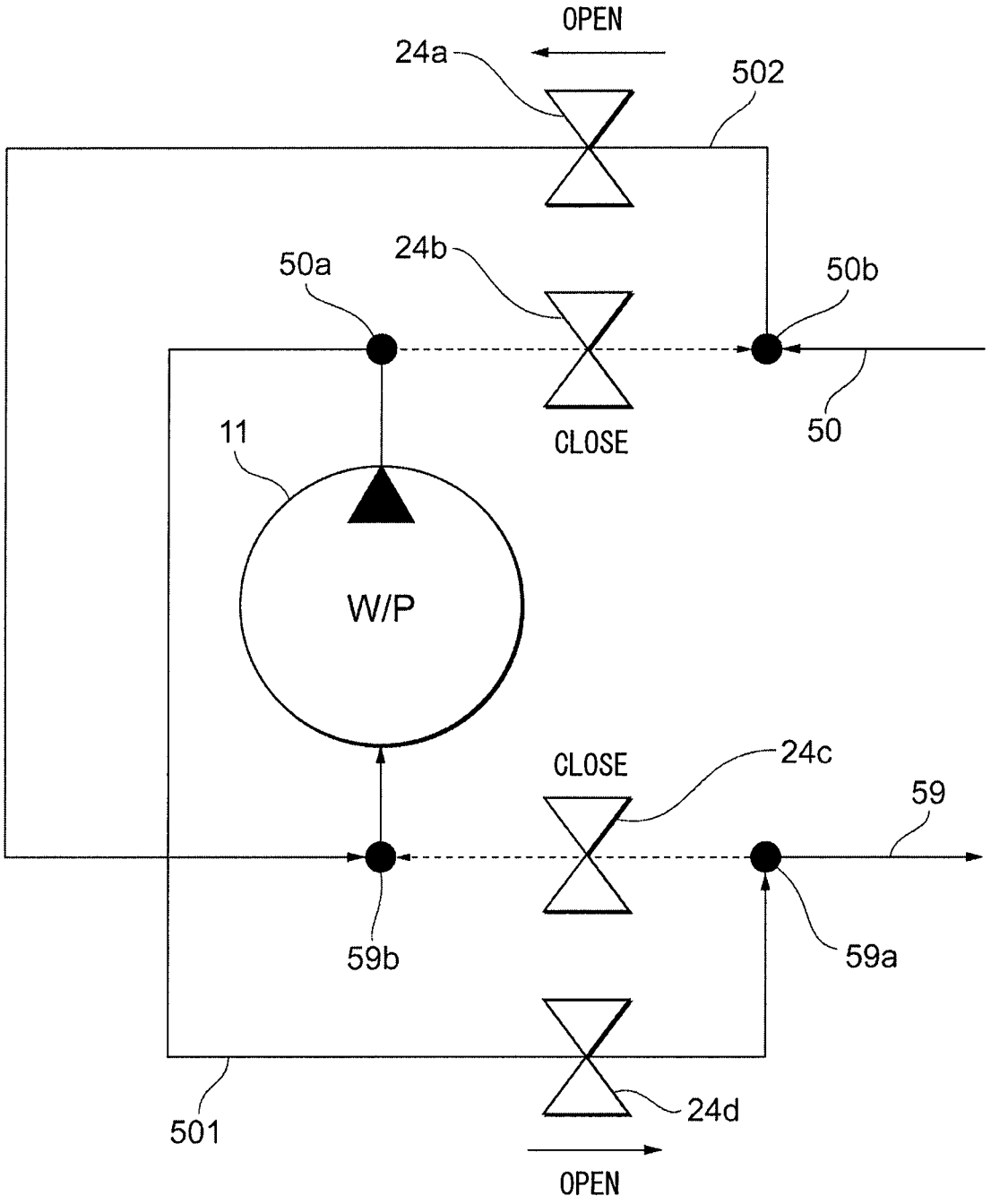
FIG. 22 is a diagram for explaining the operation of the switching valve shown in FIG. 19.

As shown in FIG. 22, the water flow switching unit 303C opens the first valve 24*a* and the fourth valve 24*d* while closing the second valve 24*b* and the third valve 24*c*, and drives the water pump 11 so as to flow in the reverse direction.

Figure 24:
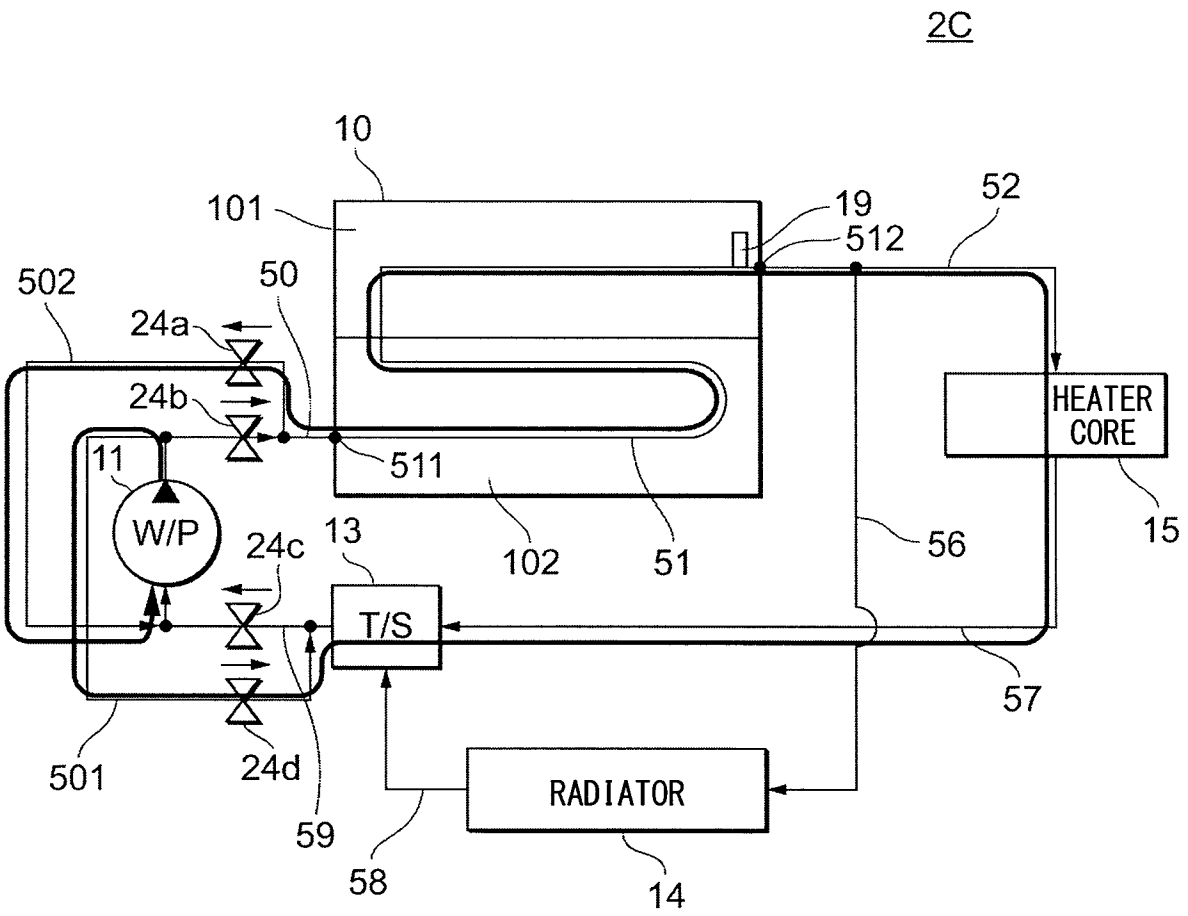
FIG. 24 is a diagram showing a state in which cooling water flows in a reverse flow in the cooling system shown in FIG. 19.

FIG. 24 shows the flow of the cooling water when the water flow switching unit 303C executes the water flow switching control so that the flow of the cooling water flows in the reverse direction. As shown in FIG. 24, the cooling water is discharged from the water pump 11 and flows through the cooling water passage 50, the first communication passage 501, the cooling water passage 59, the cooling water passage 57, the cooling water passage 52, the cooling water passage 51, the cooling water passage 50, the second communication passage 502, the cooling water passage 59, and returns to the water pump 11.

Subsequently, with reference to FIGS. 25 and 26, a cooling system 2D as a modified example using a three-way valve will be described. The cooling system 2D uses the switching valve 25 instead of the switching valve 24 according to the cooling system 2C.

The switching valve 25 has a first valve 25*a* and a second valve 25*b* which are three-way valves, respectively. The first valve 25 *a* is provided at a branch portion 50*b* of the cooling water passage 50 and the second communication passage 502 which are one end side external passage. The second valve 25*b* is provided in the branch portion 59*a* between the cooling water passage 59 and the first communication passage 501 which are the other end side outer passage.

The water flow switching unit in the cooling system 2D switches the first valve 25*a* and the second valve 25*b* so as to form a forward flow and drives the water pump 11, switches the first valve 25*a* and the second valve 25*b* so as to form a reverse flow, and drives the water pump 11. Thereby, the water flow switching control is executed.

Figure 25:
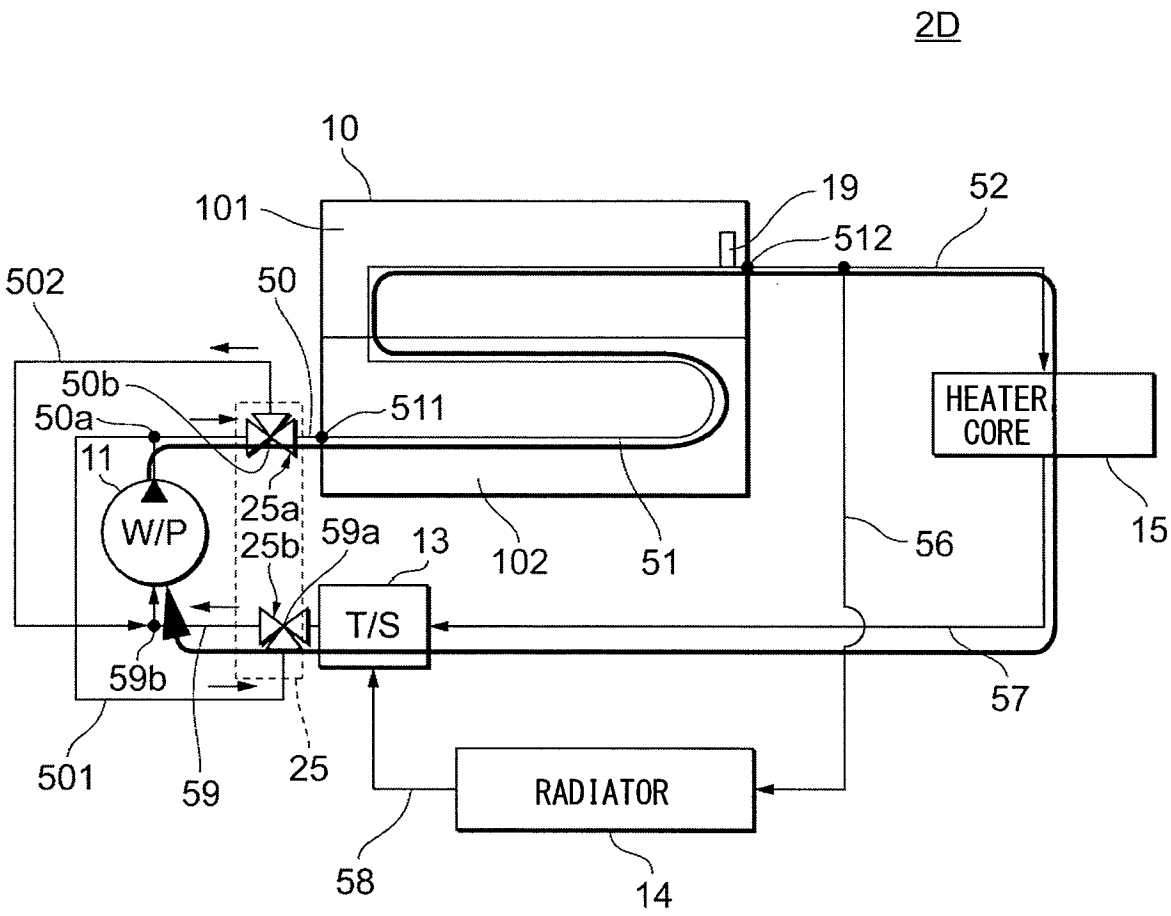
FIG. 25 is a diagram showing a state in which cooling water flows in a forward flow in a modification of the cooling system shown in FIG. 19.

As shown in FIG. 25, in the case of forward flow, by opening and closing the first valve 25*a*, which is a three-way valve, the cooling water is not allowed to flow through the second communication passage 502, and the cooling water discharged from the water pump 11 directly flows into the cooling water passage 50. By opening and closing the second valve 25*b*, which is a three-way valve, the cooling water is not allowed to flow through the first communication passage 501, and the cooling water through the cooling water passage 59 directly returns to the water pump 11. The cooling water is discharged from the water pump 11 and flows back to the water pump 11 through the cooling water passage 50, the cooling water passage 51, the cooling water passage 52, the cooling water passage 57, and the cooling water passage 59.

Figure 26:
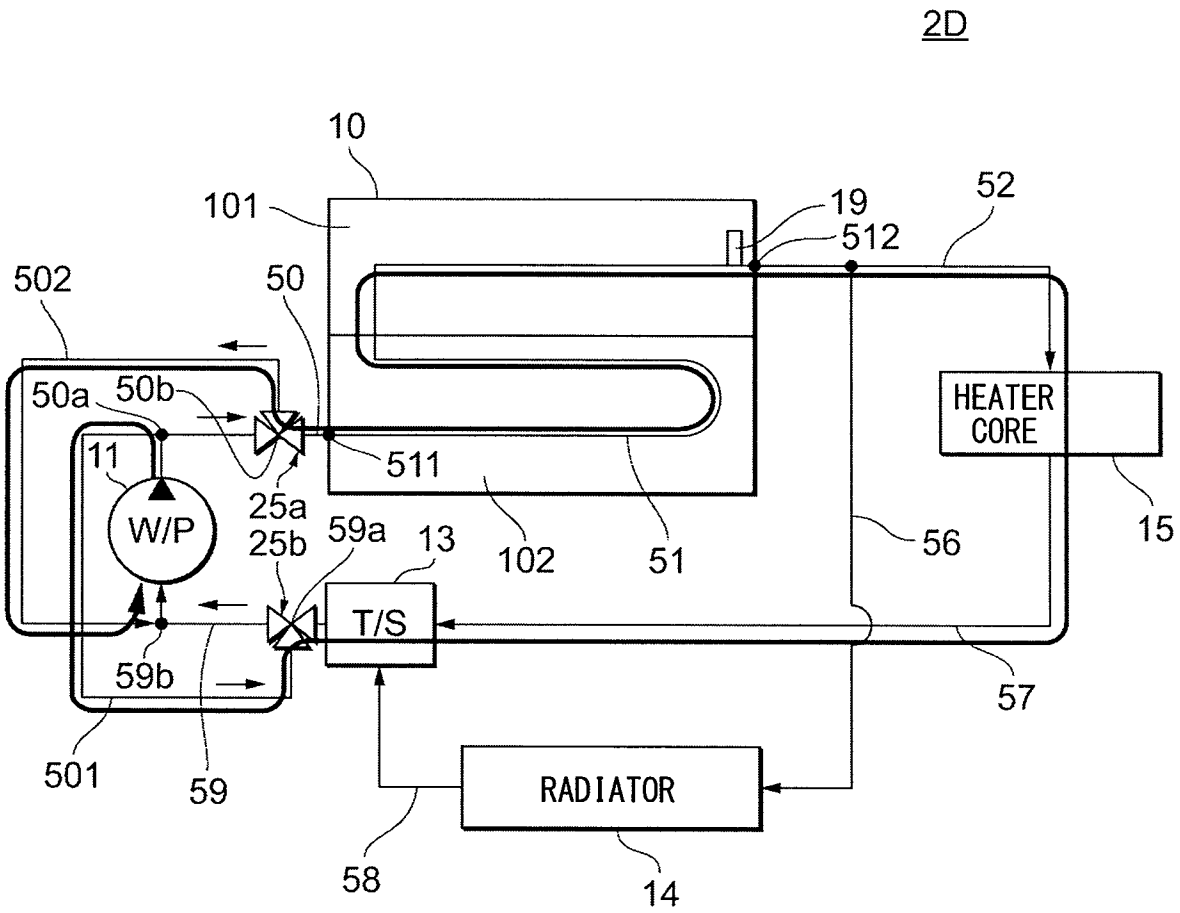
FIG. 26 is a diagram showing a state in which cooling water flows in a reverse flow in a modification of the cooling system shown in FIG. 19.

As shown in FIG. 26, in the case of the reverse flow, by opening and closing the first valve 25 *a*, which is a three-way valve, the cooling water flowing from the internal combustion engine 10 side flows to the second communication passage 502 side. By opening and closing the second valve 25*b*, which is a three-way valve, the cooling water discharged from the water pump 11 and flowing through the first communication passage 501 flows from the cooling water passage 59 to the cooling water passage 57 side. The cooling water is discharged from the water pump 11 and flows through the cooling water passage 50, the first communication passage 501, the cooling water passage 59, the cooling water passage 57, the cooling water passage 52, the cooling water passage 51, the cooling water passage 50, the second communication The passage 502, the cooling water passage 59, and returns to the water pump 11.

The cooling systems 2C and 2D according to the present embodiment are provided with the first communication passage 501 and the second communication passage 502 that connect the cooling water passage 50 which is one end side external passage and the cooling water passage 59 which is the other end side external passage, and the switching valve 24, 25 for switching a forward flow and a reverse flow. In the forward flow, the cooling water discharged from the discharge port of the water pump 11 flows through the internal combustion engine 10 via the cooling water passage 50, which is the one end side external passage, and returns to the suction port of the water pump 11 from the cooling water passage 59, which is the one end side external passage. The reverse flow passes through the first communication passage 501 and the cooling water passage 59 which is the other end side external passage, passes through the internal combustion engine 10, and returns to the suction port from the cooling water passage 50, which is the one end side external passage and the second communication passage 502. The water flow switching unit in the cooling systems 2C, 2D controls the switching valves 24, 25 and drives the water pump 11 so as to execute the water flow switching control.

According to the present embodiment, the first communication passage 501 and the second communication passage 502 connecting the discharge port side and the suction port side of the water pump 11 are provided. Since it is controlled by the switching valves 24, 25 whether or not the cooling water is supplied to the first communication passage 501 and the second communication passage 502, the water flow switching control is realized by controlling the opening and closing of the switching valves 24, 25.

The cooling system 2C has a first valve 24*a*, a second valve 24*b*, a third valve 24*c*, and a fourth valve 24*d*, each of which is two-way valve, as the switching valve 24. The first valve 24*a* is provided in the second communication passage 502. The second valve 24*b* is provided between the branch portion 50*a* of the first communication passage 501 and the branch portion 50*b* of the second communication passage 502 in the cooling water passage 50. The third valve 24*c* is provided between the branch portion 59*a* of the first communication passage 501 and the branch portion 59*b* of the second communication passage 502 in the cooling water passage 59. The fourth valve 24*d* is provided in the first communication passage 501. The water flow switching unit 303C opens the second valve 24*b* and the third valve 24*c* while closing the first valve 24*a* and the fourth valve 24*d*, and drives the water pump 11 so as to form a forward flow. The water flow switching unit 303C opens the first valve 24*a* and the fourth valve 24*d* while closing the second valve 24*b* and the third valve 24*c* and drives the water pump 11 so as to form a reverse flow.

By arranging a two-way valve with a simple structure and combining the opening and closing of the first valve 24*a*, the second valve 24*b*, the third valve 24*c*, and the fourth valve 24*d* and the driving of the water pump 11, it is possible to execute the water flow switching control.

The cooling system 2D has a first valve 25*a* and a second valve 25*b*, each of which is a three-way valve, as the switching valve 25. The first valve 25 *a* is provided at a branch portion 50*b* of the cooling water passage 50 and the second communication passage 502 which are one end side external passage. The second valve 25*b* is provided in the branch portion 59*a* between the cooling water passage 59 and the first communication passage 501 which are the other end side outer passage.

The water flow switching unit in the cooling system 2D switches the first valve 25*a* and the second valve 25*b* so as to form a forward flow and drives the water pump 11, switches the first valve 25*a* and the second valve 25*b* so as to form a reverse flow, and drives the water pump 11.

Thereby, the water flow switching control is executed. In this way, by using a three-way valve, it is possible to execute water flow switching control while reducing the number of valves to be provided.

Incidentally, the cooling system 2C, 2D according to the third embodiment has the same effects as the cooling system 2, 2A according to the first embodiment, unless they are technically contradictory.

Figure 27:
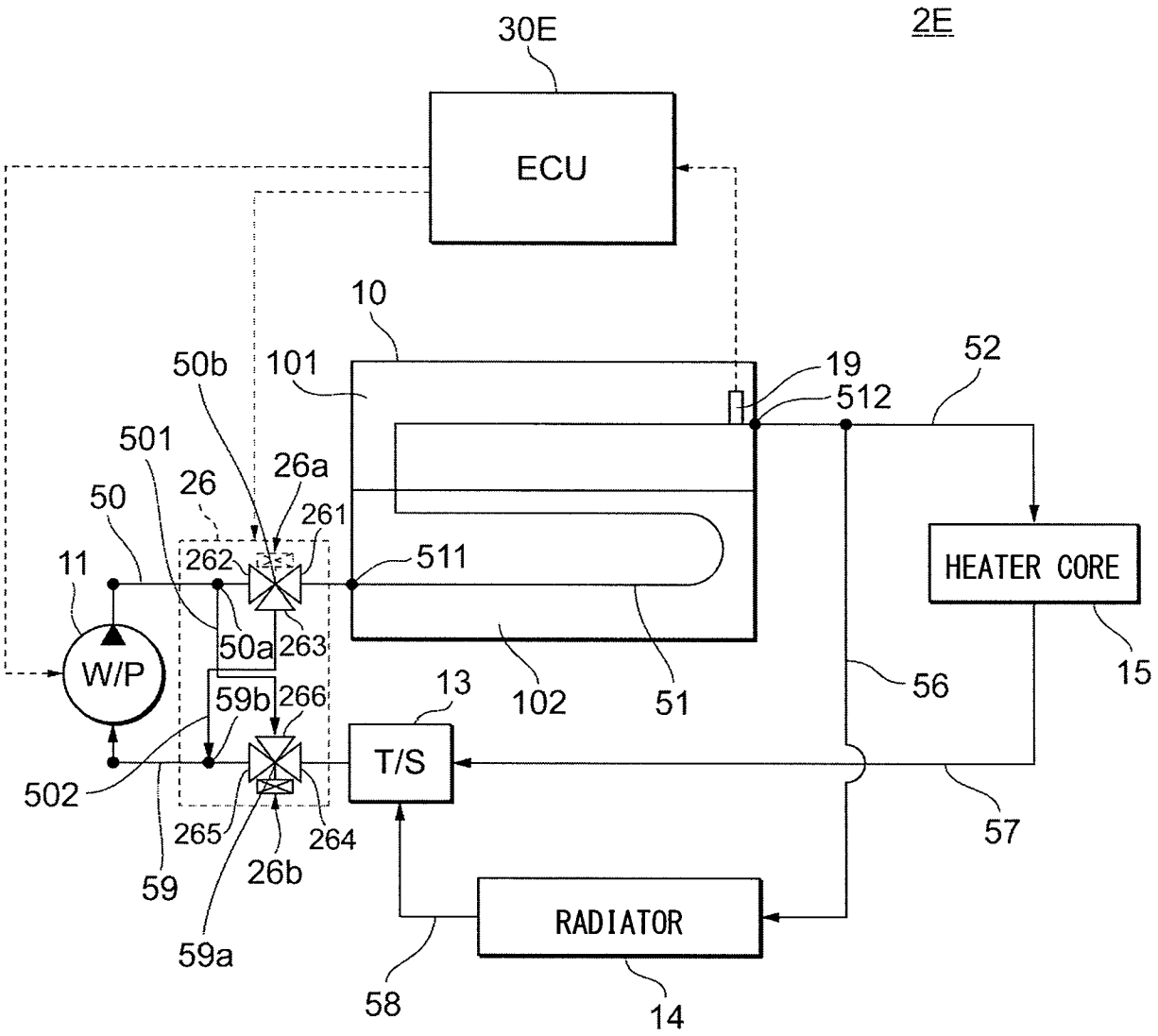
FIG. 27 is a system configuration diagram showing a configuration of a cooling system according to a fourth embodiment of the present disclosure.

Subsequently, the cooling system 2E according to the fourth embodiment will be described with reference to FIG. 27. As shown in FIG. 27, a cooling system 2E according to the fourth embodiment of the present disclosure includes the internal combustion engine 10, the water pump 11, the thermostat 13, the radiator 14, a heater core 15, and an ECU 30 E. The internal combustion engine 10, the thermostat 13, the radiator 14, and the heater core 15 are the same as those in the first embodiment, and the explanation thereof is omitted. The water pump 11 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

The cooling system 2E further includes a first communication passage 501 and a second communication passage 502 that connect the cooling water passage 50 which is one end side external passage and the cooling water passage 59 which is the other end side external passage.

The first communication passage 501 connects a branch portion 50*a* of the cooling water passage 50 and a branch portion 59*a* of the cooling water passage 59. The second communication passage 502 connects a branch portion 50*b* of the cooling water passage 50 and a branch portion 59*b* of the cooling water passage 59. The branch portion 50*a* is provided on the upstream side closer to the discharge port of the water pump 11 than the branch portion 50*b*. The branch portion 59*a* is provided on the upstream side far from the suction port of the water pump 11 than the branch portion 59*b*.

The cooling system 2E further includes a switching valve 26 for switching a forward flow and a reverse flow. In the forward flow, the cooling water discharged from the discharge port of the water pump 11 flows through the internal combustion engine 10 via the cooling water passage 50, which is the one end side external passage, and returns to the suction port of the water pump 11 from the cooling water passage 59, which is the one end side external passage. The reverse flow passes through the first communication passage 501 and the cooling water passage 59 which is the other end side external passage, passes through the internal combustion engine 10, and returns to the suction port from the cooling water passage 50, which is the one end side external passage, and the second communication passage 502.

The switching valve 26 has a first valve 26*a* and a second valve 26*b* which are three-way valves, respectively. The first valve 26 *a* is provided at the branch portion 50*b* of the cooling water passage 50 which are one end side external passage and the second communication passage 502. The second valve 26*b* is provided in the branch portion 59*a* between the cooling water passage 59 and the first communication passage 501 which are the other end side outer passage.

Figure 28:
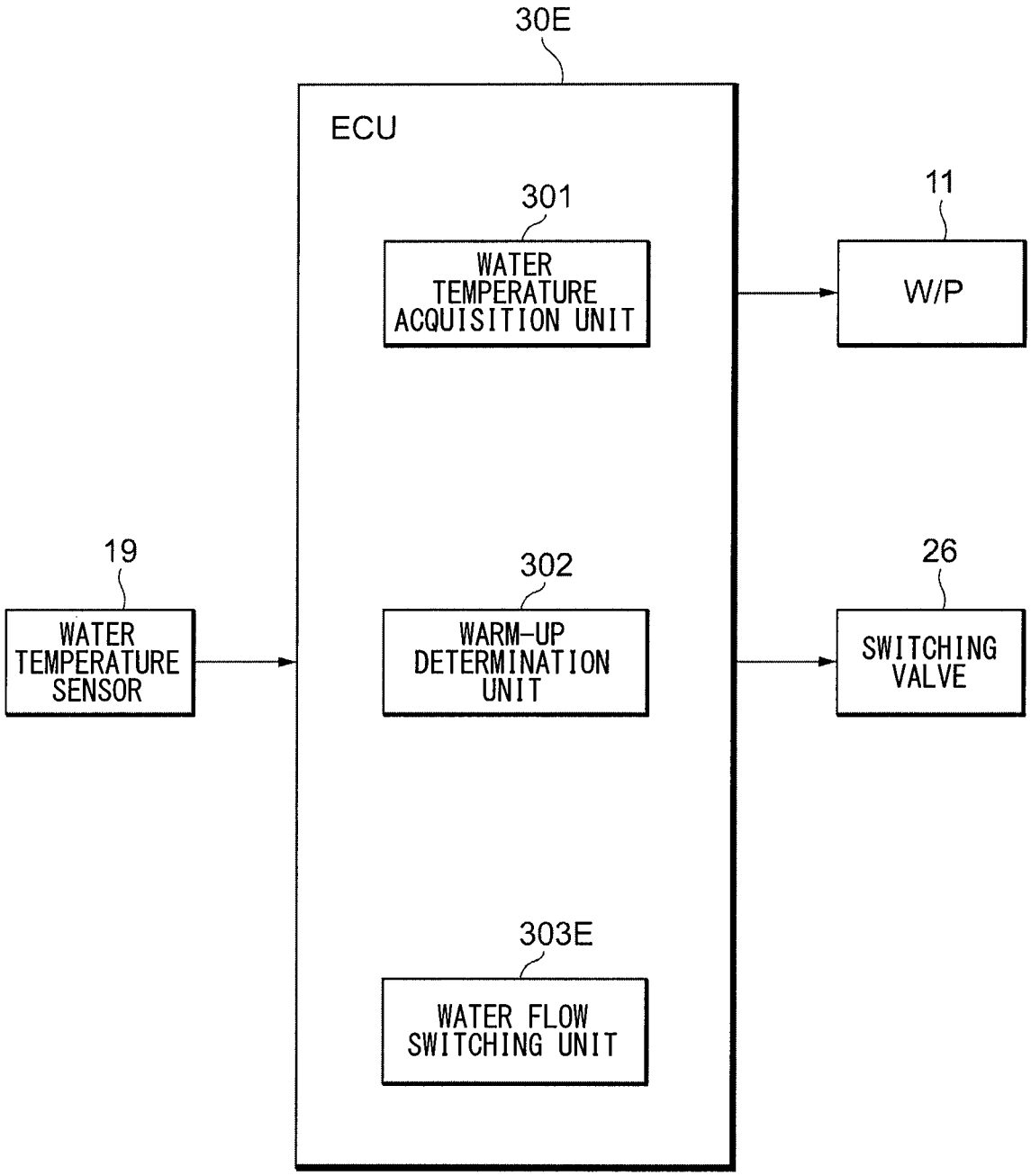
FIG. 28 is a block diagram for explaining a functional configuration of the ECU shown in FIG. 27.

Subsequently, with reference to FIG. 28, the ECU 30E which is a control device used for the cooling system 2E will be described. The ECU 30E receives a water temperature detection signal output from the water temperature sensor 19. The ECU 30E outputs a drive signal to the water pump 11 and the switching valve 26.

The ECU 30C includes the water temperature acquisition unit 301, the warm-up determination unit 302, and a water flow switching unit 303E as functional components.

The water temperature acquisition unit 301 and the warm-up determination unit 302 are the same as those described in the first embodiment, and the description thereof will be omitted.

The water flow switching unit 303E is a part that executes the water flow switching control, and switches the forward flow from the one end portion 511 to the other end portion 512 of the cooling water passage 51 and the reverse flow from the other end portion 512 toward the one end portion 511 with respect to the flow of the cooling water in the cooling water passage 51. The water flow switching unit 303E executes the water flow switching control by driving the water pump 11 and the switching valve 26.

Figure 29:
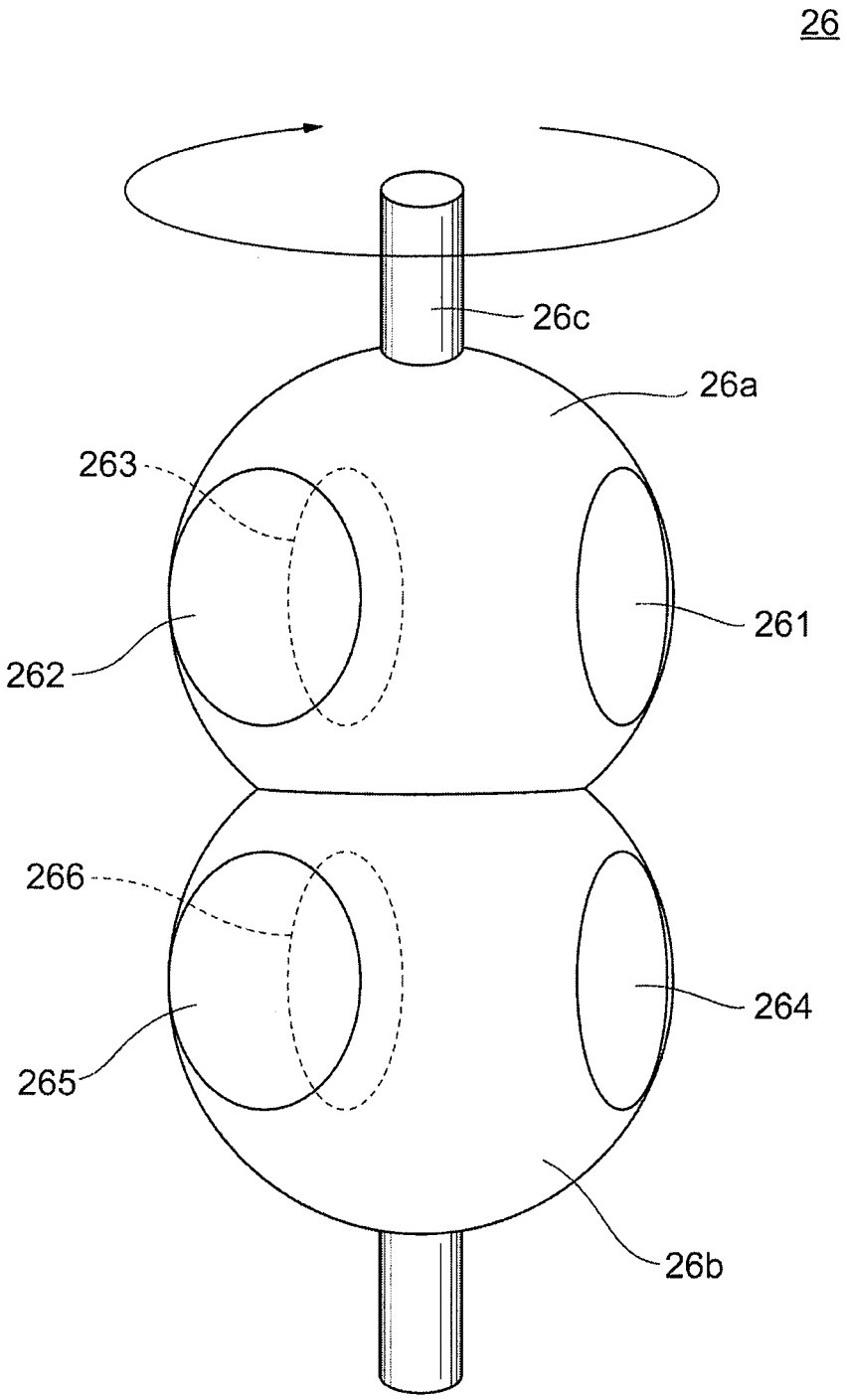
FIG. 29 is a diagram for explaining the switching valve shown in FIG. 27.

As shown in FIG. 29, the switching valve 26 is configured to integrate the first valve 26*a* and the second valve 26*b*. The first valve 26*a* and the second valve 26*b* are configured to be rotatable around the rotating shaft 26*c*. When a drive signal is input from the water flow switching unit 303E, the rotating shaft 26*c* rotates a predetermined angle so as to position the first valve 26*a* and the second valve 26*b*.

The first valve 26*a* has a communication hole 261, a communication hole 262, and a communication hole 263. The second valve 26*b* has a communication hole 264, a communication hole 265, and a communication hole 266.

Figure 30:
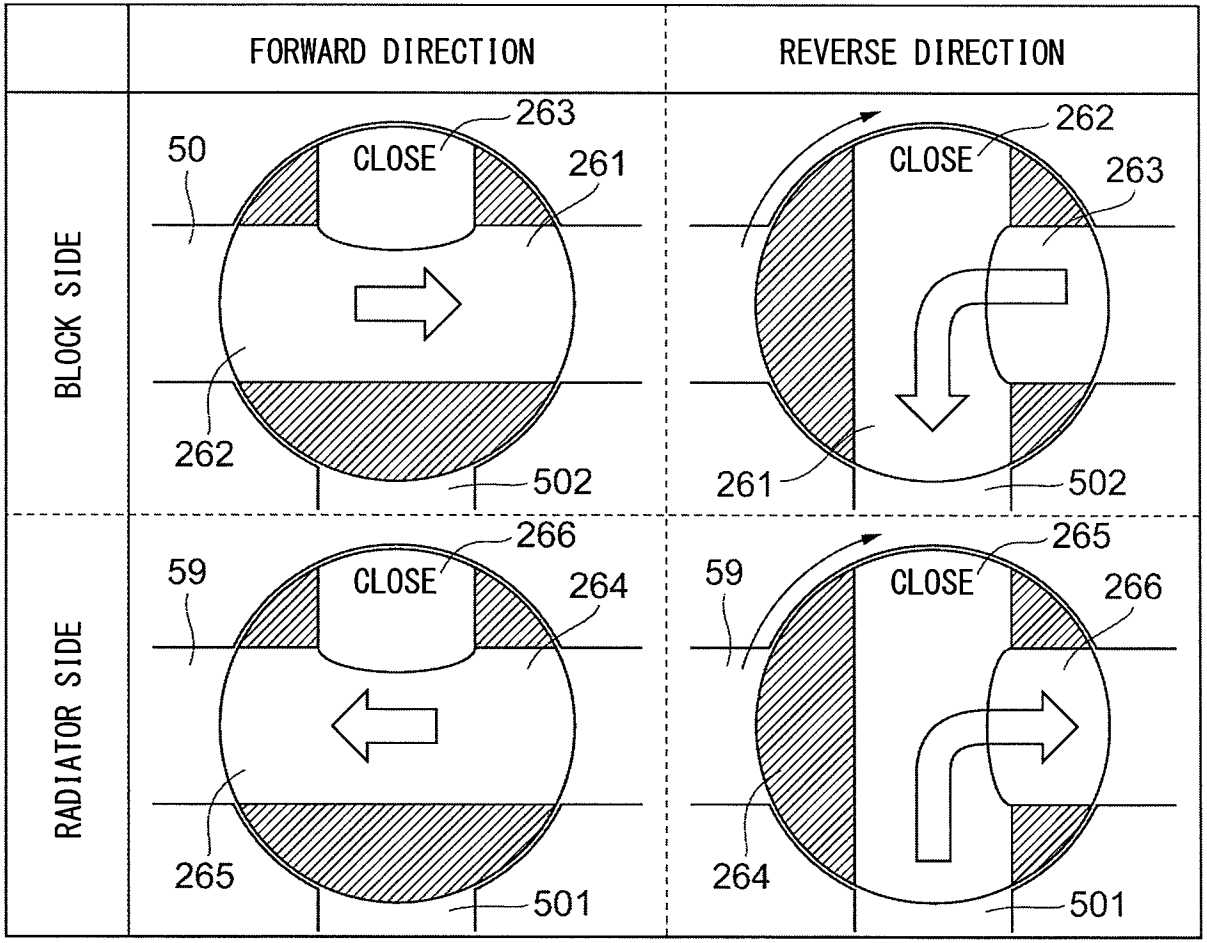
FIG. 30 is a diagram for explaining the switching valve shown in FIG. 27.

FIG. 30 is a diagram for describing a flow path formation mode when the first valve 26*a* and the second valve 26*b* are rotated by a predetermined angle. When forming the forward flow, the first valve 26*a* is rotationally driven so that the communication hole 261 and the communication hole 262 are directed to the upstream side and the downstream side of the cooling water passage 50. In this case, since the communication hole 263 faces the inner wall surface of the first valve 26*a*, a flow of water passing through the communication hole 263 is not formed. When forming the forward flow, the second valve 26*b* is rotationally driven so that the communication hole 264 and the communication hole 265 are directed to the upstream side and the downstream side of the cooling water passage 59. In this case, since the communication hole 266 faces the inner wall surface of the second valve 26*b*, the flow of water through the communication hole 266 is not formed.

When the switching valve 26 is driven so as to form the forward flow, the cooling water is discharged from the water pump 11 and flows through the cooling water passage 50, the cooling water passage 51, the cooling water passage 52, the cooling water passage 57, the cooling water passage 59, and flows back to the water pump 11.

In the case of forming the reverse flow, the first valve 26*a* is rotationally driven so that the communication hole 261 faces the second communication passage 502, and the communication hole 263 faces the downstream side of the cooling water passage 50. In this case, since the communication hole 262 faces the inner wall surface of the first valve 26*a*, a flow of water passing through the communication hole 262 is not formed. In the case of forming the reverse flow, the second valve 26*b* is rotationally driven such that the communication hole 264 is directed to the first communication passage 501 and the communication hole 266 is directed to the upstream side of the cooling water passage 59. In this case, since the communication hole 265 faces the inner wall surface of the second valve 26*b*, a flow of water passing through the communication hole 265 is not formed.

When the switching valve 26 is driven so as to form the reverse flow, the cooling water is discharged from the water pump 11 and flows through the cooling water passage 50, the first communication passage 501, the cooling water passage 59, the cooling water passage 57, the cooling water Passes through the passage 52, the cooling water passage 51, the cooling water passage 50, the second communication passage 502, and the cooling water passage 59, and returns to the water pump 11.

The cooling system 2E according to the fourth embodiment has the same effects as the cooling system 2A according to the first embodiment and the cooling systems 2C, 2D according to the third embodiment unless it is technically contradictory. In the cooling system 2D which is a modified example of the third embodiment, the operation and effect are common in that a three-way valve is used. Since the switching valve 26 of the cooling system 2E is capable of driving both the first valve 26*a* and the second valve 26*b* by rotationally driving the rotating shaft 26*c*, it is easy to realize the synchronization operation of the first valve 26*a* and the second valve 26*b*.

A switching valve 26A as a modification of the switching valve 26 will be described with reference to FIGS. 31 and 32. The switching valve 26A includes a body portion 26Aa, a solenoid 26Ab, a solenoid 26Ac, a first valve body 26Ad, a second valve body 26Ae, a third valve body 26Af, a drive shaft 26Ag, and a seal member 26Ah.

Solenoids 26Ab and solenoids 26Ac are provided at both end portions of the main body portion 26Aa. The drive shaft 26Ag is provided so as to penetrate the solenoid 26Ab, the main body portion 26Aa, and the solenoid 26Ac. When the solenoid 26Ac is energized, the drive shaft 26Ag is drawn to the solenoid 26Ac side, as shown in FIG. 31. On the other hand, when the solenoid 26Ab is energized, the drive shaft 26Ag is attracted to the solenoid 26Ab side as shown in FIG. 32.

The drive shaft 26Ag passes through the first valve body 26Ad, the second valve body 26Ae, and the third valve body 26Af. The first valve body 26Ad, the second valve body 26Ae, and the third valve body 26Af are fixed at predetermined positions of the drive shaft 26Ag. A seal member 26Ah is disposed between the first valve body 26Ad, the second valve body 26Ae, and the third valve body 26Af and the main body portion 26Aa.

Openings connected to each of the cooling water passage 50, the cooling water passage 59, the first communication passage 501, and the second communication passage 502 are provided in the main body portion 26Aa.

Figure 31:
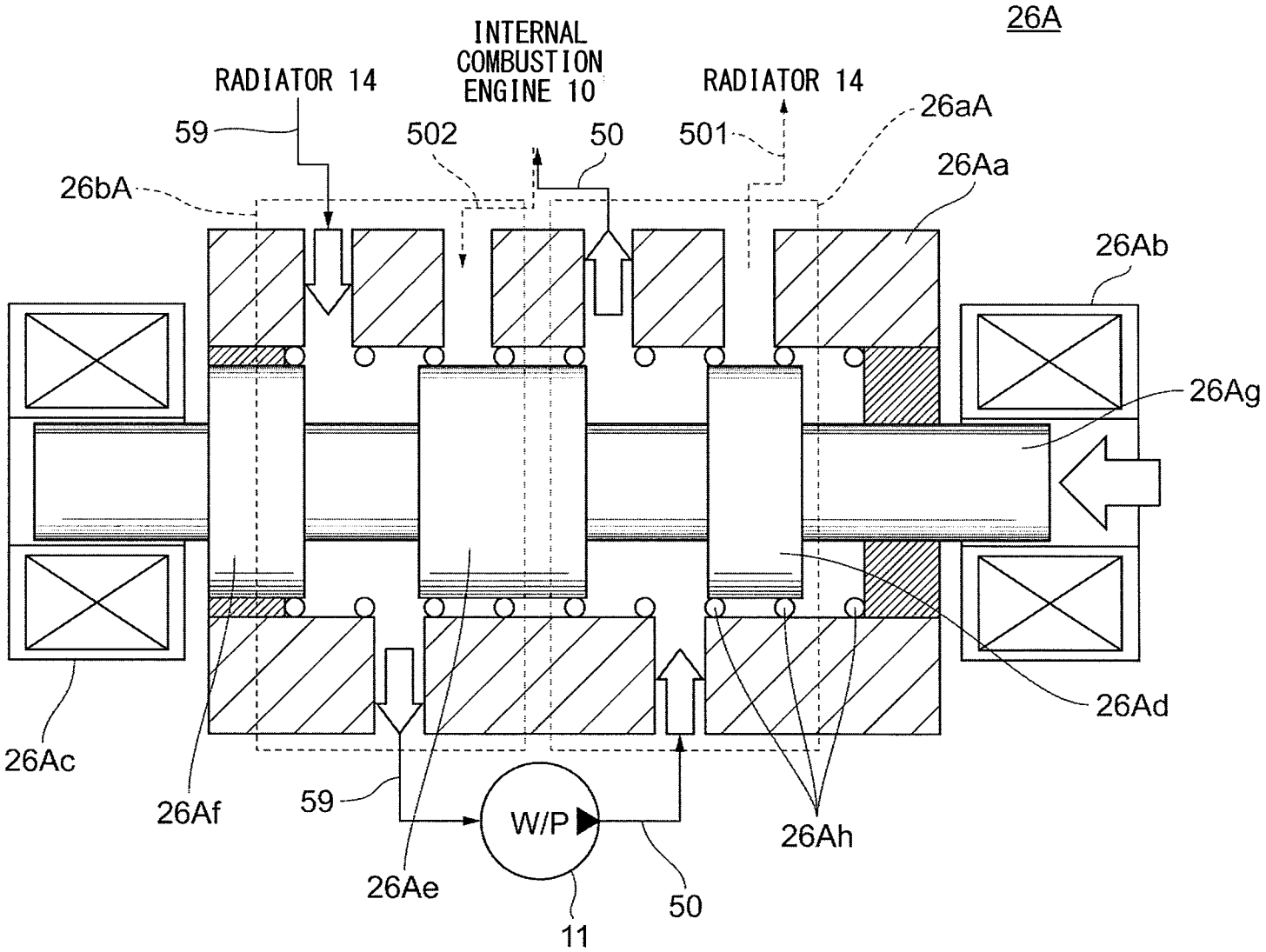
FIG. 31 is a diagram for explaining the switching valve as a modification.

As shown in FIG. 31, when the first valve body 26Ad, the second valve body 26Ae, and the third valve body 26Af are positioned, the cooling water flows so as to form the forward flow. The first valve body 26Ad is disposed to face the communication port of the first communication passage 501 so that the cooling water does not flow into the first communication passage 501. The second valve body 26Ae is disposed to face the communication port of the second communication passage 502 so that the cooling water does not flow into the second communication passage 502. The third valve body 26Af is disposed at a position that does not block any cooling water passage.

As shown in FIG. 31, when the switching valve 26 A is driven, the cooling water is discharged from the water pump 11 and flows through the cooling water passage 50, the cooling water passage 51, the cooling water passage 52, the cooling water passage 57, the cooling water passage 59, and flows back to the water pump 11.

Figure 32:
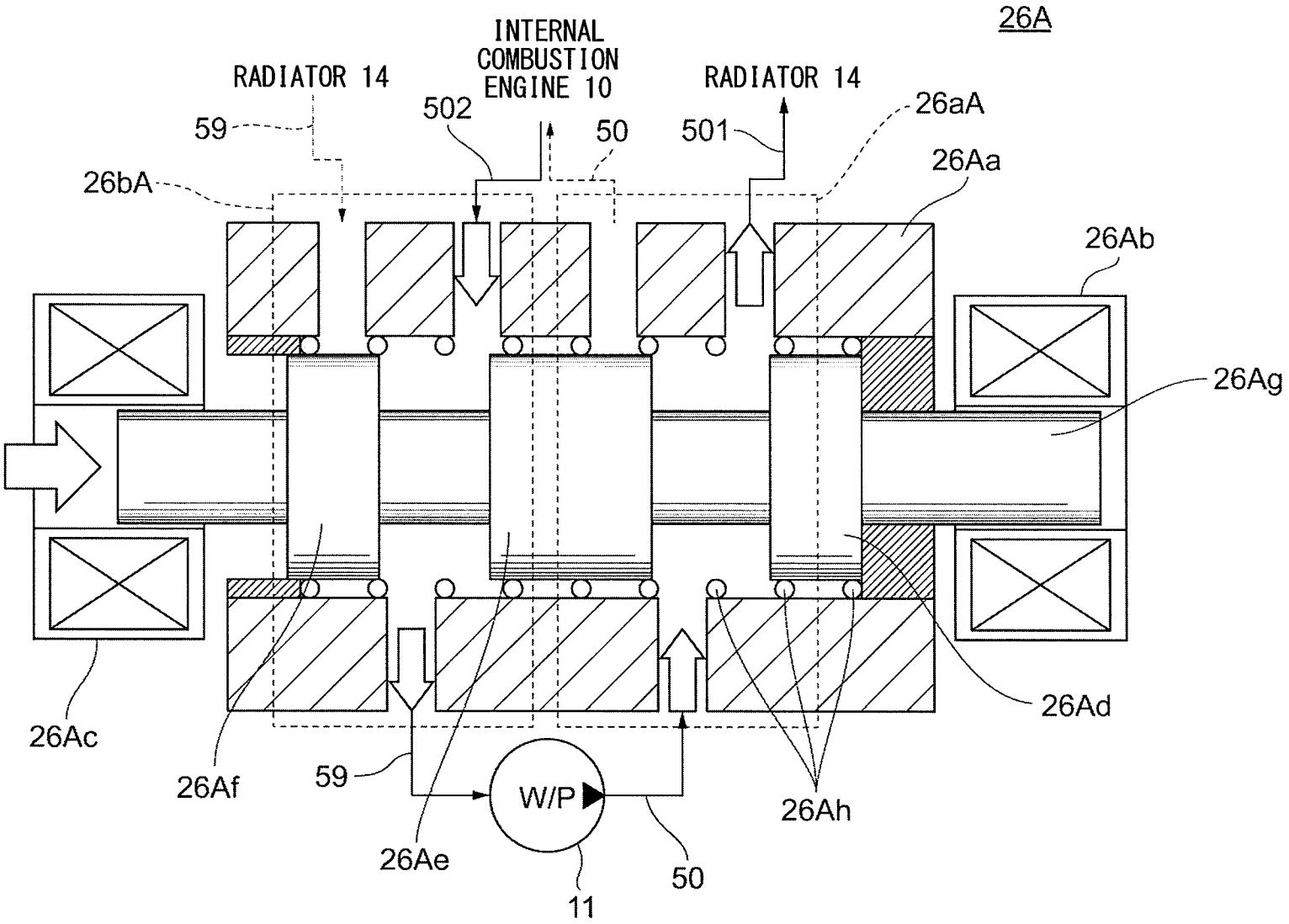
FIG. 32 is a diagram for explaining a switching valve as a modification.

When the first valve body 26Ad, the second valve body 26Ae and the third valve body 26Af are positioned as shown in FIG. 32, the cooling water flows to form the reverse flow. The first valve body 26Ad is disposed at a position that does not block any cooling water passage. The second valve body 26Ae receives the cooling water that has passed through the cooling water passage 50 from the water pump 11. The second valve body 26Ae is disposed to face the downstream side communication port of the passage 50 so that the flowing cooling water does not flow into the cooling water passage 50 but flows to the first communication passage 501. The third valve body 26Af is disposed to face the upstream side communication port of the cooling water passage 59 so that the cooling water flowing from the second communication passage 502 flows into the cooling water passage 59.

As shown in FIG. 32, when the switching valve 26A is driven, the cooling water is discharged from the water pump 11 and flows through the cooling water passage 50, the first communication passage 501, the cooling water passage 59, the cooling water passage 57, the cooling water passage 52, the cooling water passage 51, the cooling water passage 50, the second communication passage 502, and the cooling water passage 59, and returns to the water pump 11.

Since the first valve body 26Ad, the second valve body 26Ae, and the third valve body 26Af can both be driven by advancing and retracting the drive shaft 26Ag in the switching valve 26A, it is easy to realize the synchronization operation with the first valve body 26Ad, the second valve body 26Ae, and the third valve body 26Af.

Figure 33:
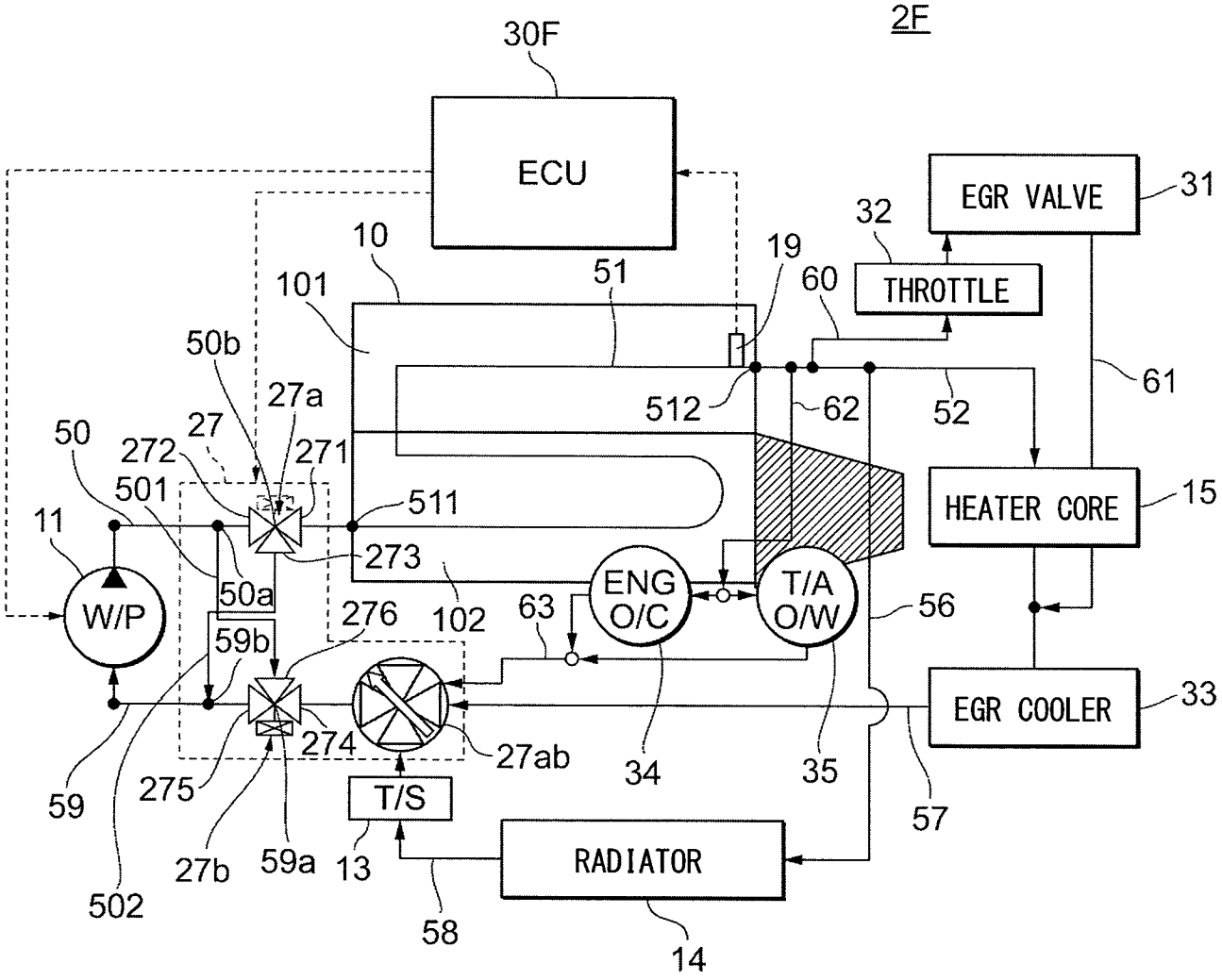
FIG. 33 is a system configuration diagram showing a configuration of a cooling system according to a fifth embodiment of the present disclosure.

Subsequently, a cooling system 2F according to a fifth embodiment will be described with reference to FIG. 33. As shown in FIG. 33, a cooling system 2F according to the fifth embodiment of the present disclosure includes an internal combustion engine 10, a water pump 11, a thermostat 13, a radiator 14, a heater core 15, an ECU 30F, an EGR valve 31, a throttle 32, an EGR cooler 33, an engine oil cooler 34, and a transaxle oil warmer 35. The internal combustion engine 10, the thermostat 13, the radiator 14, and the heater core 15 are the same as those in the first embodiment, and the explanation thereof is omitted. The water pump 11 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

From the cooling water passage 52, the cooling water passage 60 and the cooling water passage 62 branch off. The cooling water passage 60 is connected to the throttle 32 and the EGR valve 31. A cooling water passage 61 extends from the EGR valve 31. The cooling water passage 61 is connected to the cooling water passage 57 through the heater core 15.

The EGR cooler 33 is provided on the way of the cooling water passage 57. The cooling water passage 62 is connected to the engine oil cooler 34 and the transaxle oil warmer 35.

The cooling system 2E further includes a first communication passage 501 and a second communication passage 502 that connect the cooling water passage 50 which is one end side external passage and the cooling water passage 59 which is the other end side external passage.

The first communication passage 501 connects a branch portion 50*a* of the cooling water passage 50 and a branch portion 59*a* of the cooling water passage 59. The second communication passage 502 connects a branch portion 50*b* of the cooling water passage 50 and a branch portion 59*b* of the cooling water passage 59. The branch portion 50*a* is provided on the upstream side closer to the discharge port of the water pump 11 than the branch portion 50*b*. The branch portion 59*a* is provided on the upstream side far from the suction port of the water pump 11 than the branch portion 59*b*.

The cooling system 2E further includes a switching valve 27 for switching a forward flow and a reverse flow. In the forward flow, the cooling water discharged from the discharge port of the water pump 11 flows through the internal combustion engine 10 via the cooling water passage 50, which is the one end side external passage, and returns to the suction port of the water pump 11 from the cooling water passage 59, which is the one end side external passage. The reverse flow passes through the first communication passage 501 and the cooling water passage 59 which is the other end side external passage, passes through the internal combustion engine 10, and returns to the suction port from the cooling water passage 50, which is the one end side external passage, and the second communication passage 502.

The switching valve 27 has a first valve 27*a* and a second valve 27*b* which are three-way valves, respectively, and a flow rate control valve 27*ab*. The first valve 27*a* is provided in the branch portion 50*b* of the cooling water passage 50 and the second communication passage 502 which are one end side external passage. The second valve 27 *b* is provided in the branch portion 59*a* between the cooling water passage 59 which is the other end side external passage and the first communication passage 501.

Cooling water passages 57, 58, and 63 are connected to the flow rate control valve 27*ab*. The cooling water passage 63 connects the engine oil cooler 34 and the transaxle oil warmer 35 to the flow control valve 27*ab*.

Figure 34:
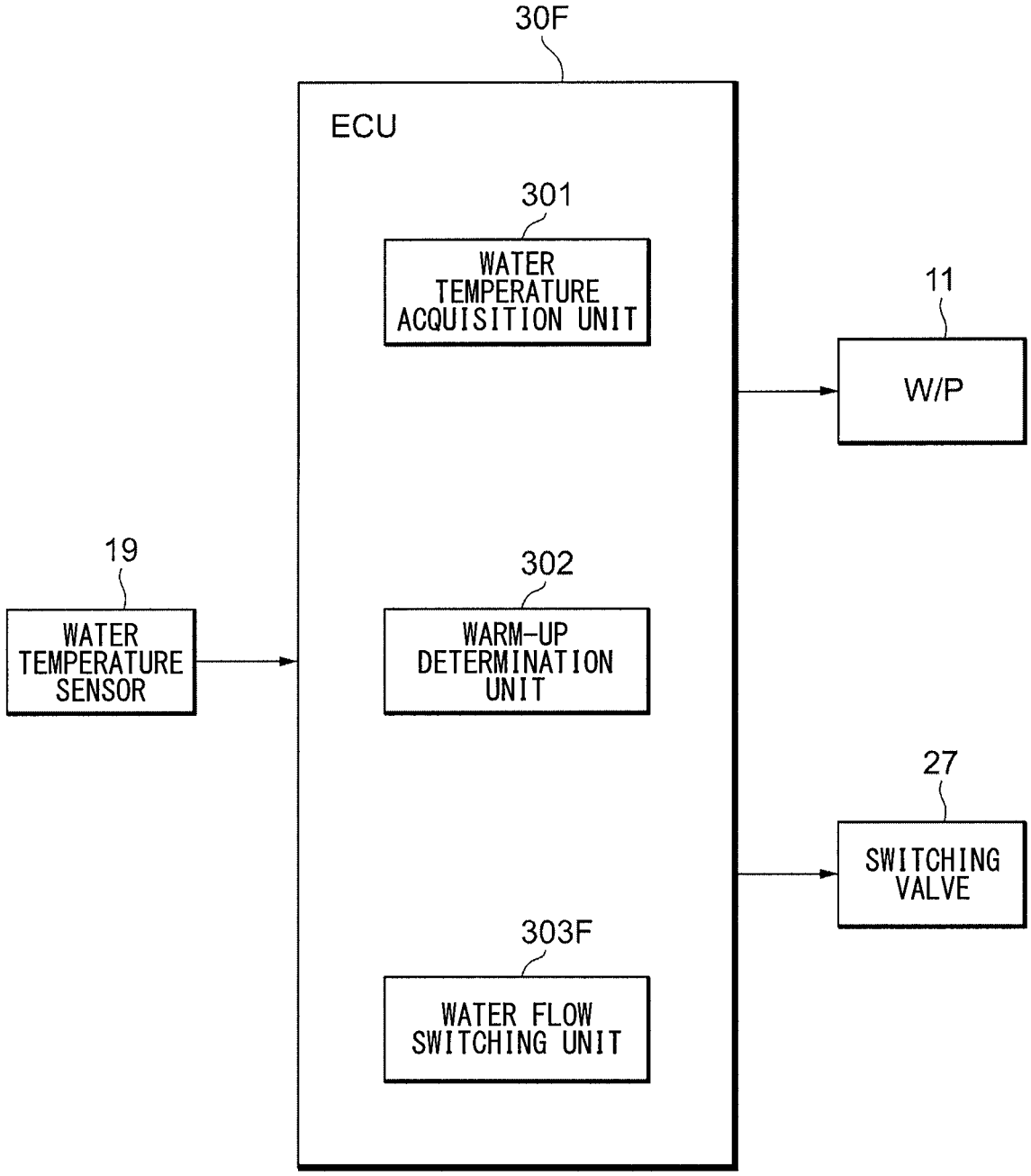
FIG. 34 is a block diagram for explaining a functional configuration of the ECU shown in FIG. 33.

Subsequently, with reference to FIG. 34, the ECU 30F which is a control device used for the cooling system 2F will be described. The ECU 30F receives a water temperature detection signal output from the water temperature sensor 19. The ECU 30F outputs a drive signal to the water pump 11 and the switching valve 27.

The ECU 30F includes the water temperature acquisition unit 301, the warm-up determination unit 302, and a water flow switching unit 303F as functional components.

The water temperature acquisition unit 301 and the warm-up determination unit 302 are the same as those described in the first embodiment, and the description thereof will be omitted.

The water flow switching unit 303F is a part that executes the water flow switching control, and switches the forward flow from the one end portion 511 to the other end portion 512 of the cooling water passage 51 and the reverse flow from the other end portion 512 toward the one end portion 511 with respect to the flow of the cooling water in the cooling water passage 51. The water flow switching unit 303F executes the water flow switching control by driving the water pump 11 and the switching valve 27.

Figure 35:
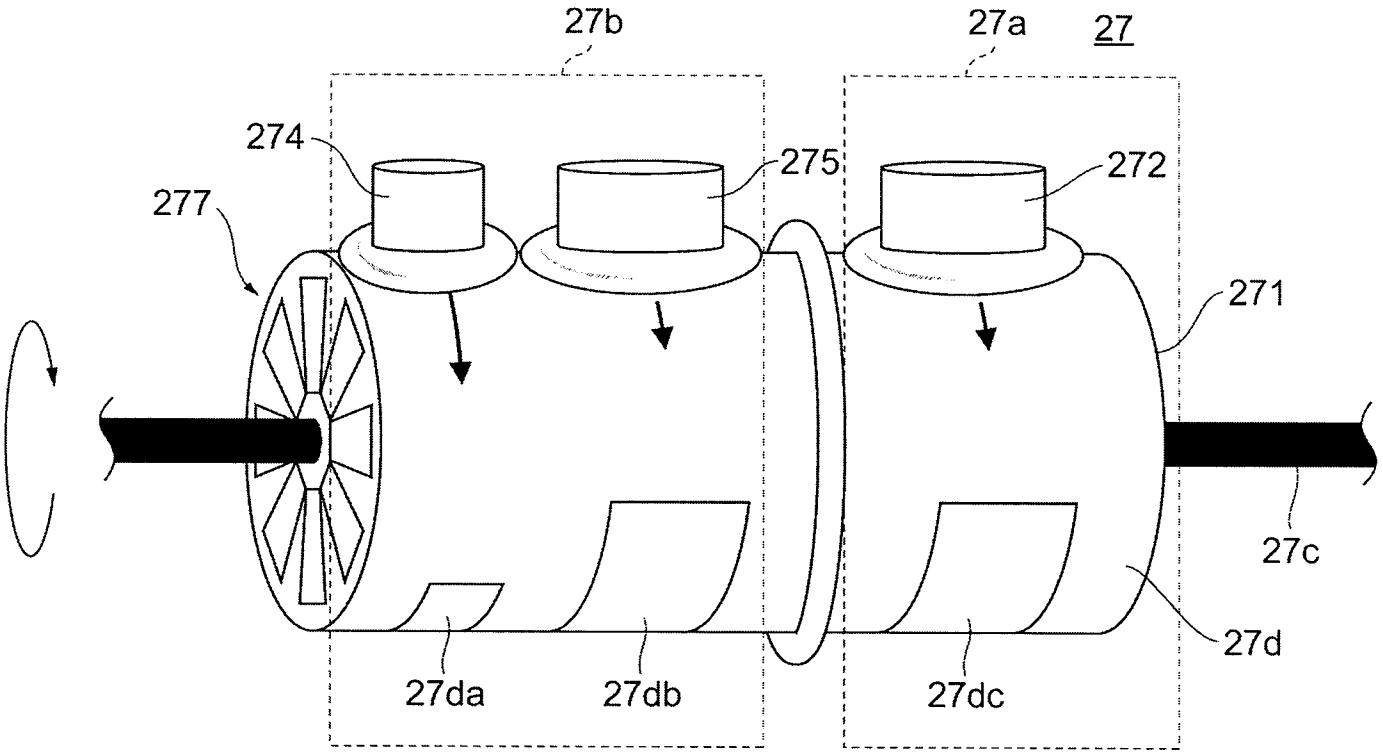
FIG. 35 is a diagram for explaining the switching valve shown in FIG. 33.

As shown by way of example in FIG. 35, the switching valve 27 has a rotating shaft 27*c* and an inner main body portion 27*d*. The inner main body portion 27*d* is configured to rotate around the rotating shaft 27*c*. A communication hole 271, a communication hole 277, a flow adjustment opening 27*da*, a flow adjustment opening 27*db*, a flow rate adjustment opening 27*dc*, and a partition wall 27*dd* are formed in the inner main body portion 27*d*.

The communication hole 271 is connected to the one end portion 511 of the internal combustion engine 10 through the cooling water passage 50. The communication hole 277 is connected to the cooling water passages 57, 63. A communication hole 272, a communication hole 273, a communication hole 274, a communication hole 275, and a communication hole 276 are provided on the outer side of the inner main body portion 27*d*.

Figure 36:
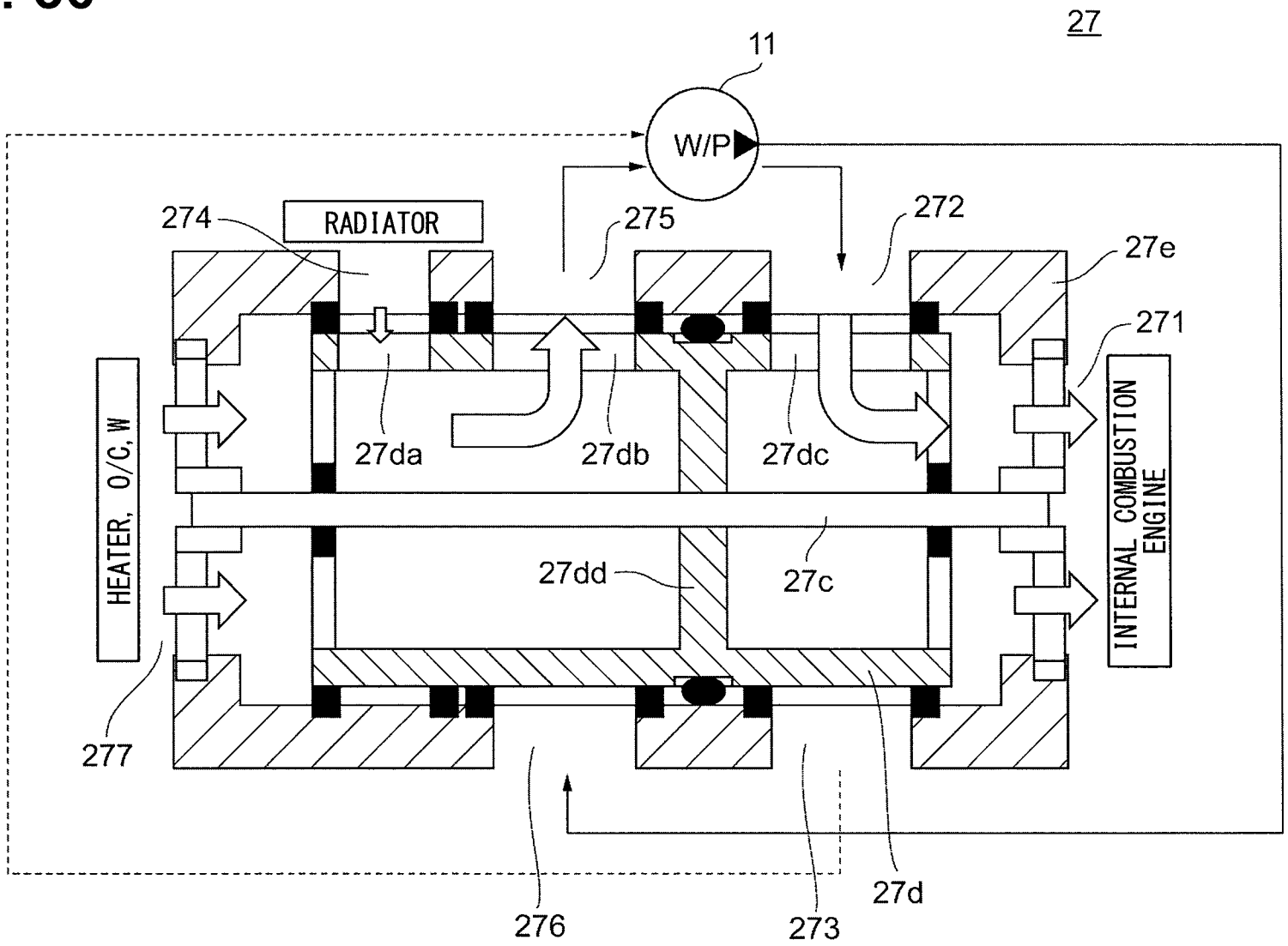
FIG. 36 is a diagram for explaining the switching valve shown in FIG. 33.

As shown in FIG. 36, an outer main body portion 27*e* is provided outside the inner main body portion 27*d*. The communication hole 272, the communication hole 273, the communication hole 274, the communication hole 275, and the communication hole 276 are provided in the outer main body portion 27*e*.

The state of the switching valve 27 shown in FIG. 36 is a state in which the forward flow is formed. The flow adjustment opening 27*da* is located at a position corresponding to the communication hole 274. The communication hole 274 is connected to the cooling water passage 58. The cooling water that has passed through the radiator 14 flows into the inside of the inner main body portion 27*d*. Since the communication hole 277 is not closed, the cooling water that has passed through the heater core 15, the engine oil cooler 34, and the transaxle oil warmer 35 also flows into the inner main body portion 27*d*.

The flow adjustment opening 27*db* is located at a position corresponding to the communication hole 275. The communication hole 275 is connected to the cooling water passage 59. The inner main body portion 27*d* is partitioned by the partition wall 27*dd* between the flow rate adjustment opening 27*db* and the flow rate adjustment opening 27*dc*. The cooling water flowing from the flow adjustment opening 27*da* and the communication hole 277 flows from the communication hole 275 to the suction port of the water pump 11 via the cooling water passage 59.

The flow adjustment opening 27*dc* is located at a position corresponding to the communication hole 272. The cooling water discharged from the discharge port of the water pump 11 flows into the inside of the inner main body portion 27*d* through the cooling water passage 50, the communication hole 272 and the flow rate adjustment opening 27*dc*. The flowing cooling water flows into the cooling water passage 50 through the communication hole 271.

Figure 37:
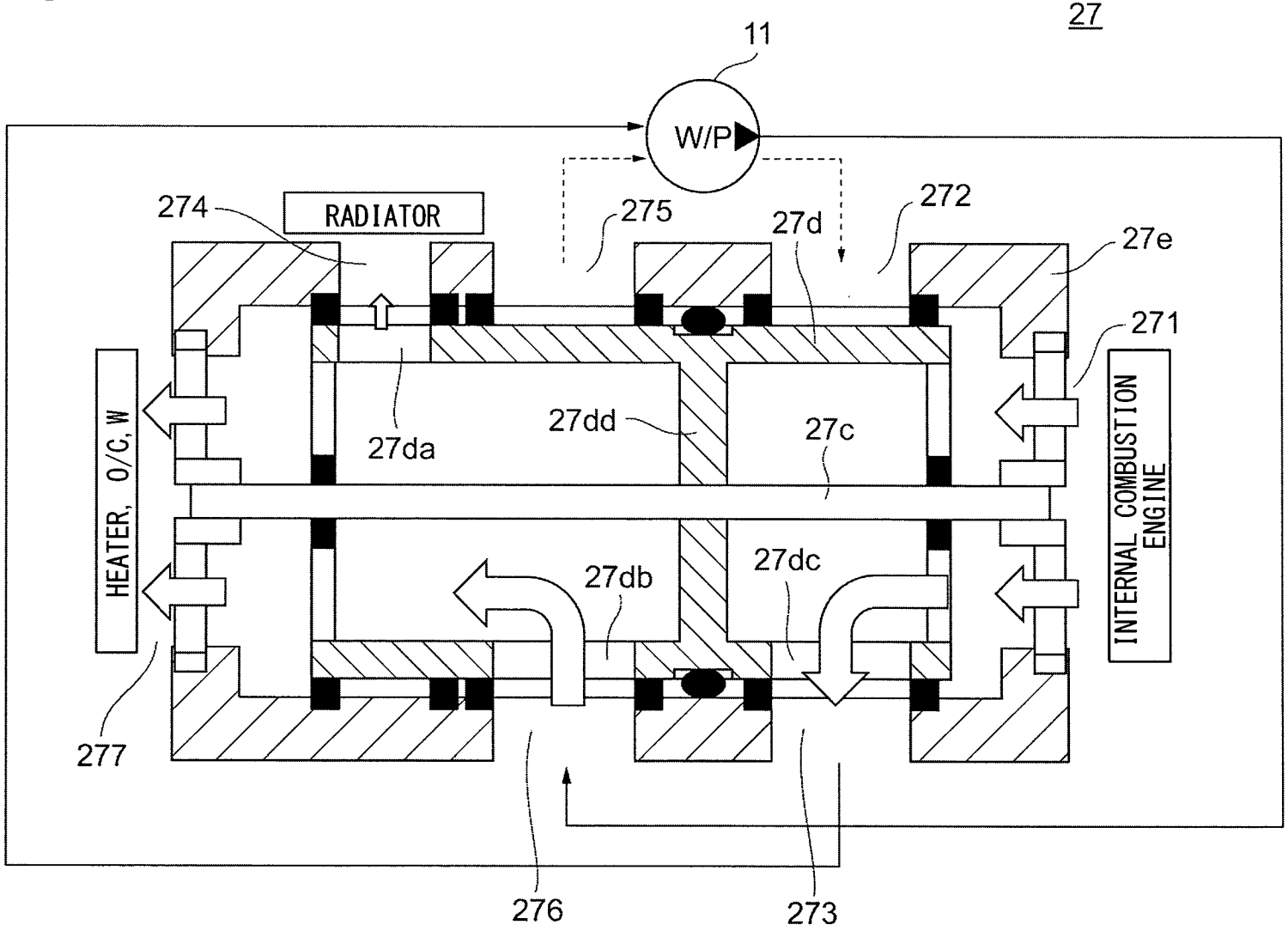
FIG. 37 is a diagram for explaining the switching valve shown in FIG. 33.

The state of the switching valve 27 shown in FIG. 37 is a state in which the forward flow is formed. The flow adjustment opening 27*db* is located at a position corresponding to the communication hole 275. The cooling water discharged from the water pump 11 flows into inside of the inner main body portion 27*d* through the communication hole 275 and the flow rate adjustment opening 27*db*. The flowing cooling water flows through the communication hole 277 to the internal combustion engine 10 via the heater core 15, the engine oil cooler 34, and the transaxle oil warmer 35. The cooling water flowing out from the internal combustion engine 10 flows into inside of the inner main body portion 27*d* from the communication hole 271.

The flow adjustment opening 27*dc* is located at a position corresponding to the communication hole 273. The cooling water flowing from the internal combustion engine 10 flows through the communication hole 273 and the flow rate adjustment opening 27*dc* to the suction port side of the water pump 11.

Figure 38:
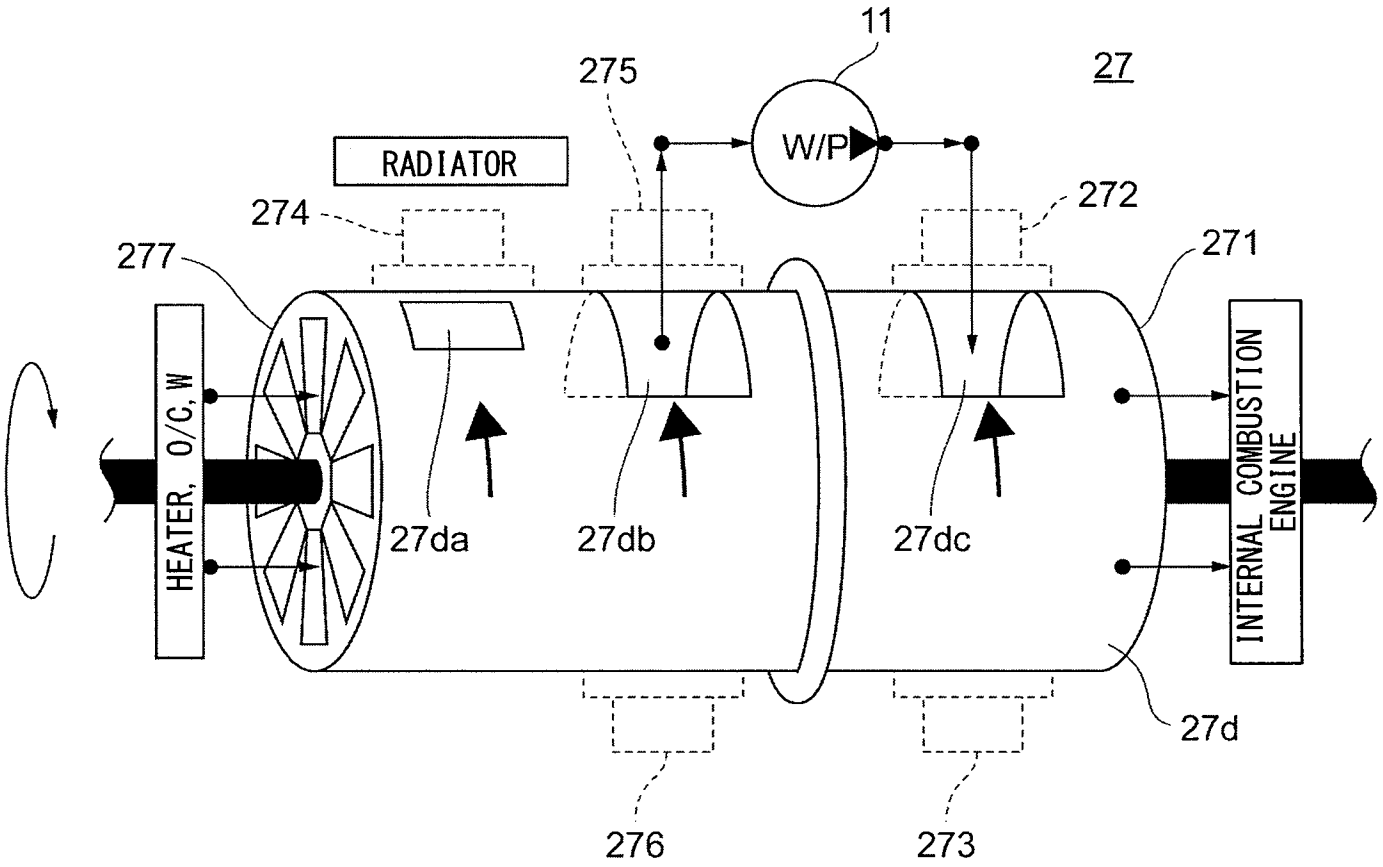
FIG. 38 is a diagram for explaining the switching valve shown in FIG. 33.
Figure 39:
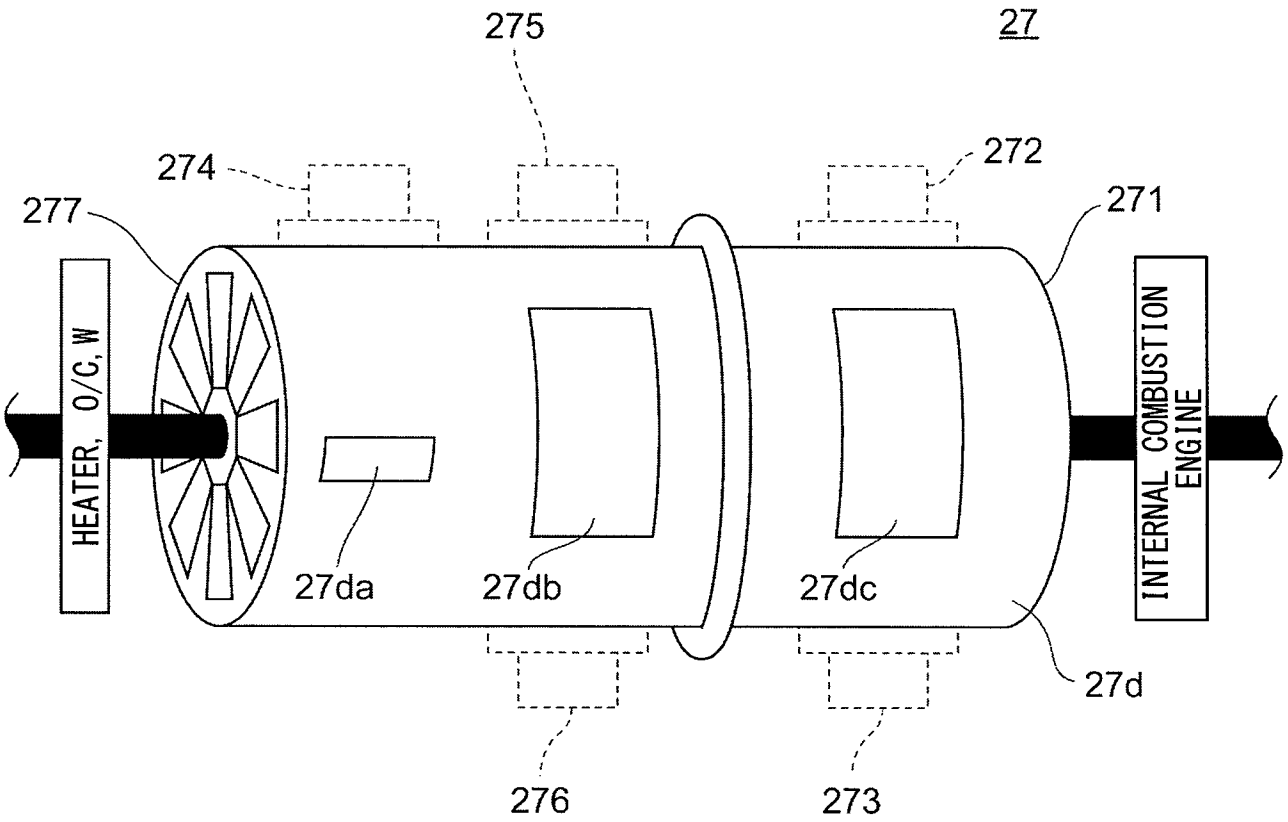
FIG. 39 is a diagram for explaining the switching valve shown in FIG. 33.
Figure 40:
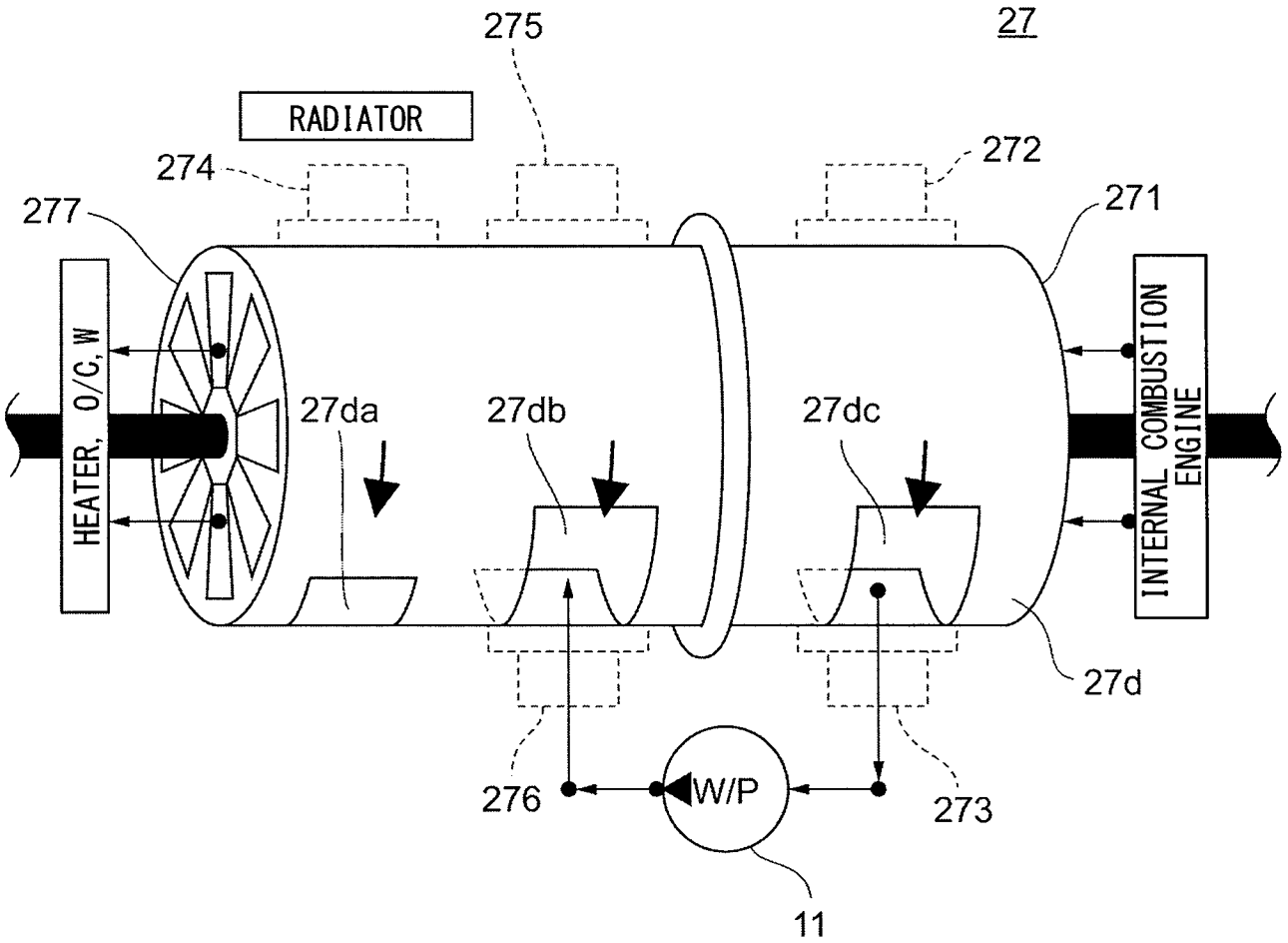
FIG. 40 is a diagram for explaining the switching valve shown in FIG. 33.

The state of the switching valve 27 shown in FIG. 38 is a state in which a forward flow is formed, and is a perspective view of the state shown in FIG. 36. The state of the switching valve 27 shown in FIG. 39 is a perspective view showing a state in which the flow of cooling water is stopped. All of the flow adjustment opening 27*da*, the flow rate adjustment opening 27*db*, and the flow rate adjustment opening 27*dc* are closed. The state of the switching valve 27 shown in FIG. 40 is a state in which a forward flow is formed, and is a perspective view of the state shown in FIG. 37.

Figure 41:
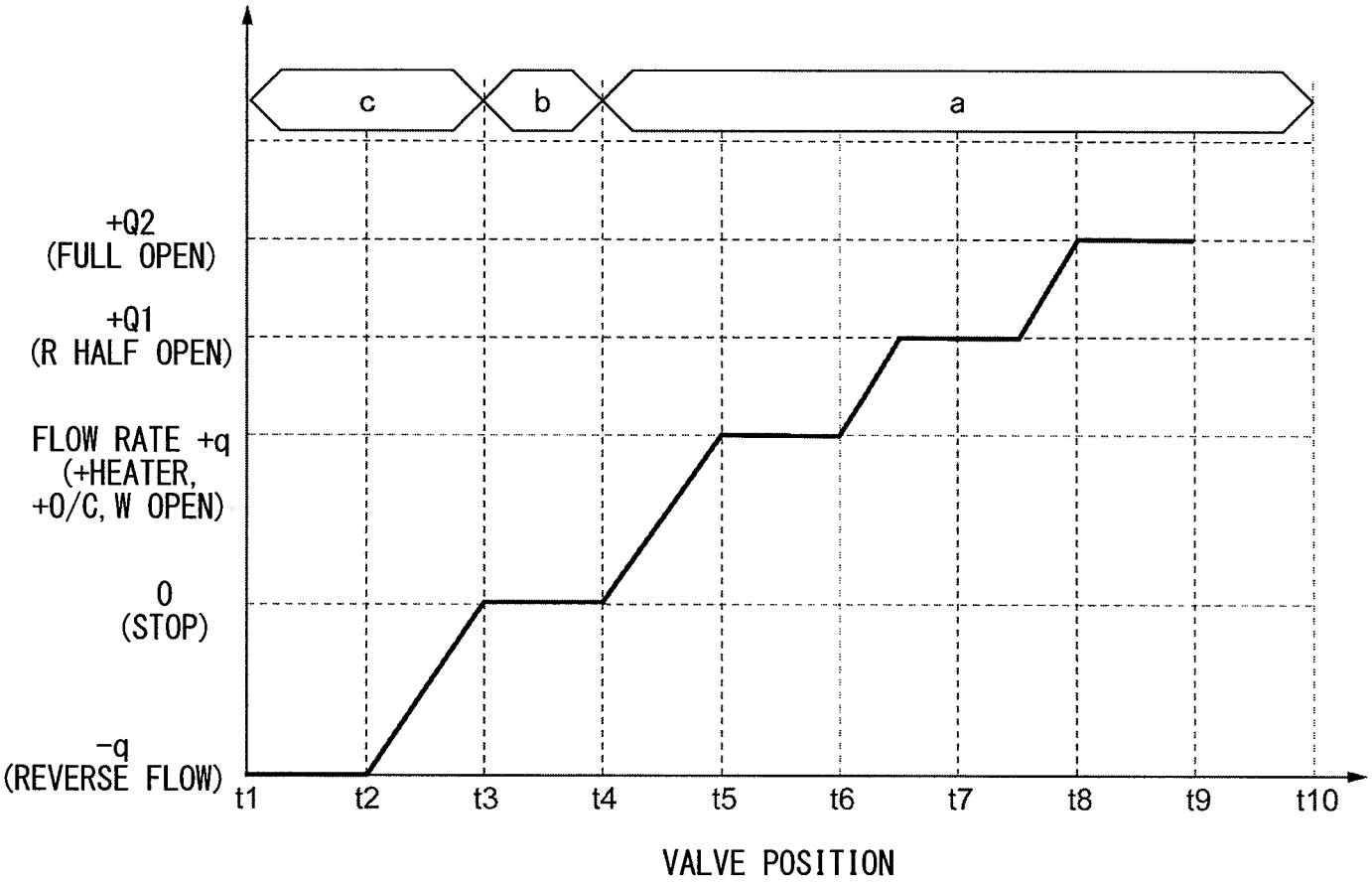
FIG. 41 is a diagram for explaining the switching valve shown in FIG. 33.

FIG. 41 is a view showing the relationship between the valve position and the flow rate of the switching valve 27. From time t1 to time t2, the reverse flow shown in FIG. 40 is formed. It is possible to adjust the amount of overlap between the flow adjustment opening 27*db* and the communication hole 276 and adjust the flow rate of the cooling water flowing in the reverse direction. From time t2 to time t3, the flow rate of the cooling water flowing backward is decreased.

From time t3 to time t4, as shown in FIG. 39, the switching valve 27 is in the water-stop state. From time t4 to time t5, the switching valve 27 is adjusted so that the flow rate of the cooling water flowing from the heater core 15, the engine oil cooler 34, and the transaxle oil warmer 35 becomes dominant. From time t6 to time t7, the switching valve 27 is adjusted so that the cooling water also flows through the radiator 14. After time t8, the switching valve 27 is adjusted so as to form a forward flow in the previous cycle.

Figure 42:
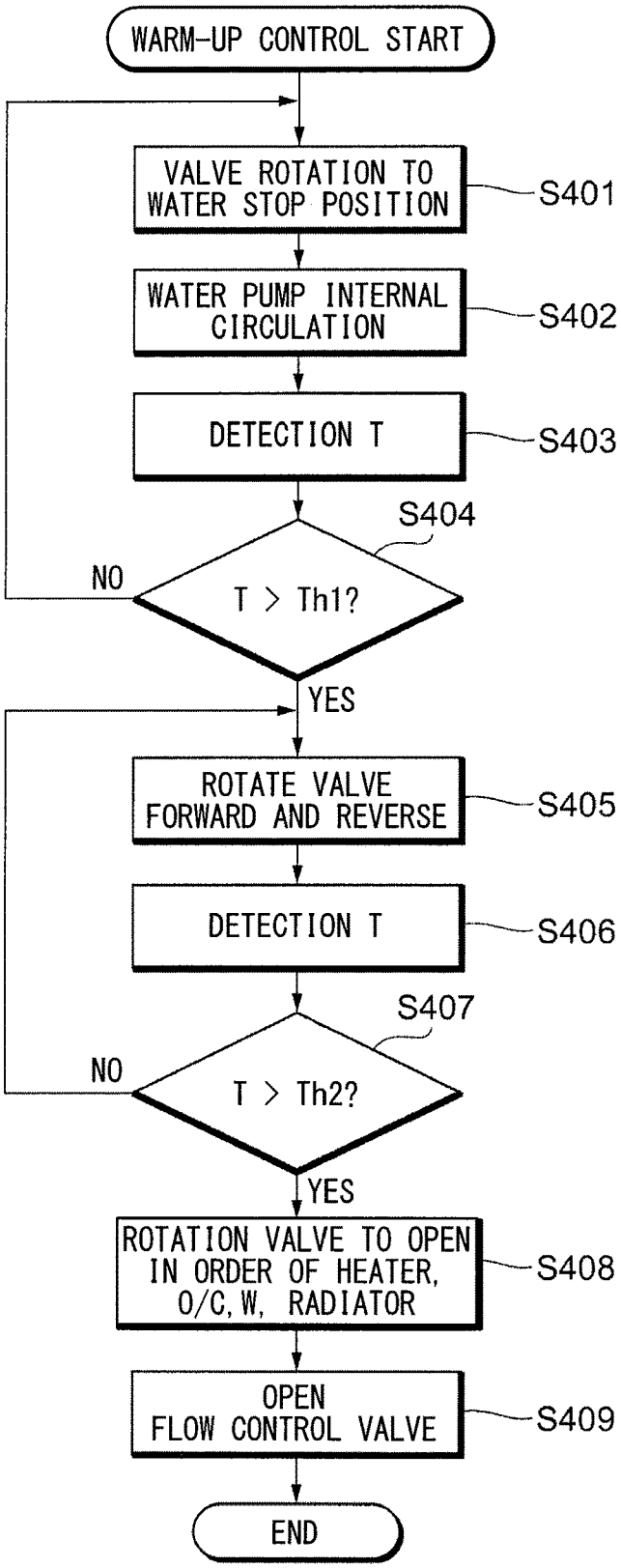
FIG. 42 is a flowchart for explaining a process of warm-up control.

Subsequently, the warm-up control of the cooling system 2F will be described with reference to FIG. 42. In step S401 of FIG. 42, the water flow switching unit 303F rotates the switching valve 27 to the water stop position as shown in FIG. 39. In step S402 following step S401, a signal for driving the water pump 11 is outputted. In step S403 following S402, the water temperature acquisition unit 301 detects the water temperature sensor temperature T detected by the water temperature sensor 19.

In step S404 following step S403, the warm-up determination unit 302 determines whether or not the water temperature sensor temperature T has reached the warming-up temperature Th1. The warm-up temperature Th1 is lower than the warm-up temperature Th2. If the water temperature sensor temperature T has not reached the warming-up temperature Th1 (step S404: NO), the process returns to step S401. If the water temperature sensor temperature T has reached the warming-up temperature Th1 (step S404: YES), the process proceeds to step S405.

In step S405, the water flow switching unit 303F is configured to rotate the switching valve 27 in forward and reverse directions so that the switching valve 27 alternates between the state shown in FIG. 38 and the state shown in FIG. 39. The cooling water in the internal combustion engine 10 is once pushed out and then returned, so that the temperature of the cooling water in the internal combustion engine 10 rises faster and the warm-up time is shortened. Since the maximum temperature of the cooling water in the internal combustion engine 10 also does not exceed the upper limit temperature, boiling of the cooling water can be prevented.

In step S406 following step S405, the water temperature acquisition unit 301 acquires the water temperature T. In step S407 subsequent to step S406, the warm-up determining unit 302 determines whether or not the water temperature sensor temperature T has reached the warming-up temperature Th2. If the water temperature sensor temperature T has not reached the warming-up temperature Th1 (step S407: NO), the process returns to step S405. If the water temperature sensor temperature T has reached the warming-up temperature Th1 (step S407: YES), the process proceeds to step S408.

In step S408, the water flow switching unit 303F rotates the switching valve 27, so that the state where the flow rate of the cooling water flowing from the heater core 15, the engine oil cooler 34, and the transaxle oil warmer 35 is dominant, is changed to the state where the cooling water flows from the radiator 14 as well. In step S409 following step S408, the switching valve 27 is fully opened in the forward direction.

The cooling system 2F according to the fifth embodiment has the same effects as the cooling system 2, 2A according to the first embodiment and the cooling systems 2C, 2D according to the third embodiment unless it is technically contradictory. In the cooling system 2D which is a modified example of the third embodiment, the operation and effect are common in that a three-way valve is used. Since the switching valve 27 of the cooling system 2F can drive the first valve 27*a* and the second valve 27*b* by rotationally driving the rotating shaft 27*c*, it is easy to realize the tuning operation. Furthermore, since the flow adjustment openings 27*da*, 27*db*, and 27*dc* are provided, the first valve 27*a* and the second valve 27*b* are configured so that the flow rate can be adjusted, and stepwise flow rate adjustment can be performed after completion of warming up.

Figure 43:
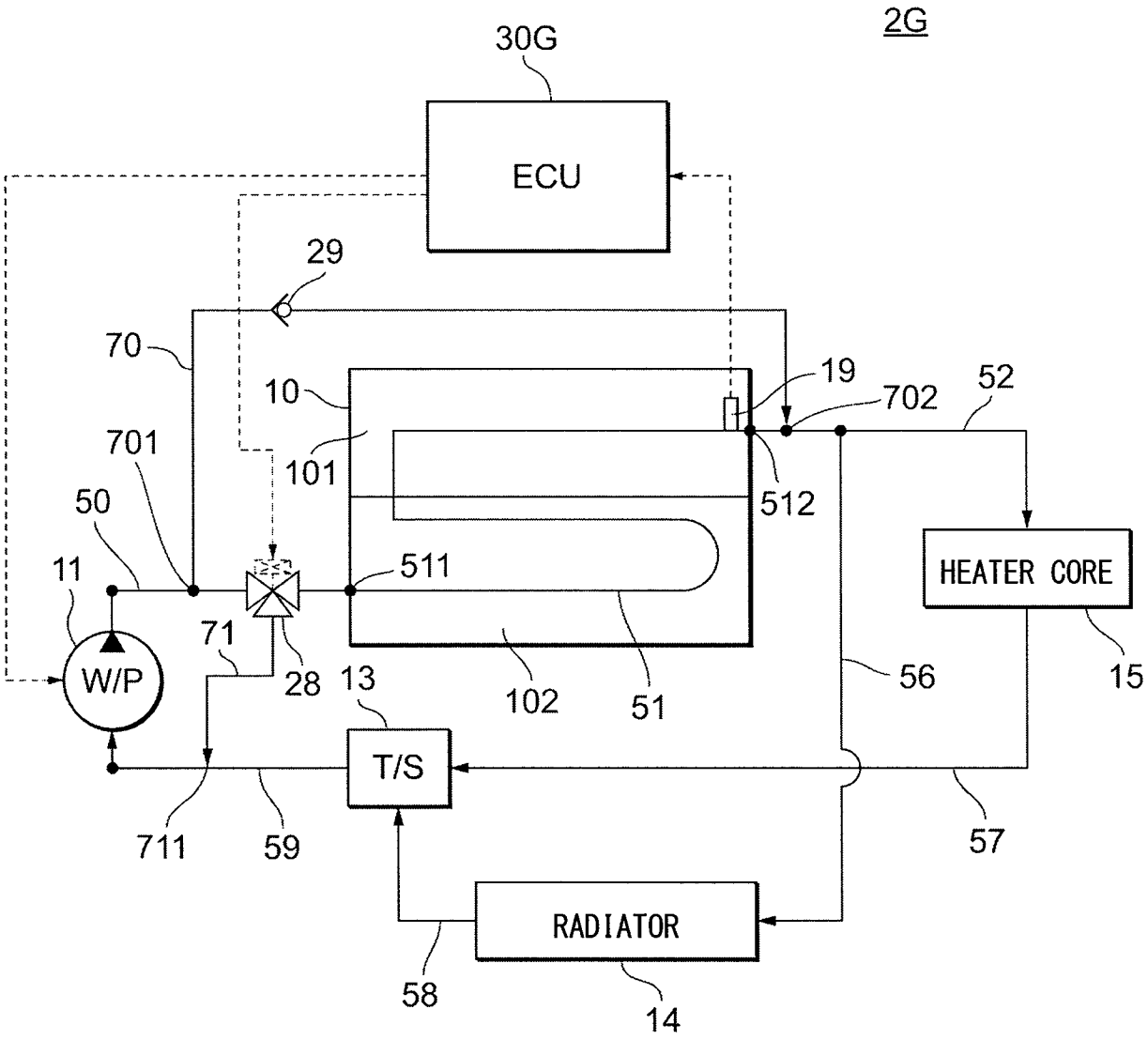
FIG. 43 is a system configuration diagram showing a configuration of a cooling system according to a sixth embodiment of the present disclosure.

Subsequently, a cooling system 2G according to a sixth embodiment will be described with reference to FIG. 43. As shown in FIG. 43, a cooling system 2G according to the sixth embodiment of the present disclosure includes the internal combustion engine 10, the water pump 11, the thermostat (T/S) 13, the radiator 14, the heater core 15, and an ECU 30G. The internal combustion engine 10, the thermostat 13, the radiator 14, and the heater core 15 are the same as those in the first embodiment, and the explanation thereof is omitted. The water pump 11 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

The cooling system 2G further includes a three-way valve 28. The three-way valve 28 is provided on the way of the cooling water passage 50. The communication passage 71 is provided so as to connect the three-way valve 28 and the branch portion 711 of the cooling water passage 50.

The cooling system 2G further includes a check valve 29. The check valve 29 is provided on the way of the bypass passage 70. The bypass passage 70 is provided so as to connect the flow dividing portion 701 of the cooling water passage 50 and the merging portion 702 of the cooling water passage 52. The check valve 29 is provided so that cooling water can flow from the dividing portion 701 toward the merging portion 702.

Figure 44:
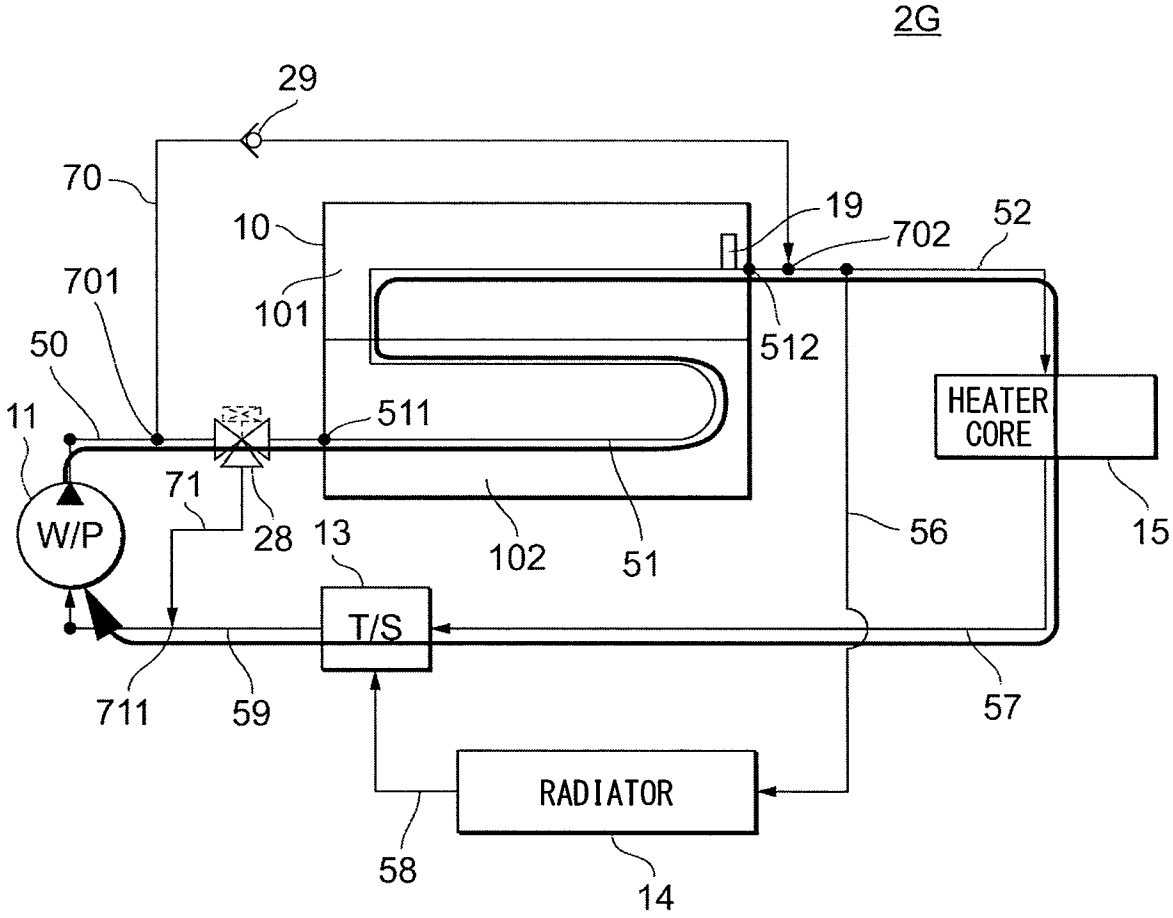
FIG. 44 is a diagram showing a state in which cooling water flows in a forward flow in the cooling system shown in FIG. 43.

FIG. 44 shows the flow of the cooling water when the ECU 30G executes the water flow switching control which forms the forward flow. In the case of forming the forward flow, the ECU 30G closes the communication passage 71 side of the three-way valve 28 and controls so that the cooling water can pass through the cooling water passage 50 side. As shown in FIG. 44, the cooling water is discharged from the water pump 11, passes through the cooling water passage 50, the cooling water passage 51, the cooling water passage 52, the cooling water passage 57, and the cooling water passage 59 and flows back to the water pump 11.

Figure 45:
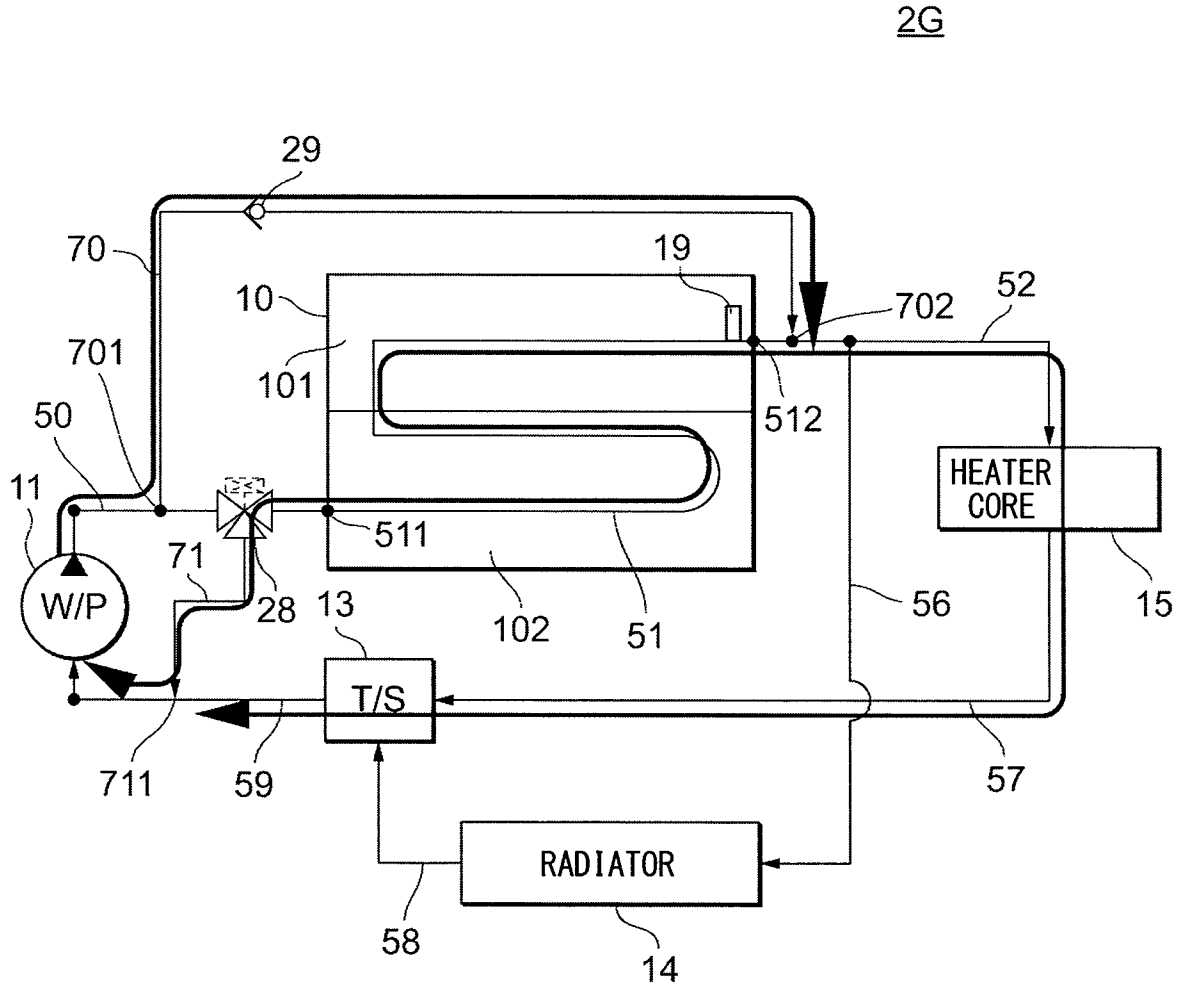
FIG. 45 is a diagram showing a state in which cooling water flows in a reverse flow in the cooling system shown in FIG. 43.

FIG. 45 shows the flow of the cooling water when the ECU 30G executes the water flow switching control to form the reverse flow. In the case of forming a reverse flow, the ECU 30G closes the upstream side of the cooling water passage 50 of the three-way valve 28 and controls so that the cooling water can pass from the internal combustion engine 10 side of the cooling water passage 50 to the communication passage 71. As shown in FIG. 45, the cooling water is discharged from the water pump 11 and passes through the cooling water passage 50, the bypass passage 70, the cooling water passage 51, the cooling water passage 50, the communication passage 71, the cooling water passage 59 and returns to the water pump 11. After the cooling water passes through the bypass passage 70, the cooling water is diverted and flows back to the water pump 11 through the cooling water passage 52, the cooling water passage 57 and the cooling water passage 59.

As described above, the cooling system 2G according to the present embodiment includes the bypass passage 70 that divides the cooling water from the dividing portion 701 of the cooling water passage 50, which is the one end side outer passage, and rejoins the cooling water into the cooling water passage 52 which is the other end side external passage connected to the other end portion 512 side on the cooling water passage 51 which is the internal passage, and the check valve 29 provided in the bypass passage 70. Further, the cooling system 2G includes the three-way valve 28 provided between the dividing portion 701 of the cooling water passage 50 and the one end portion 511, and the communication passage 71 connected the three-way valve 28 and the cooling water passage 59 which is the other end side external passage and connected to the other end portion 512. The ECU 30G including the water flow switching unit executes water flow switching control by controlling the water pump 11 and the three-way valve 28.

The ECU 30G including the water flow switching unit switches the three-way valve 28 so that the cooling water flows from the flow dividing unit 701 to the one end portion 511, drives the water pump 11, and controls the three way valve 28 such that the cooling water flows from the one end portion 511 to the communication passage 71, and drives the water pump 11 to execute the water flow switching control.

Figure 46:
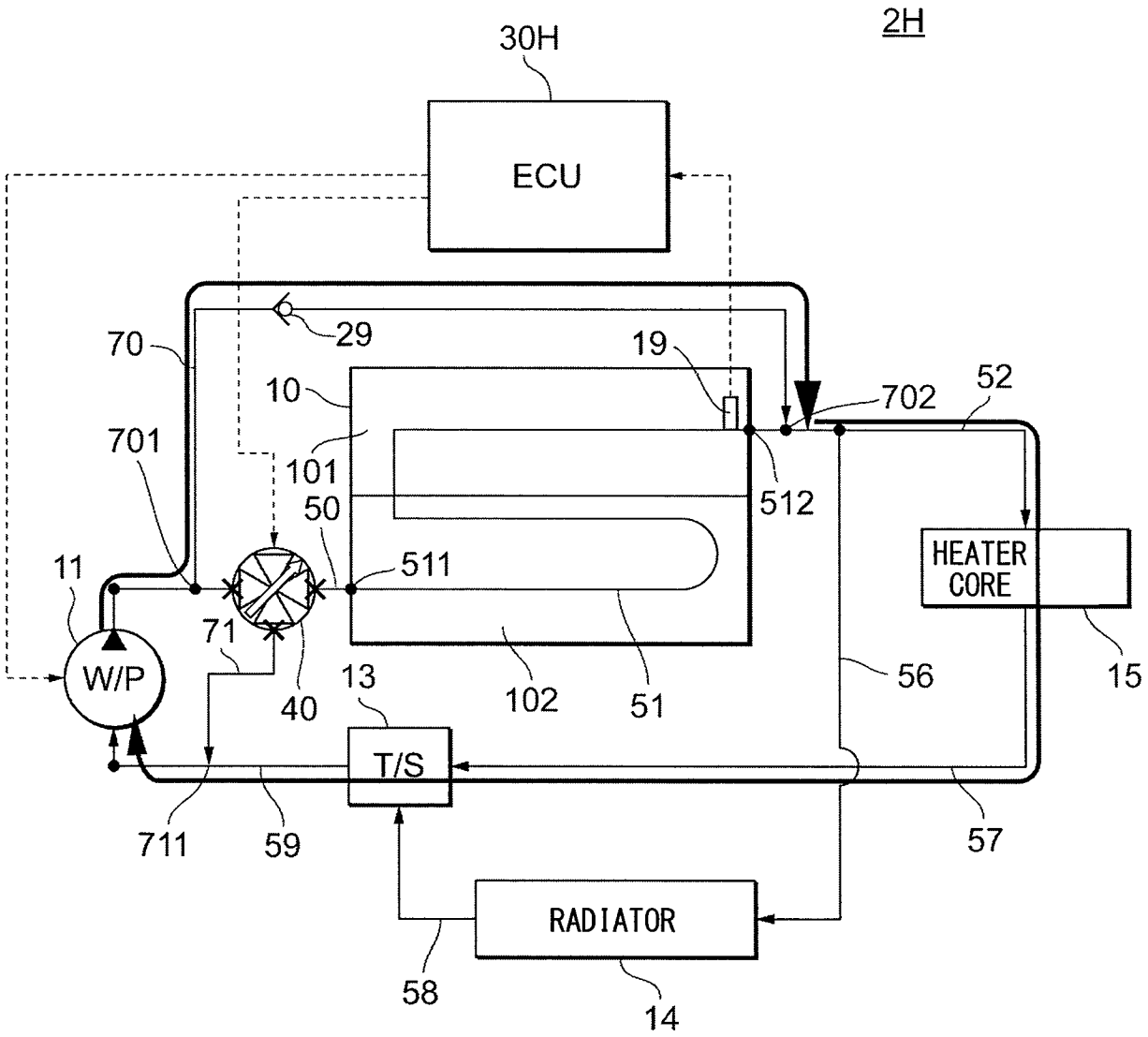
FIG. 46 is a system configuration diagram showing a configuration of a modification of the cooling system shown in FIG. 43.

A cooling system 2H as a modification of the cooling system 2G according to the sixth embodiment will be described with reference to FIG. 46. As shown in FIG. 46, the cooling system 2H includes the internal combustion engine 10, the water pump 11, the thermostat 13, the radiator 14, the heater core 15, and the ECU 30C. The internal combustion engine 10, the thermostat 13, the radiator 14, and the heater core 15 are the same as those in the first embodiment, and the explanation thereof is omitted. The water pump 11 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

The cooling system 2H includes a flow rate adjusting multi-way valve 40 instead of the three-way valve 28 of the cooling system 2G. The flow rate adjusting multi-way valve 40 is provided on the way of the cooling water passage 50. The communication passage 71 is provided so as to connect the flow rate adjusting multi-way valve 40 and a branch portion 711 of the cooling water passage 50.

Figure 47:
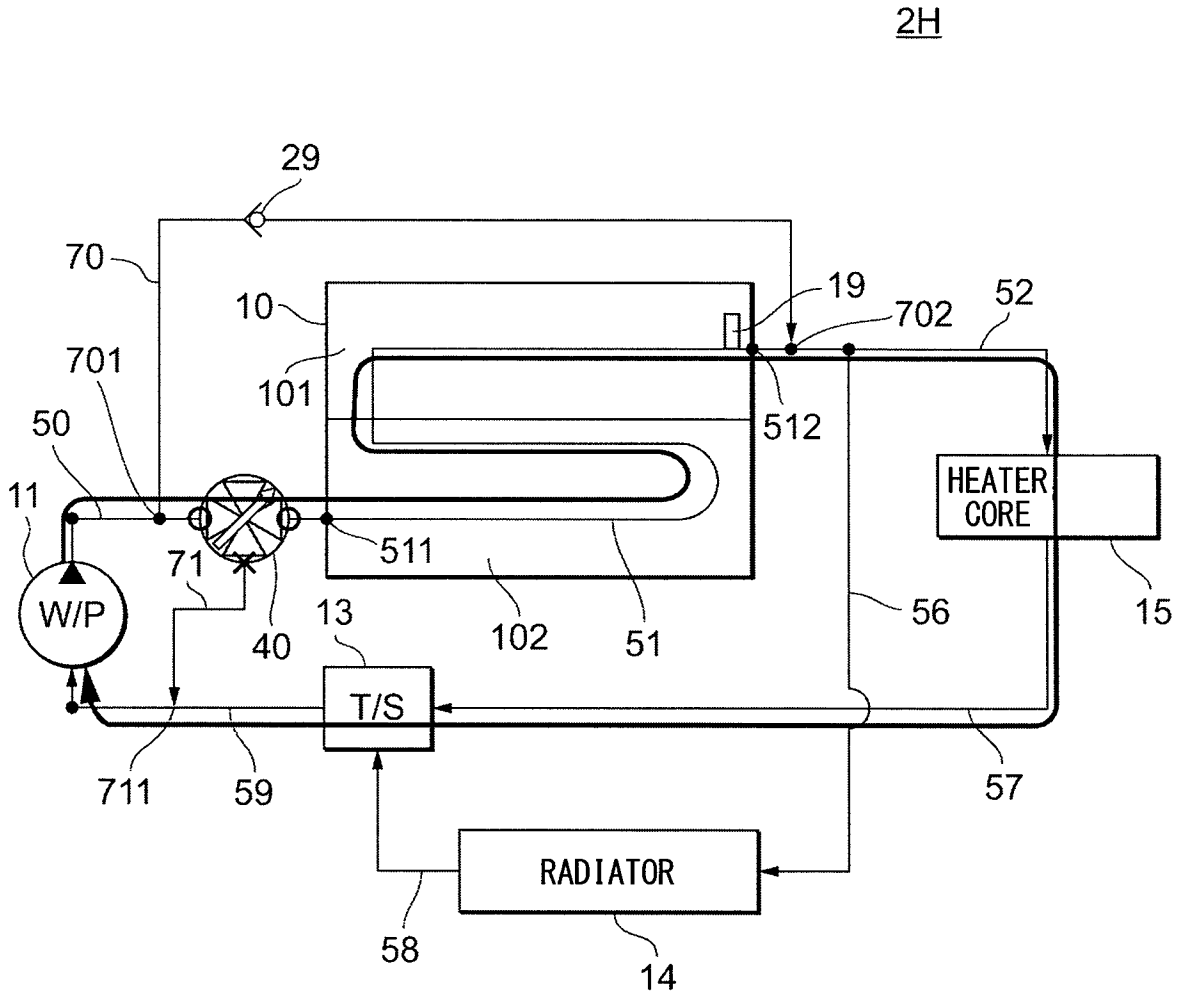
FIG. 47 is a view showing a state in which cooling water flows in a forward flow in the cooling system shown in FIG. 46.

FIG. 47 shows the flow of the cooling water when the ECU 30H executes the water flow switching control which forms the forward flow. In the case of forming a forward flow, the ECU 30H closes the communication passage 71 side of the flow rate adjusting multi-way valve 40 and controls so that the cooling water can pass through the cooling water passage 50 side. As shown in FIG. 47, the cooling water is discharged from the water pump 11, passes through the cooling water passage 50, the cooling water passage 51, the cooling water passage 52, the cooling water passage 57, and the cooling water passage 59 and flows back to the water pump 11.

Figure 48:
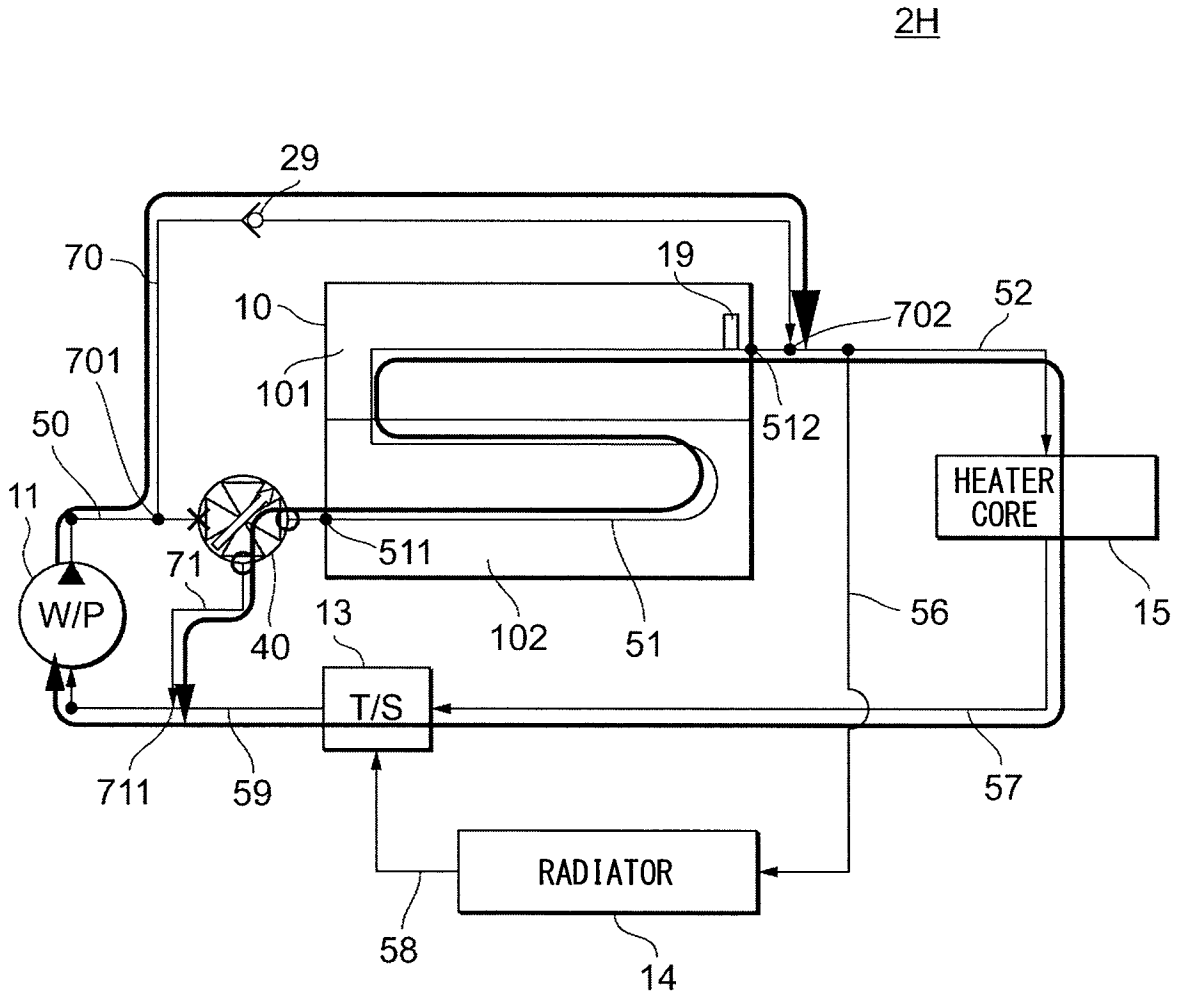
FIG. 48 is a view showing a state in which cooling water flows in a reverse flow in the cooling system shown in FIG. 46.

FIG. 48 shows the flow of the cooling water when the ECU 30H executes the water flow switching control to form the reverse flow. In the case of forming the reverse flow, the ECU 30H closes the upstream side of the cooling water passage 50 of the three-way valve 28 and controls so that the cooling water can pass from the internal combustion engine 10 side of the cooling water passage 50 to the communication passage 71. As shown in FIG. 45, the cooling water is discharged from the water pump 11 and passes through the cooling water passage 50, the bypass passage 70, the cooling water passage 51, the cooling water passage 50, the communication passage 71, the cooling water passage 59 and returns to the water pump 11. After the cooling water passes through the bypass passage 70, the cooling water is diverted and flows back to the water pump 11 through the cooling water passage 52, the cooling water passage 57 and the cooling water passage 59.

Figure 49:
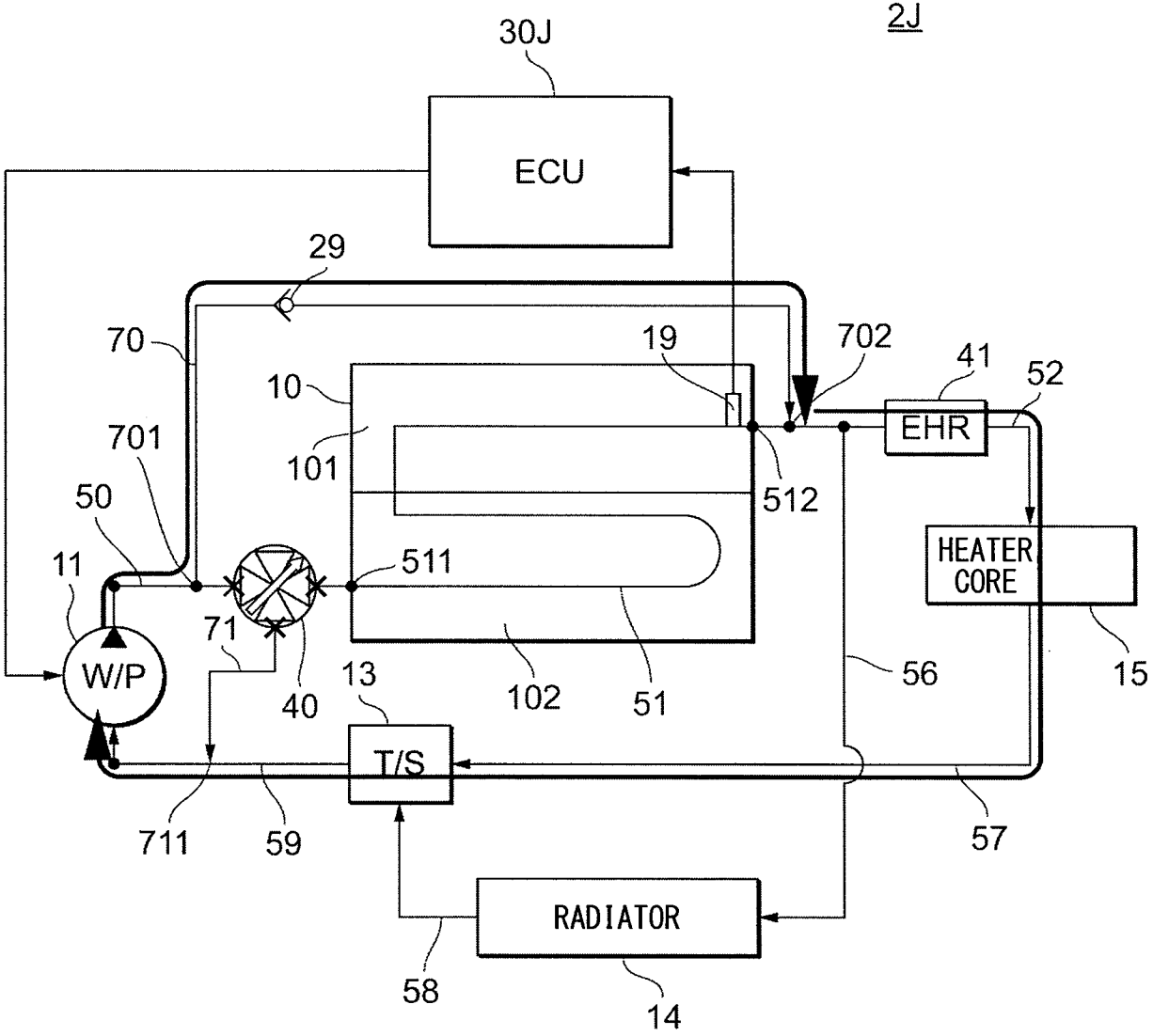
FIG. 49 is a system configuration diagram showing a configuration of a modification of the cooling system shown in FIG. 43.

As shown in FIG. 46, the flow rate adjusting multi-way valve 40 can close all the inlet/outlet ports so as not to allow the cooling water to flow into the internal combustion engine 10. In this case, as in the case of the cooling system 2J shown in FIG. 49, it is also possible to provide the exhaust heat recovery device 41 in the cooling water passage 52 to recover the exhaust heat by the cooling water.

Figure 50:
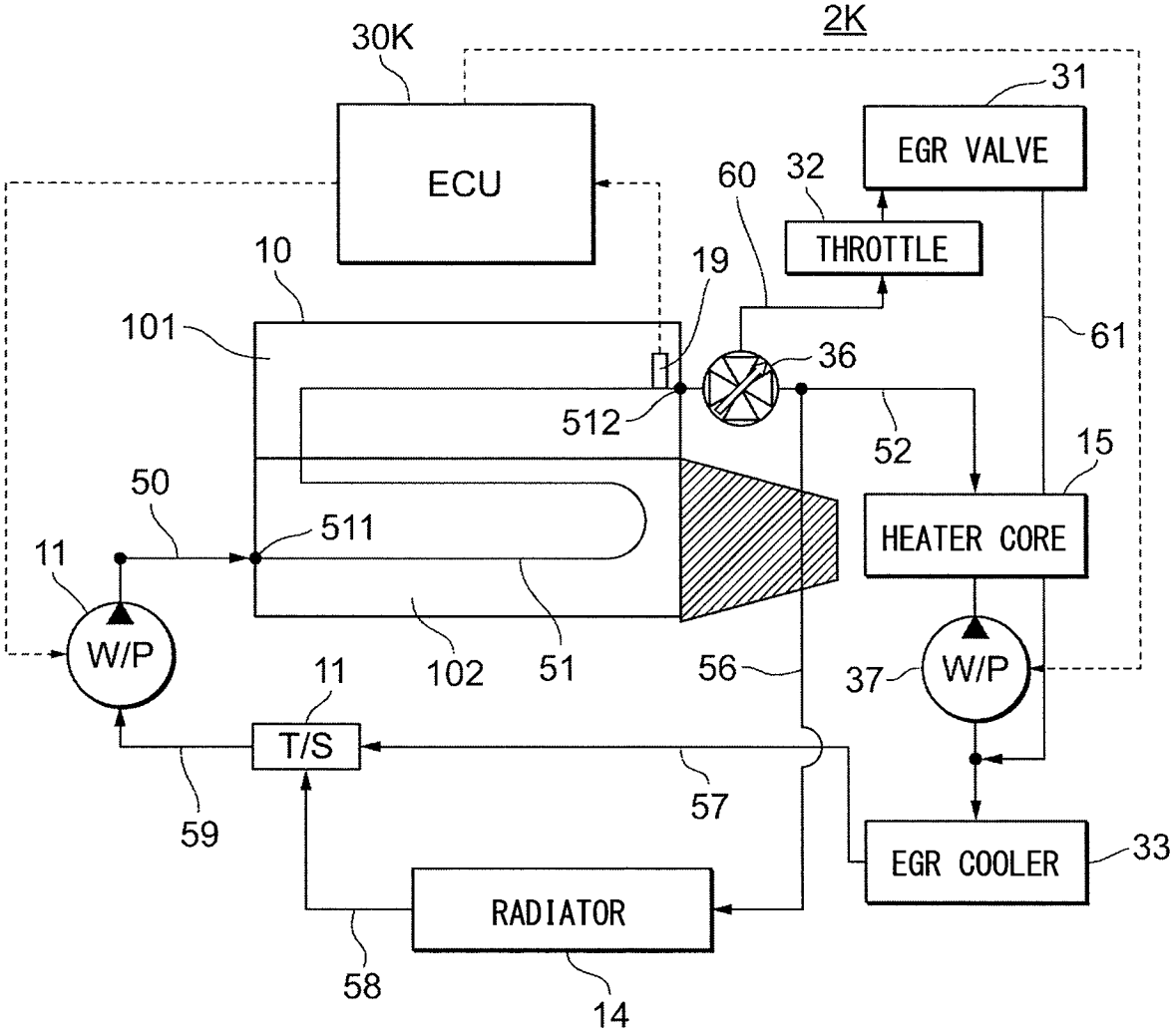
FIG. 50 is a system configuration diagram showing a configuration of a cooling system according to a seventh embodiment of the present disclosure.

Subsequently, a cooling system 2K according to a seventh embodiment will be described with reference to FIG. 50. As shown in FIG. 50, the cooling system 2K according to the seventh embodiment of the present disclosure includes the internal combustion engine 10, the water pump 11, the thermostat 13, the radiator 14, the heater core 15, an ECU 30K, an EGR valve 31, a throttle 32, an EGR cooler 33, and the water pump 37. The internal combustion engine 10, the thermostat 13, the radiator 14, and the heater core 15 are the same as those in the first embodiment, and the explanation thereof is omitted. The water pump 11, 37 may not have a function of rotating in both forward and reverse directions and discharging cooling water in both directions, and the water pump capable of discharging cooling water in one direction can be used. The cooling water passages 50, 51, 52, 56, 57, 58, and 59 are also the same as those in the first embodiment, so the explanation thereof is omitted.

A multi-way valve 36 is provided in the cooling water passage 52. The cooling water passage 60 branches off from the multi-way valve 36. The cooling water passage 60 is connected to the throttle 32 and the EGR valve 31. A cooling water passage 61 extends from the EGR valve 31. The cooling water passage 61 is connected to the cooling water passage 57 through the heater core 15. The EGR cooler 33 is provided on the way of the cooling water passage 57.

Figure 51:
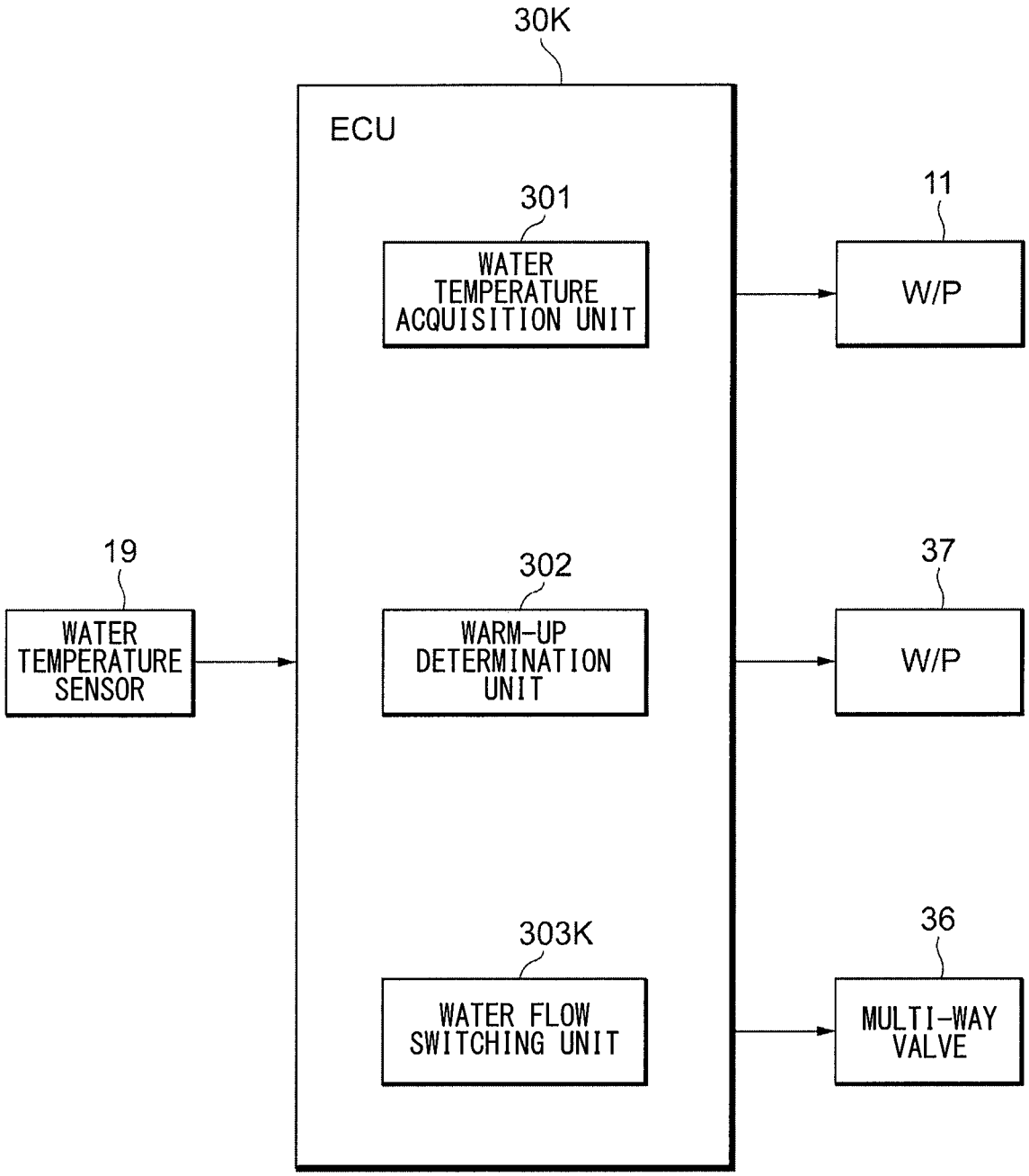
FIG. 51 is a block diagram for explaining a functional configuration of the ECU shown in FIG. 50.

Subsequently, with reference to FIG. 51, the ECU 30K which is a control device used for the cooling system 2K will be described. The ECU 30K receives a water temperature detection signal output from the water temperature sensor 19. The ECU 30K outputs a drive signal to the water pump 11, 37 and the multi-way valve 36.

The ECU 30K includes functional components such as the water temperature acquisition unit 301, the warm-up determining unit 302, and a water flow switching unit 303K.

The water temperature acquisition unit 301 and the warm-up determination unit 302 are the same as those described in the first embodiment, and the description thereof will be omitted.

The water flow switching unit 303K is a part that executes the water flow switching control, and switches the forward flow from the one end portion 511 to the other end portion 512 of the cooling water passage 51 and the reverse flow from the other end portion 512 toward the one end portion 511 with respect to the flow of the cooling water in the cooling water passage 51. The water flow switching unit 303F executes the water flow switching control by driving the water pump 11, 37, and the multi-way valve 36.

Figure 52:
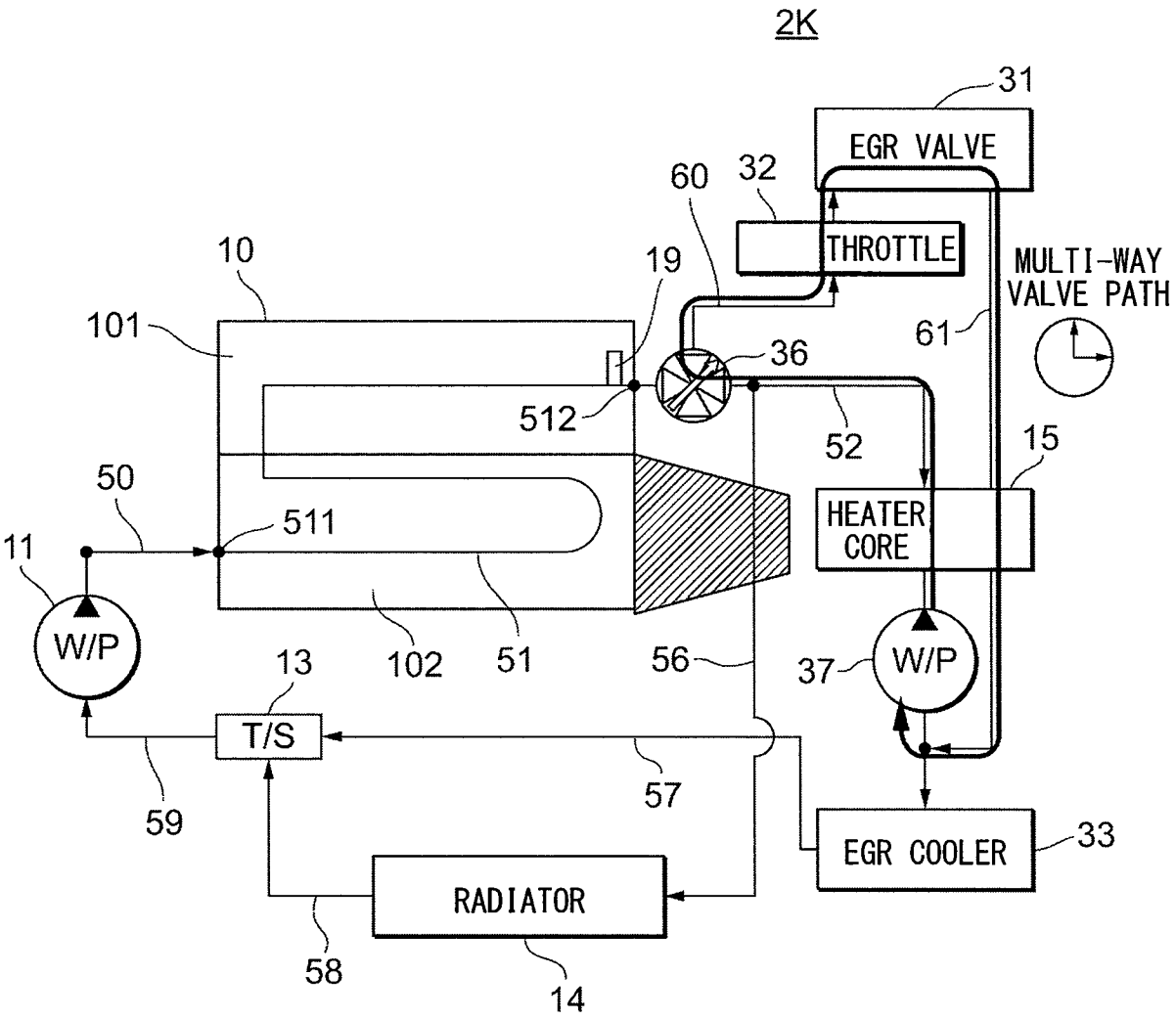
FIG. 52 is a diagram showing one embodiment in which cooling water flows in the cooling system shown in FIG. 50.

FIG. 52 shows the flow of the cooling water when the water flow switching unit 303K executes the water flow switching control to be in the water stopped state. In the case of setting the water stop state, the water flow switching unit 303K closes the internal combustion engine 10 side of the multi-way valve 36. In the case of setting the water stop state, the water flow switching unit 303K stops the water pump 11 and drives the water pump 37. As shown in FIG. 52, the cooling water is discharged from the water pump 37, and the cooling water passage 52, the heater core 15, the multi-way valve 36, the cooling water passage 60, the throttle 32, the EGR valve 31, the cooling water passage 61, the heater core 15, and flows back to the water pump 11.

Figure 53:
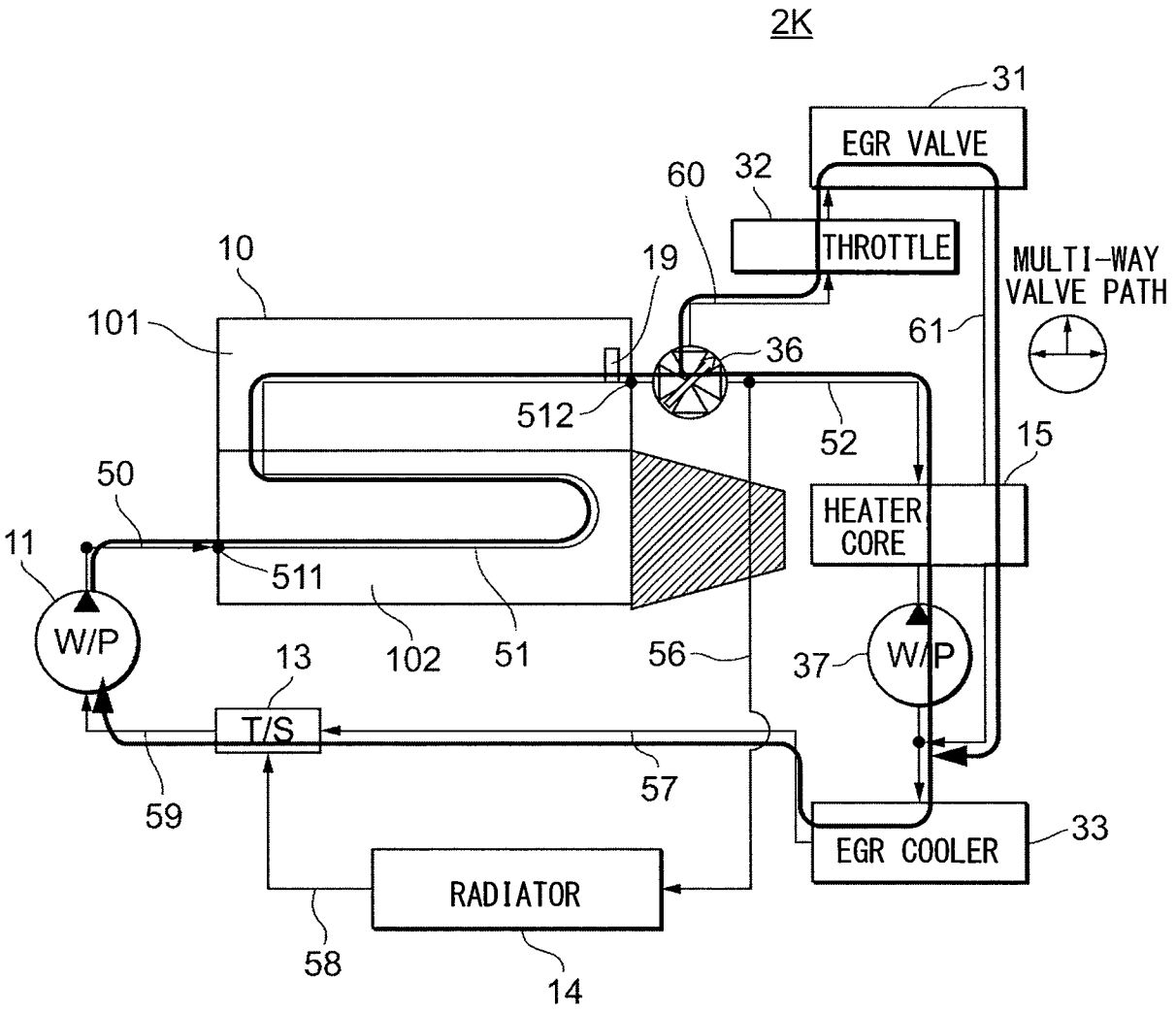
FIG. 53 is a diagram showing a state in which cooling water flows in a forward flow in the cooling system shown in FIG. 50.

FIG. 53 shows the flow of the cooling water in the case where the water flow switching unit 303K executes the water flow switching control to form the forward flow. In the case of forming the forward flow, the water flow switching unit 303K performs control so as to open all the paths of the multi-way valve 36. In the case of setting the water stop state, the water flow switching unit 303K stops the water pump 11 and drives the water pump 37. As shown in FIG. 52, the cooling water is discharged from the water pump 11 and flows through the cooling water passage 50, the cooling water passage 51, the cooling water passage 52, the heater core 15, the EGR cooler 33, the cooling water passage 57, and the cooling water passage 59, and flows back to the water pump 11. The cooling water is branched into the cooling water passage 60 by the multi-way valve 36 and rejoins into the cooling water passage 52 through the throttle 32, the EGR valve 31, the cooling water passage 61 and the heater core 15.

Figure 54:
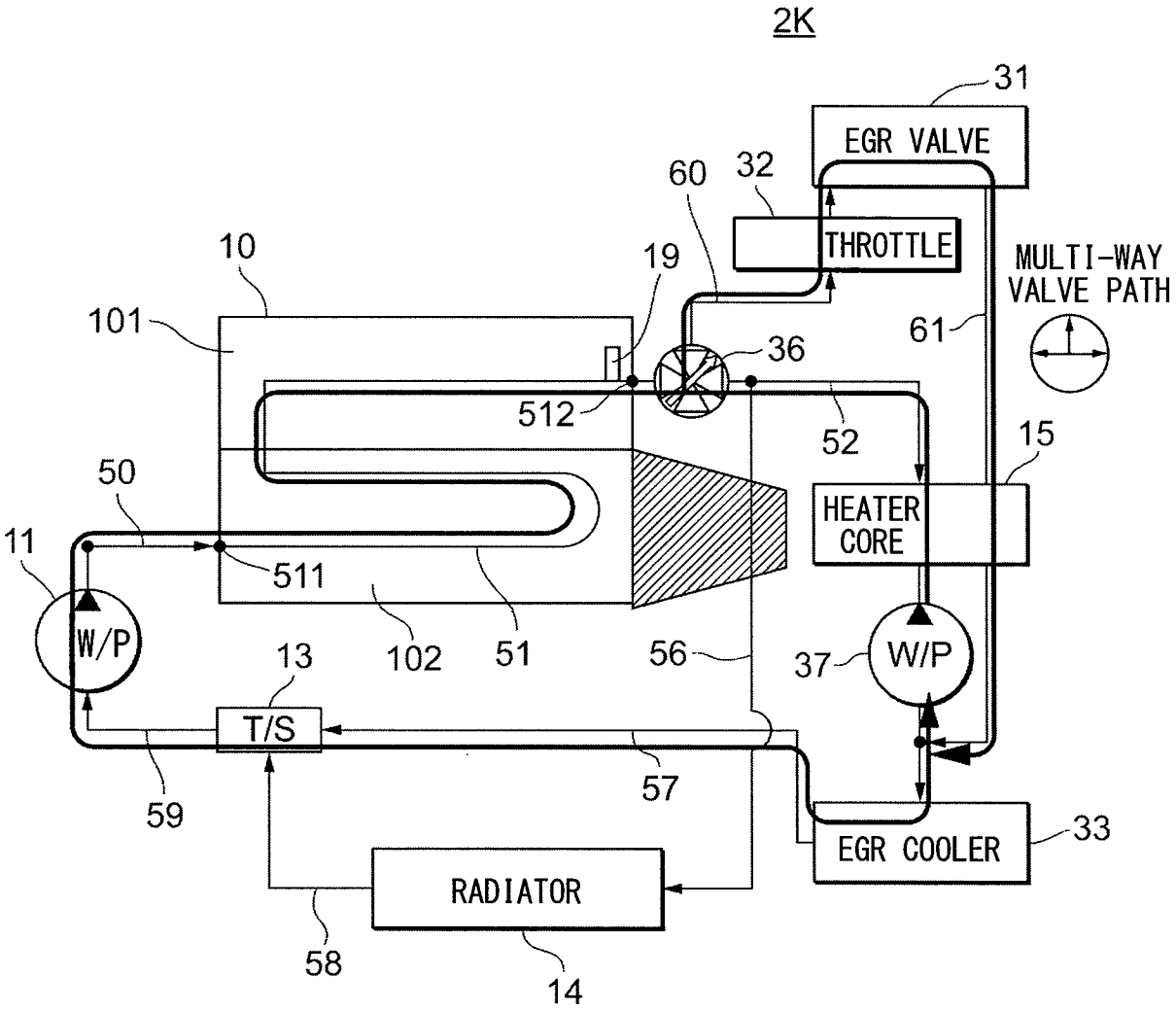
FIG. 54 is a diagram showing a state in which cooling water flows in a reverse flow in the cooling system shown in FIG. 50.

FIG. 54 shows the flow of the cooling water in the case where the water flow switching unit 303K executes the water flow switching control to be the reverse flow. In the case of forming the forward flow, the water flow switching unit 303K performs control so as to open all the paths of the multi-way valve 36. In the case of forward flow, the water flow switching unit 303K stops the water pump 11 and drives the water pump 37. As shown in FIG. 54, the cooling water is discharged from the water pump 37 and flows through the cooling water passage 52, the cooling water passage 51, the cooling water passage 50, the cooling water passage 57, the EGR cooler 33, and the cooling water passage 52, returns to the water pump 37. The cooling water is branched into the cooling water passage 60 by the multi-way valve 36 and rejoins into the cooling water passage 52 through the throttle 32, the EGR valve 31, the cooling water passage 61 and the heater core 15.

As described above, the present embodiment includes the water pump 37 as the other end side water pump provided in the cooling water passage 52 which is the other end side external passage connected to the other end portion 512. The water pump 11 and the water pump 37 are arranged so that their discharge directions are opposite to each other. By arranging in this way, the flow of the cooling water in the case of driving the water pump 11 and the flow of the cooling water in the case of driving the water pump 37 can be reversed, so that the water pump 11 and the water pump 37 are alternately driven so as to execute the water flow switching control.

The water flow switching unit 303K forms the forward flow by driving the water pump 11, and drives the water pump 37 to form the reverse flow.

Figure 55:
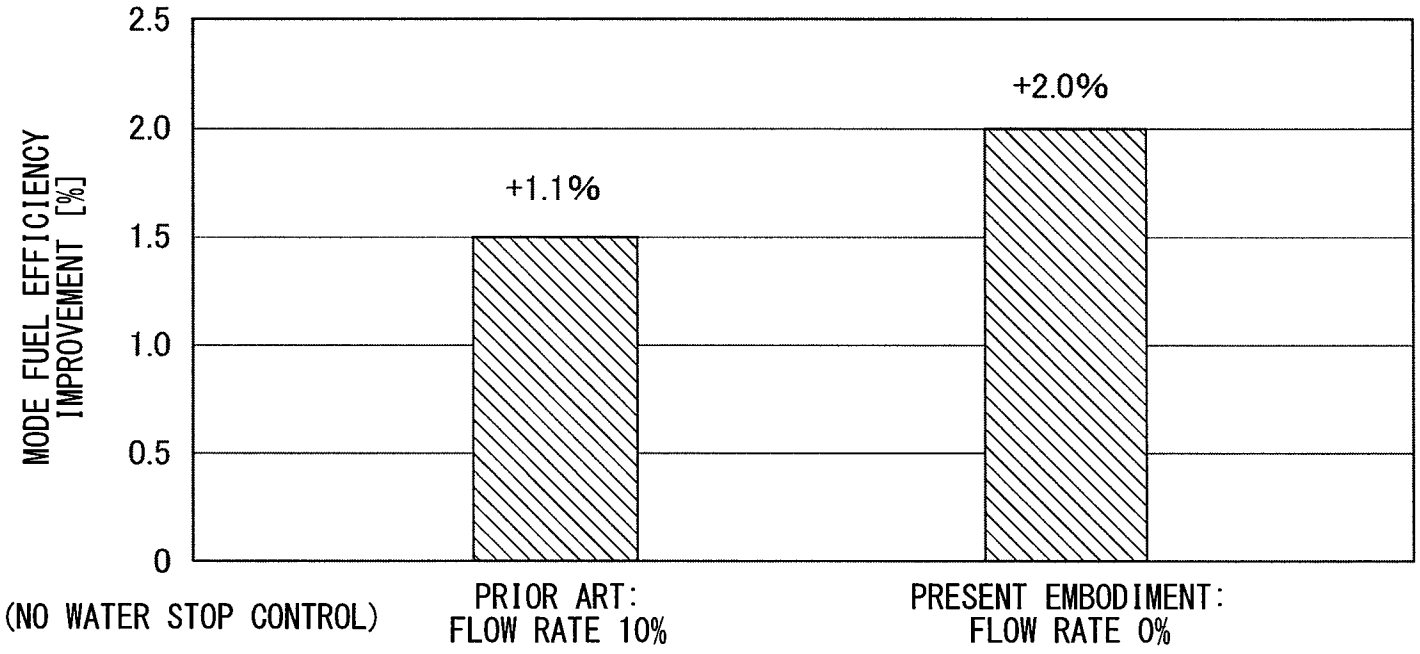
FIG. 55 is a diagram for explaining an effect of improving fuel economy.

When the water stop control is executed, the fuel economy of the internal combustion engine 10 can be improved. As shown in FIG. 55, the fuel efficiency improvement effect is 0.9% as compared with the case where the water stop control is not executed completely.

The embodiments have been described with reference to specific examples above. However, the present disclosure is not limited to these specific examples. Those skilled in the art appropriately design modifications to these specific examples, which are also included in the scope of the present disclosure as long as they have the features of the present disclosure. The elements, the arrangement, the conditions, the shape, etc. of the specific examples described above are not limited to those exemplified and can be appropriately modified. The combinations of elements included in each of the above described specific examples can be appropriately modified as long as no technical inconsistency occurs.

In the present embodiment, as the internal combustion engine warms up, the temperature of the cooling water rises locally in the internal passage. Therefore, by causing a flow to the cooling water, the cooling water whose temperature has been locally raised moves to a place where the temperature hardly rises so as to avoid boiling. Further, according to the present disclosure, since the control for switching the water flow is executed, the flow of the cooling water in the internal passage can be switched between the forward flow and the reverse flow. It is possible to flow the once-warmed cooling water back into the internal combustion engine, by flowing the cooling water while switching the flow in an opposite direction. Therefore, earlier warm-up can be realized while avoiding local boiling.

The invention claimed is:

1. A cooling system for cooling an internal combustion engine, comprising:

an internal passage that circulates cooling water inside the internal combustion engine;

a water pump provided in one end side external passage connected to one end portion of the internal passage;

a water flow switching unit configured to execute a water flow switching control that switches the cooling water flow in the internal passage between a forward flow directed from the one end portion to the other end portion of the internal passage and a reverse flow directed from the other end portion to the one end portion;

a bypass passage configured to divert and rejoin the cooling water into the other end portion side of the internal passage and/or the other end side external passage connected to the other end portion side;

a cooling water reservoir provided in the bypass passage and capable of temporarily storing and discharging the cooling water; and a two-way valve provided in the other end side or the other end side external passage of the internal passage in parallel with the bypass passage, wherein the water flow switching unit executes the water flow switching control by controlling the water pump and the two-way valve.

2. The cooling system according to claim 1, further comprising:

a water temperature acquisition unit configured to acquire temperature of the cooling water inside the internal combustion engine, wherein the water flow switching unit executes the water flow switching control, when the temperature of the cooling water in the internal combustion engine reaches a lower threshold temperature.

3. The cooling system according to claim 2, wherein the water flow switching unit ends the water flow switching control, when the temperature of the cooling water inside the internal combustion engine reaches an upper threshold temperature higher than the lower threshold temperature.

4. The cooling system according to claim 1, wherein the water flow switching unit executes the water flow switching control that forms the forward flow by driving the water pump while closing the two-way valve, and forms the reverse flow by stopping the water pump while closing the two-way valve.

5. The cooling system according to claim 1, wherein the cooling water reservoir includes a storage chamber connected to the bypass passage and into which the cooling water flows, a piston configured to divide the storage chamber, a biasing member urging the piston against the cooling water flowing into the storage chamber.

6. A cooling system for cooling an internal combustion engine, comprising:

an internal passage that circulates cooling water inside the internal combustion engine;

a water pump provided in one end side external passage connected to one end portion of the internal passage;

a water flow switching unit configured to execute a water flow switching control that switches the cooling water flow in the internal passage between a forward flow directed from the one end portion to the other end portion of the internal passage and a reverse flow directed from the other end portion to the one end portion;

an other end side external passage connected to the other end portion;

a first communication passage and a second communication passage connecting the one end side external passage and the other end side external passage; and switching valves configured to switch a forward flow and a reverse flow of the cooling water discharged from the discharge port of the water pump, wherein the forward flow passes the internal combustion engine through the one end side external passage, and returns from the other end side external passage to the inlet port of the water pump, and the reverse flow passes the internal combustion engine through the first communication passage, and through the other end side external passage, and returns from the one end side external passage and the second communication passage to the suction port, wherein the water flow switching unit executes the water flow switching control by driving the water pump while controlling the switching valve, the switching valve has a first valve, a second valve, a third valve, and a fourth valve, all of which are two-way valves, the first valve is provided in the second communication passage, the second valve is provided between a branch portion to the first communication passage and a branch portion of the second communication passage in the one end side external passage, the third valve is provided between a branch portion to the first communication passage and a branch portion of the second communication passage in the other end side external passage, the fourth valve is provided in the first communication passage, and the water flow switching unit executes the water flow switching control in which the forward flow is formed by opening the second valve and the third valve while closing the first valve and the fourth valve and driving the water pump, and the reverse flow is formed by opening the first valve and the fourth valve while closing the valve and the third valve and driving the water pump.

7. A cooling system for cooling an internal combustion engine, comprising:

an internal passage that circulates cooling water inside the internal combustion engine;

a water pump provided in one end side external passage connected to one end portion of the internal passage;

a water flow switching unit configured to execute a water flow switching control that switches the cooling water flow in the internal passage between a forward flow directed from the one end portion to the other end portion of the internal passage and a reverse flow directed from the other end portion to the one end portion;

an other end side external passage connected to the other end portion;

a first communication passage and a second communication passage connecting the one end side external passage and the other end side external passage; and switching valves configured to switch a forward flow and a reverse flow of the cooling water discharged from the discharge port of the water pump, wherein the forward flow passes the internal combustion engine through the one end side external passage, and returns from the other end side external passage to the inlet port of the water pump, and the reverse flow passes the internal combustion engine through the first communication passage, and through the other end side external passage, and returns from the one end side external passage and the second communication passage to the suction port, wherein the water flow switching unit executes the water flow switching control by driving the water pump while controlling the switching valve, the switching valve has a first valve and a second valve, each of which is three-way valve, the first valve is provided at a branch portion between the one end side external passage and the second communication passage, the second valve is provided at the branch portion between the other end side external passage and the first communication passage, and the water flow switching unit executes the water flow switching control that drives the water pump while switching the first valve and the second valve so as to form the forward flow, and drives the water pump while switching the first valve and the second valve so as to form the reverse flow.

8. The cooling system according to claim 7, wherein the first valve and the second valve are configured to be adjustable in flow rate.

9. A cooling system for cooling an internal combustion engine, comprising:

an internal passage that circulates cooling water inside the internal combustion engine;

a water pump provided in one end side external passage connected to one end portion of the internal passage;

a water flow switching unit configured to execute a water flow switching control that switches the cooling water flow in the internal passage between a forward flow directed from the one end portion to the other end portion of the internal passage and a reverse flow directed from the other end portion to the one end portion;

a bypass passage configured to branch the cooling water from the dividing portion of the one end side external passage and rejoin the cooling water to the other end side external passage connected to the other end portion side of the internal passage;

a check valve provided in the bypass passage;

a three-way valve provided between the dividing portion of the one end side external passage and the one end portion;

a communication passage connecting the three-way valve and an other end side external passage connected to the other end portion; and the water flow switching unit executes the water flow switching control by controlling the water pump and the three-way valve.

10. The cooling system according to claim 9, wherein the water flow switching unit executes the water flow switching control that drives the water pump while switching the three-way valve so as to flow the cooling water from the dividing portion to the one end portion, and drives the water pump while switching the three-way valve so as to flow the cooling water from the one end portion to the communication passage.

* * * * *